US010279934B2

(12) United States Patent
Christensen et al.

(10) Patent No.: US 10,279,934 B2
(45) Date of Patent: May 7, 2019

(54) FILLABLE VAPORIZER CARTRIDGE AND METHOD OF FILLING

(71) Applicant: JUUL LABS, INC., San Francisco, CA (US)

(72) Inventors: Steven Christensen, San Mateo, CA (US); Aaron Keller, San Francisco, CA (US); James Monsees, San Francisco, CA (US); Ariel Atkins, San Francisco, CA (US)

(73) Assignee: JUUL Labs, Inc., San Francisco, CA (US)

( * ) Notice: Subject to any disclaimer, the term of this patent is extended or adjusted under 35 U.S.C. 154(b) by 0 days.

(21) Appl. No.: 15/430,284

(22) Filed: Feb. 10, 2017

(65) Prior Publication Data

US 2017/0233114 A1 Aug. 17, 2017

Related U.S. Application Data

(60) Provisional application No. 62/294,285, filed on Feb. 11, 2016.

(51) Int. Cl.

| | |
|---|---|
| ***B65B 3/00*** | (2006.01) |
| ***A24F 47/00*** | (2006.01) |
| ***B65B 3/14*** | (2006.01) |
| ***B65B 3/18*** | (2006.01) |

(52) U.S. Cl.

CPC ..... *B65B 3/003* (2013.01); *A24F 47/008* (2013.01); *B65B 3/14* (2013.01); *B65B 3/18* (2013.01)

(58) Field of Classification Search

CPC ..... A24F 47/008; B65B 3/003; B65B 3/14; B65B 3/18

See application file for complete search history.

(56) References Cited

U.S. PATENT DOCUMENTS

| | | | |
|---|---|---|---|
| 374,584 | A | 12/1887 | Cook |
| 576,653 | A | 2/1897 | Bowlby |
| 595,070 | A | 12/1897 | Oldenbusch |
| 720,007 | A | 2/1903 | Edwin Grant Dexter |
| 799,844 | A | 9/1905 | Fuller |

(Continued)

FOREIGN PATENT DOCUMENTS

| | | | |
|---|---|---|---|
| AU | 2014206215 | A1 | 8/2014 |
| AU | 2014208287 | A1 | 8/2014 |

(Continued)

OTHER PUBLICATIONS

"Commission Regulation (EC) No. 1275/2008,"Official Journal of the European Union, Dec. 17, 2008.

(Continued)

*Primary Examiner* — Timothy L Maust
*Assistant Examiner* — Timothy P Kelly
(74) *Attorney, Agent, or Firm* — Mintz Levin Cohn Ferris Glovsky and Popeo, P.C.

(57) ABSTRACT

Methods of filling a tank reservoir of an electronic cigarette or cartridge for an electronic cigarette with a vaporizable material so that air is not entrapped within the cartridge. In particular, described herein are methods of filing a tank volume of a cartridge for an electronic cigarette from a bottom or side surface opposite a wick so that the wick remains at least partially dry and can vent air during filling until the tank volume is full.

42 Claims, 9 Drawing Sheets

(56) References Cited

U.S. PATENT DOCUMENTS 968,160 A 8/1910 Edward Hibberd Johnson
969,076 A 8/1910 Pender
1,067,531 A 7/1913 MacGregor
1,163,183 A 12/1915 Stoll
1,299,162 A 4/1919 Fisher
1,505,748 A 8/1924 Louis
1,552,877 A 9/1925 Phillipps et al.
1,632,335 A 6/1927 Hiering
1,706,244 A 3/1929 Louis
1,845,340 A 2/1932 Ritz
1,972,118 A 9/1934 McDill
1,998,683 A 4/1935 Montgomery
2,031,363 A 2/1936 Elof
2,039,559 A 5/1936 Segal
2,104,266 A 1/1938 McCormick
2,159,698 A 5/1939 Harris et al.
2,177,636 A 10/1939 Coffelt et al.
2,195,260 A 3/1940 Rasener
2,231,909 A 2/1941 Hempal
2,327,120 A 8/1943 McCoon
D142,178 S 8/1945 Ann Becwar
2,460,427 A 2/1949 Musselman et al.
2,483,304 A 9/1949 Rudolf
2,502,561 A 4/1950 Ludwig
2,765,949 A 10/1956 Swan
2,830,597 A 4/1958 Kummli
2,860,638 A 11/1958 Bartolomeo
2,897,958 A 8/1959 Tarleton et al.
2,935,987 A 5/1960 Ackerbauer
3,146,937 A 9/1964 Joseph
3,258,015 A 6/1966 Ellis et al.
3,271,719 A 9/1966 Ovshinsky
3,292,634 A 12/1966 Beucler
D207,887 S 6/1967 Francis Leroy Parsisson
3,373,915 A 3/1968 Anderson et al.
3,420,360 A 1/1969 Young
3,443,827 A 5/1969 Acker et al.
3,456,645 A 7/1969 Brock
3,479,561 A 11/1969 Janning
3,567,014 A 3/1971 Feigelman
3,675,661 A 7/1972 Weaver
3,707,017 A 12/1972 Paquette
3,723,048 A 3/1973 Russell
3,792,704 A 2/1974 Parker
3,815,597 A 6/1974 Goettelman
3,861,523 A 1/1975 Fountain et al.
3,941,300 A 3/1976 Troth
4,020,853 A 5/1977 Nuttall
4,049,005 A 9/1977 Hernandez et al.
4,066,088 A 1/1978 Ensor
D250,485 S 12/1978 Cuthbertson
D255,548 S 6/1980 Grodin
4,207,976 A 6/1980 Herman
4,215,708 A 8/1980 Bron
4,219,032 A 8/1980 Tabatznik et al.
D260,690 S 9/1981 Stutzer
4,303,083 A 12/1981 Burruss, Jr.
D271,255 S 11/1983 Rousseau
4,506,683 A 3/1985 Cantrell et al.
4,519,319 A 5/1985 Howlett
4,520,938 A 6/1985 Finke
D280,494 S 9/1985 Abel
4,595,024 A 6/1986 Greene et al.
4,625,737 A 12/1986 Keritsis et al.
4,648,393 A 3/1987 Landis et al.
4,708,151 A 11/1987 Shelar
4,735,217 A 4/1988 Gerth et al.
4,771,796 A 9/1988 Myer
4,793,365 A 12/1988 Sensabaugh, Jr. et al.
4,794,323 A 12/1988 Zhou et al.
4,798,310 A 1/1989 Kasai et al.
4,813,536 A 3/1989 Willis
4,819,665 A 4/1989 Roberts et al.
4,830,028 A 5/1989 Lawson et al.
D301,837 S 6/1989 Peterson et al.
4,836,224 A 6/1989 Lawson et al.
4,846,199 A 7/1989 Rose
4,848,374 A 7/1989 Chard et al.
4,848,563 A 7/1989 Robbins
D302,659 S 8/1989 Peterson et al.
D303,722 S 9/1989 Marlow et al.
4,870,748 A 10/1989 Hensgen et al.
D304,771 S 11/1989 Katayama
4,893,639 A 1/1990 White
4,896,683 A 1/1990 Cohen et al.
4,907,606 A 3/1990 Lilja et al.
4,924,883 A 5/1990 Perfetti et al.
4,938,236 A 7/1990 Banerjee et al.
4,941,483 A 7/1990 Ridings et al.
4,944,317 A 7/1990 Thal
D310,171 S 8/1990 Cusenza
4,945,929 A 8/1990 Egilmex
4,947,874 A 8/1990 Brooks et al.
4,947,875 A 8/1990 Brooks et al.
D310,349 S 9/1990 Rowen
4,955,397 A 9/1990 Johnson et al.
4,984,588 A 1/1991 Stewart, Jr.
D315,032 S 2/1991 Hayes
5,005,759 A 4/1991 Bouche
5,019,122 A 5/1991 Clearman et al.
5,020,548 A 6/1991 Farrier et al.
5,027,836 A 7/1991 Shannon et al.
5,031,646 A 7/1991 Lippiello et al.
5,040,551 A 8/1991 Schlatter et al.
5,050,621 A 9/1991 Creighton et al.
5,060,671 A 10/1991 Counts et al.
5,065,776 A 11/1991 Lawson et al.
5,076,297 A 12/1991 Farrier et al.
5,101,838 A 4/1992 Schwartz et al.
5,105,831 A 4/1992 Banerjee et al.
5,105,836 A 4/1992 Gentry et al.
5,105,838 A 4/1992 White et al.
5,123,530 A 6/1992 Lee
5,133,368 A 7/1992 Neumann et al.
5,141,004 A 8/1992 Porenski
5,144,962 A 9/1992 Counts et al.
5,148,817 A 9/1992 Houminer et al.
5,152,456 A 10/1992 Ross et al.
5,183,062 A 2/1993 Clearman et al.
D336,346 S 6/1993 Miller et al.
5,224,498 A 7/1993 Deevi et al.
5,228,460 A 7/1993 Sprinkel et al.
5,240,012 A 8/1993 Ehrman et al.
5,249,586 A 10/1993 Morgan et al.
5,261,424 A 11/1993 Sprinkel, Jr.
5,269,237 A 12/1993 Baker et al.
5,269,327 A 12/1993 Counts et al.
5,296,685 A 3/1994 Burstein et al.
5,303,720 A 4/1994 Banerjee et al.
5,322,075 A 6/1994 Deevi et al.
5,324,498 A 6/1994 Streusand et al.
5,345,951 A 9/1994 Serrano et al.
5,369,723 A 11/1994 Counts et al.
5,372,148 A 12/1994 McCafferty et al.
5,388,574 A 2/1995 Lngebrethsen
5,449,078 A 9/1995 Akers
5,456,269 A 10/1995 Kollasch
5,472,001 A 12/1995 Nicholson
D367,605 S 3/1996 Moore
5,497,791 A 3/1996 Bowen et al.
D368,552 S 4/1996 Adams
5,529,078 A 6/1996 Rehder et al.
D371,633 S 7/1996 Chenard
5,545,904 A 8/1996 Orbach
5,564,442 A 10/1996 MacDonald et al.
5,579,934 A 12/1996 Buono
5,591,368 A 1/1997 Fleischhauer et al.
5,605,226 A 2/1997 Hernlein
D379,810 S 6/1997 Giordano, Jr. et al.
5,641,064 A 6/1997 Goserud
D380,293 S 7/1997 Cudmore
5,649,552 A 7/1997 Cho et al.
D382,146 S 8/1997 Sandy
5,666,977 A 9/1997 Higgins et al.

(56) References Cited

U.S. PATENT DOCUMENTS 5,666,978 A 9/1997 Counts et al.
5,708,258 A 1/1998 Counts et al.
5,730,118 A 3/1998 Hermanson
5,730,158 A 3/1998 Collins et al.
5,746,587 A 5/1998 Racine et al.
D397,504 S 8/1998 Zelenik
D398,150 S 9/1998 Vonarburg
5,810,164 A 9/1998 Rennecamp
5,819,756 A 10/1998 Mielordt
5,845,649 A 12/1998 Saito et al.
D405,007 S 2/1999 Naas, Sr.
5,865,185 A 2/1999 Collins et al.
5,865,186 A 2/1999 Volsey, II
5,881,884 A 3/1999 Podosek
5,894,841 A 4/1999 Voges
D411,332 S 6/1999 Zelenik
D412,279 S 7/1999 Brice
5,931,828 A 8/1999 Durkee
5,934,289 A 8/1999 Watkins et al.
5,938,018 A 8/1999 Keaveney et al.
5,944,025 A 8/1999 Cook et al.
5,954,979 A 9/1999 Counts et al.
D414,893 S 10/1999 Moore
5,967,310 A 10/1999 Hill
5,975,415 A 11/1999 Zehnal
5,979,460 A 11/1999 Matsumura
5,994,025 A 11/1999 Iwasa et al.
5,996,589 A 12/1999 St Charles
6,024,097 A 2/2000 Von Wielligh
6,026,820 A 2/2000 Baggett, Jr. et al.
6,040,560 A 3/2000 Fleischhauer et al.
D422,884 S 4/2000 Lafond
6,053,176 A 4/2000 Adams et al.
D424,236 S 5/2000 Reed
6,089,857 A 7/2000 Matsuura et al.
6,095,153 A 8/2000 Kessler et al.
6,102,036 A 8/2000 Slutsky et al.
6,119,684 A 9/2000 Nohl et al.
6,125,853 A 10/2000 Susa et al.
D433,532 S 11/2000 Higgins et al.
6,155,268 A 12/2000 Takeuchi
6,164,287 A 12/2000 White
D436,686 S 1/2001 Fujisawa
6,196,232 B1 3/2001 Chkadua
6,216,705 B1 4/2001 Ossepian
D442,328 S 5/2001 Barmes
6,234,169 B1 5/2001 Bulbrook et al.
6,265,789 B1 7/2001 Honda et al.
D447,276 S 8/2001 Gustafson
6,269,966 B1 8/2001 Pallo et al.
D450,313 S 11/2001 Koinuma
D450,662 S 11/2001 Kwok
6,324,261 B1 11/2001 Merte
6,349,728 B1 2/2002 Pham
D454,079 S 3/2002 Fong
6,381,739 B1 4/2002 Breternitz, Jr. et al.
6,386,371 B1 5/2002 Parsons
6,407,371 B1 6/2002 Toya et al.
6,418,938 B1 7/2002 Fleischhauer et al.
6,431,363 B1 8/2002 Hacker
6,443,146 B1 9/2002 Voges
6,446,793 B1 9/2002 Layshock
D465,660 S 11/2002 Doeing
6,510,982 B2 1/2003 White et al.
D471,104 S 3/2003 Hunt
6,532,965 B1 3/2003 Abhulimen et al.
6,536,442 B2 3/2003 St Charles et al.
6,557,708 B2 5/2003 Polacco
6,598,607 B2 7/2003 Adiga et al.
D477,920 S 8/2003 McCarty et al.
D478,569 S 8/2003 Hussaini et al.
D478,897 S 8/2003 Tsuge
6,603,924 B2 8/2003 Brown et al.
6,606,998 B1 8/2003 Gold
6,612,404 B2 9/2003 Sweet et al.
6,615,840 B1 9/2003 Fournier et al.
6,622,867 B2 9/2003 Menceles
6,637,430 B1 * 10/2003 Voges ..... A61M 15/0065 128/200.14
6,655,379 B2 12/2003 Clark et al.
D485,639 S 1/2004 Stronski
6,672,762 B1 1/2004 Faircloth et al.
6,688,313 B2 2/2004 Wrenn et al.
6,707,274 B1 3/2004 Karr
6,708,846 B1 3/2004 Fuchs et al.
6,726,006 B1 4/2004 Funderburk et al.
6,743,030 B2 6/2004 Lin et al.
6,752,649 B2 6/2004 Arkin et al.
D494,315 S 8/2004 Cartier
6,769,436 B2 8/2004 Horian
6,772,756 B2 8/2004 Shayan
D495,599 S 9/2004 Biesecker
6,799,576 B2 10/2004 Farr
6,803,545 B2 10/2004 Blake et al.
6,803,744 B1 10/2004 Sabo
6,805,545 B2 10/2004 Slaboden
6,810,883 B2 11/2004 Felter et al.
D500,301 S 12/2004 Deguchi
D500,302 S 12/2004 Deguchi
6,827,573 B2 12/2004 St Charles et al.
6,854,470 B1 2/2005 Pu
6,874,507 B2 4/2005 Farr
D505,922 S 6/2005 Mayo et al.
D506,447 S 6/2005 Mayo et al.
D506,731 S 6/2005 Mayo et al.
6,909,840 B2 6/2005 Harwig et al.
D507,244 S 7/2005 Mayo et al.
6,923,890 B2 8/2005 Ricatto et al.
6,954,979 B2 10/2005 Logan
6,994,096 B2 2/2006 Rostami et al.
7,000,775 B2 2/2006 Gelardi et al.
7,015,796 B2 3/2006 Snyder
7,025,066 B2 4/2006 Lawson et al.
D523,171 S 6/2006 Mitten et al.
D525,948 S 8/2006 Blair et al.
7,082,825 B2 8/2006 Aoshima et al.
D528,992 S 9/2006 Hobart et al.
D529,044 S 9/2006 Andre et al.
7,109,876 B2 9/2006 Smith et al.
D530,340 S 10/2006 Andre et al.
D531,190 S 10/2006 Lee et al.
7,117,707 B2 10/2006 Adams et al.
D534,921 S 1/2007 Andre et al.
D535,261 S 1/2007 Daniels
D535,308 S 1/2007 Andre et al.
7,185,659 B2 3/2007 Sharpe
D539,813 S 4/2007 Chen
D540,687 S 4/2007 Egawa
D540,749 S 4/2007 Kaule
7,214,075 B2 5/2007 He et al.
D544,643 S 6/2007 Lin
D545,303 S 6/2007 Chang
7,234,593 B2 6/2007 Fath et al.
D545,904 S 7/2007 Chen et al.
D546,782 S 7/2007 Poulet et al.
D547,002 S 7/2007 Lin
D551,548 S 9/2007 Didier
D551,970 S 10/2007 Didier
7,275,941 B1 10/2007 Bushby
D556,154 S 11/2007 Poulet et al.
7,290,549 B2 11/2007 Banerjee et al.
D557,209 S 12/2007 Ahlgren et al.
D558,060 S 12/2007 Šir et al.
D562,151 S 2/2008 Larocca et al.
D565,496 S 4/2008 Disla
D568,298 S 5/2008 Lundgren et al.
D569,727 S 5/2008 Moretti
7,374,048 B2 5/2008 Mazurek
D571,202 S 6/2008 Vogt
D571,556 S 6/2008 Raile
D573,474 S 7/2008 Beam et al.
7,415,982 B1 8/2008 Sheridan
D576,619 S 9/2008 Udagawa et al.
D577,019 S 9/2008 Udagawa et al.

(56) References Cited

U.S. PATENT DOCUMENTS

| | | | |
|---|---|---|---|
| D577,150 | S | 9/2008 | Bryman et al. |
| D577,591 | S | 9/2008 | Bouroullec et al. |
| 7,428,905 | B2 | 9/2008 | Mua |
| 7,434,584 | B2 | 10/2008 | Steinberg |
| D580,756 | S | 11/2008 | Seebold |
| D585,077 | S | 1/2009 | Sheba et al. |
| 7,488,171 | B2 | 2/2009 | St Charles et al. |
| D589,941 | S | 4/2009 | Maier et al. |
| D590,988 | S | 4/2009 | Hon |
| D590,989 | S | 4/2009 | Hon |
| D590,990 | S | 4/2009 | Hon |
| D590,991 | S | 4/2009 | Hon |
| D591,758 | S | 5/2009 | Lee |
| 7,530,352 | B2 | 5/2009 | Childers et al. |
| 7,546,703 | B2 | 6/2009 | Johnske et al. |
| D599,670 | S | 9/2009 | Qin |
| 7,581,540 | B2 | 9/2009 | Hale et al. |
| 7,621,403 | B2 | 11/2009 | Althoff et al. |
| D605,509 | S | 12/2009 | Leonardis |
| D606,505 | S | 12/2009 | Seflic et al. |
| 7,633,270 | B2 | 12/2009 | Wong et al. |
| 7,644,823 | B2 | 1/2010 | Gelardi et al. |
| D610,588 | S | 2/2010 | Chen |
| D611,409 | S | 3/2010 | Green et al. |
| D616,753 | S | 6/2010 | Beam et al. |
| 7,726,320 | B2 | 6/2010 | Robinson et al. |
| 7,753,055 | B2 | 7/2010 | Bryman |
| D621,357 | S | 8/2010 | Dong |
| 7,767,698 | B2 | 8/2010 | Warchol et al. |
| D624,238 | S | 9/2010 | Turner |
| 7,793,860 | B2 | 9/2010 | Bankers et al. |
| 7,793,861 | B2 | 9/2010 | Bankers et al. |
| 7,801,573 | B2 | 9/2010 | Yazdi et al. |
| D624,880 | S | 10/2010 | Felegy, Jr. et al. |
| 7,813,832 | B2 | 10/2010 | Sundar |
| 7,815,332 | B1 | 10/2010 | Smith |
| D627,962 | S | 11/2010 | Mudrick |
| 7,832,397 | B2 | 11/2010 | Lipowicz |
| 7,832,410 | B2 | 11/2010 | Hon |
| 7,845,359 | B2 | 12/2010 | Montaser |
| D631,055 | S | 1/2011 | Gilbert et al. |
| D631,458 | S | 1/2011 | Liao et al. |
| 7,886,507 | B2 | 2/2011 | McGuinness, Jr. |
| D634,735 | S | 3/2011 | Maier |
| 7,905,236 | B2 | 3/2011 | Bryman et al. |
| 7,913,686 | B2 | 3/2011 | Hughes et al. |
| D639,303 | S | 6/2011 | Ni et al. |
| D639,782 | S | 6/2011 | Kim |
| D641,718 | S | 7/2011 | Sakai |
| D642,330 | S | 7/2011 | Turner |
| D644,375 | S | 8/2011 | Zhou |
| 7,987,846 | B2 | 8/2011 | Hale et al. |
| 7,988,034 | B2 | 8/2011 | Pezzoli |
| 8,003,080 | B2 | 8/2011 | Rabinowitz et al. |
| D645,817 | S | 9/2011 | Sasada et al. |
| D647,247 | S | 10/2011 | Jones |
| 8,042,550 | B2 | 10/2011 | Urtsev et al. |
| D649,708 | S | 11/2011 | Oneil |
| D649,932 | S | 12/2011 | Symons |
| 8,079,371 | B2 | 12/2011 | Robinson et al. |
| 8,080,975 | B2 | 12/2011 | Bessa et al. |
| 8,091,558 | B2 | 1/2012 | Martzel |
| D653,803 | S | 2/2012 | Timmermans |
| D656,496 | S | 3/2012 | Andre et al. |
| 8,141,701 | B2 | 3/2012 | Hodges |
| 8,156,944 | B2 | 4/2012 | Han |
| 8,157,918 | B2 | 4/2012 | Becker et al. |
| D661,889 | S | 6/2012 | Wu |
| D661,991 | S | 6/2012 | Brummelhuis et al. |
| 8,205,622 | B2 | 6/2012 | Pan |
| D664,146 | S | 7/2012 | Hoehn et al. |
| D664,636 | S | 7/2012 | Robinson et al. |
| 8,251,060 | B2 | 8/2012 | White et al. |
| 8,282,995 | B2 | 10/2012 | Calzia et al. |
| D670,272 | S | 11/2012 | Suzuki |
| D670,659 | S | 11/2012 | Ishikawa et al. |
| 8,308,624 | B2 | 11/2012 | Travers et al. |
| 8,314,235 | B2 | 11/2012 | Dixit et al. |
| D672,715 | S | 12/2012 | Brunner et al. |
| 8,322,350 | B2 | 12/2012 | Lipowicz |
| D674,182 | S | 1/2013 | Copeland et al. |
| D674,748 | S | 1/2013 | Ferber et al. |
| 8,344,693 | B2 | 1/2013 | Budziszek et al. |
| D676,741 | S | 2/2013 | Van Landsveld et al. |
| 8,371,310 | B2 | 2/2013 | Brenneise |
| 8,375,957 | B2 | 2/2013 | Hon |
| 8,381,739 | B2 | 2/2013 | Gonda |
| 8,387,612 | B2 | 3/2013 | Damani et al. |
| 8,393,331 | B2 | 3/2013 | Hon |
| 8,402,978 | B2 | 3/2013 | Karles et al. |
| 8,424,539 | B2 | 4/2013 | Braunshteyn et al. |
| D681,445 | S | 5/2013 | Van Landsveld et al. |
| D682,090 | S | 5/2013 | Scatterday |
| D682,698 | S | 5/2013 | Young |
| D682,841 | S | 5/2013 | Suetake et al. |
| 8,443,534 | B2 | 5/2013 | Goodfellow et al. |
| D684,683 | S | 6/2013 | Curti et al. |
| 8,464,867 | B2 | 6/2013 | Holloway et al. |
| D686,336 | S | 7/2013 | Horian |
| D686,987 | S | 7/2013 | Vanstone et al. |
| D687,042 | S | 7/2013 | Yoneta et al. |
| 8,479,747 | B2 | 7/2013 | O'Connell |
| 8,490,629 | B1 | 7/2013 | Shenassa et al. |
| 8,495,998 | B2 | 7/2013 | Schennum |
| 8,499,766 | B1 | 8/2013 | Newton |
| 8,511,318 | B2 | 8/2013 | Hon |
| D690,461 | S | 9/2013 | Chen |
| 8,539,959 | B1 | 9/2013 | Scatterday |
| 8,541,401 | B2 | 9/2013 | Mishra et al. |
| D691,324 | S | 10/2013 | Saliman |
| D692,615 | S | 10/2013 | Verleur |
| 8,550,069 | B2 | 10/2013 | Alelov |
| 8,552,691 | B2 | 10/2013 | Wu |
| D693,054 | S | 11/2013 | Verleur |
| 8,578,942 | B2 | 11/2013 | Schennum |
| 8,578,943 | B2 | 11/2013 | Luan et al. |
| D695,450 | S | 12/2013 | Benassayag et al. |
| D696,051 | S | 12/2013 | Scatterday |
| 8,596,460 | B2 | 12/2013 | Scatterday |
| 8,646,462 | B2 | 2/2014 | Yamada et al. |
| D700,572 | S | 3/2014 | Esses |
| 8,671,952 | B2 | 3/2014 | Winterson et al. |
| 8,678,012 | B2 | 3/2014 | Li et al. |
| 8,689,789 | B2 | 4/2014 | Andrus et al. |
| 8,689,805 | B2 | 4/2014 | Hon |
| 8,695,794 | B2 | 4/2014 | Scatterday |
| 8,707,965 | B2 | 4/2014 | Newton |
| D704,629 | S | 5/2014 | Liu |
| D704,634 | S | 5/2014 | Eidelman et al. |
| D705,918 | S | 5/2014 | Robinson et al. |
| 8,714,150 | B2 | 5/2014 | Alelov |
| 8,714,161 | B2 | 5/2014 | Liu |
| 8,733,345 | B2 | 5/2014 | Siller |
| 8,733,346 | B2 | 5/2014 | Rinker |
| D707,389 | S | 6/2014 | Liu |
| D707,627 | S | 6/2014 | Brunner et al. |
| 8,739,788 | B2 | 6/2014 | Yomtov |
| 8,741,348 | B2 | 6/2014 | Hansson et al. |
| 8,752,545 | B2 | 6/2014 | Buchberger |
| 8,752,557 | B2 | 6/2014 | Lipowicz |
| 8,757,169 | B2 | 6/2014 | Gysland |
| D708,727 | S | 7/2014 | Postma |
| 8,770,187 | B2 | 7/2014 | Murphy |
| 8,781,307 | B2 | 7/2014 | Buzzetti |
| 8,790,556 | B2 | 7/2014 | Bundren et al. |
| 8,794,231 | B2 | 8/2014 | Thorens et al. |
| 8,794,244 | B2 | 8/2014 | Hammel et al. |
| 8,794,245 | B1 | 8/2014 | Scatterday |
| 8,807,140 | B1 | 8/2014 | Scatterday |
| 8,809,261 | B2 | 8/2014 | Elsohly et al. |
| 8,813,747 | B2 | 8/2014 | Gibson et al. |
| 8,813,759 | B1 | 8/2014 | Horian |
| 8,820,330 | B2 | 9/2014 | Bellinger et al. |
| 8,829,395 | B2 | 9/2014 | Bao |

(56) References Cited

U.S. PATENT DOCUMENTS 8,851,068 B2 10/2014 Cohen et al.
8,851,081 B2 10/2014 Fernando et al.
8,851,083 B2 10/2014 Oglesby et al.
8,857,446 B2 10/2014 Wu
8,863,752 B2 10/2014 Hon
8,869,792 B1 10/2014 Lee
8,881,737 B2 11/2014 Collett et al.
8,881,738 B2 11/2014 Bryman
8,893,726 B2 11/2014 Hon
8,897,628 B2 11/2014 Conley et al.
D718,621 S 12/2014 Mitchell et al.
D718,723 S 12/2014 Clymer et al.
D718,933 S 12/2014 Brown, Jr.
D719,701 S 12/2014 Scatterday
D720,095 S 12/2014 Alima
D720,496 S 12/2014 Alima
D720,497 S 12/2014 Alima
8,899,238 B2 12/2014 Robinson et al.
8,899,240 B2 12/2014 Mass
8,905,040 B2 12/2014 Scatterday et al.
8,910,630 B2 12/2014 Todd
8,910,639 B2 12/2014 Chang et al.
8,910,640 B2 12/2014 Sears et al.
8,910,641 B2 12/2014 Hon
8,910,783 B2 12/2014 Liu
8,915,254 B2 12/2014 Monsees et al.
8,919,561 B2 12/2014 Boisseau
D721,202 S 1/2015 Liu
D721,577 S 1/2015 Scatterday
8,925,555 B2 1/2015 Monsees et al.
8,928,277 B2 1/2015 Xiang et al.
8,931,492 B2 1/2015 Scatterday
D721,972 S 2/2015 Brewer et al.
D722,023 S 2/2015 Brunner et al.
8,948,578 B2 2/2015 Buchberger
8,950,395 B2 2/2015 Schennum
8,955,522 B1 2/2015 Bowen et al.
8,960,199 B2 2/2015 Zhuang et al.
8,963,725 B2 2/2015 Xiang
D723,735 S 3/2015 Liu
D723,736 S 3/2015 Liu
D724,037 S 3/2015 Yoshioka
D725,310 S 3/2015 Eksouzian
D725,823 S 3/2015 Scatterday et al.
8,967,382 B2 3/2015 Liu
8,973,587 B2 3/2015 Liu
8,975,764 B1 3/2015 Abehasera
8,978,663 B2 3/2015 Newton
8,991,402 B2 3/2015 Bowen et al.
D726,727 S 4/2015 Holz et al.
9,010,335 B1 4/2015 Scatterday
9,016,274 B1 4/2015 White
9,018,899 B2 4/2015 Xiang
D728,855 S 5/2015 Liu
D729,030 S 5/2015 Novick et al.
D729,277 S 5/2015 Uchida
D729,366 S 5/2015 Kauss et al.
D729,439 S 5/2015 Scatterday
D729,444 S 5/2015 Leidel
D729,445 S 5/2015 Leidel
D730,571 S 5/2015 Chen
D730,572 S 5/2015 Leidel
9,022,026 B2 5/2015 Fang
9,022,039 B2 5/2015 Hearn
9,025,291 B2 5/2015 Xiang
9,028,808 B2 5/2015 Huland
9,032,968 B2 5/2015 Glasberg et al.
9,038,626 B2 5/2015 Yamada et al.
9,038,642 B2 5/2015 Liu
D731,114 S 6/2015 Leidel
D733,142 S 6/2015 Solomon et al.
D733,356 S 6/2015 Leidel
9,046,278 B2 6/2015 Koller
9,050,431 B2 6/2015 Turner et al.
9,055,617 B2 6/2015 Thorens et al.
9,055,770 B2 6/2015 Liu
9,060,388 B2 6/2015 Liu
9,060,548 B2 6/2015 Zheng et al.
9,066,543 B2 6/2015 Cameron
9,072,321 B2 7/2015 Liu
9,072,322 B2 7/2015 Liu
9,078,472 B2 7/2015 Liu
9,078,474 B2 7/2015 Thompson
9,078,475 B2 7/2015 Li et al.
9,089,166 B1 7/2015 Scatterday
9,089,168 B2 7/2015 Liu
9,090,173 B2 7/2015 Oishi
D736,706 S 8/2015 Huang et al.
D736,995 S 8/2015 Recio
D737,508 S 8/2015 Liu
9,095,174 B2 8/2015 Capuano
9,095,175 B2 8/2015 Terry et al.
9,099,873 B2 8/2015 Xiang
9,101,729 B2 8/2015 Liu
9,113,659 B2 8/2015 Liu
D737,566 S 9/2015 Gaddis
D738,038 S 9/2015 Smith
D739,973 S 9/2015 Chao
9,131,733 B2 9/2015 Liu
D741,001 S 10/2015 Alarcon et al.
D741,002 S 10/2015 Liu
D741,541 S 10/2015 Liu
D742,063 S 10/2015 Recio
D742,064 S 10/2015 Leidel
9,155,336 B2 10/2015 Liu
9,166,424 B2 10/2015 Oakley, Jr.
9,167,849 B2 10/2015 Adamic
9,167,850 B2 10/2015 Liu
9,167,852 B2 10/2015 Xiu
9,167,853 B2 10/2015 Xiang
D742,492 S 11/2015 Robinson et al.
D742,624 S 11/2015 Meyers
D743,099 S 11/2015 Oglesby
D744,159 S 11/2015 Lukas
9,185,937 B2 11/2015 Liu
9,197,726 B2 11/2015 Stanimirovic et al.
D744,342 S 12/2015 Blasko et al.
D744,419 S 12/2015 Bowen et al.
D744,696 S 12/2015 Malhi
D745,004 S 12/2015 Kim
D745,388 S 12/2015 Taylor
D746,291 S 12/2015 Solomon et al.
9,198,463 B2 12/2015 Liu
9,198,464 B2 12/2015 Liu
9,198,466 B2 12/2015 Liu
9,204,670 B2 12/2015 Liu
9,215,895 B2 12/2015 Bowen et al.
9,220,302 B2 12/2015 DePiano et al.
9,220,303 B2 12/2015 Li et al.
D747,035 S 1/2016 Moradian
D747,265 S 1/2016 Marini
D747,546 S 1/2016 Liu
D747,603 S 1/2016 Gaddis
D747,722 S 1/2016 Webb
D747,852 S 1/2016 Meyers
D748,329 S 1/2016 Bagai et al.
9,226,525 B2 1/2016 Liu
9,226,526 B2 1/2016 Liu
9,233,217 B2 1/2016 Jones
9,240,695 B2 1/2016 Xiang
9,240,697 B2 1/2016 Xiang
D748,852 S 2/2016 Wu
D748,853 S 2/2016 Seibel et al.
D749,260 S 2/2016 Wu
D749,261 S 2/2016 Chen
D749,505 S 2/2016 Verleur et al.
D749,510 S 2/2016 Liu
D749,781 S 2/2016 Lane
D750,320 S 2/2016 Verleur et al.
D750,321 S 2/2016 Chen
9,247,773 B2 * 2/2016 Memari ..... A24F 15/12
9,254,002 B2 2/2016 Chong et al.
9,254,005 B2 2/2016 Liu
9,255,277 B2 2/2016 Bakker et al.

(56) References Cited

U.S. PATENT DOCUMENTS

| | | | |
|---|---|---|---|
| D750,835 | S | 3/2016 | Wei |
| D751,250 | S | 3/2016 | Vuong |
| D751,527 | S | 3/2016 | Hinokio et al. |
| D751,755 | S | 3/2016 | Van Riper |
| D751,757 | S | 3/2016 | Stern |
| D752,277 | S | 3/2016 | Liu |
| D752,278 | S | 3/2016 | Verleur et al. |
| D752,279 | S | 3/2016 | Liu |
| D752,280 | S | 3/2016 | Verleur et al. |
| D752,282 | S | 3/2016 | Doster |
| D752,283 | S | 3/2016 | Doster |
| D752,284 | S | 3/2016 | Doster |
| D752,285 | S | 3/2016 | Doster |
| D752,286 | S | 3/2016 | Doster |
| D752,808 | S | 3/2016 | Hearn |
| 9,271,525 | B2 | 3/2016 | Liu |
| 9,271,526 | B2 | 3/2016 | Liu |
| 9,271,529 | B2 | 3/2016 | Alima |
| 9,272,103 | B2 | 3/2016 | Storz |
| 9,277,768 | B2 | 3/2016 | Xiu |
| 9,277,769 | B2 | 3/2016 | Liu |
| 9,281,705 | B2 | 3/2016 | Xiang |
| 9,282,772 | B2 | 3/2016 | Tucker et al. |
| 9,282,773 | B2 | 3/2016 | Greim et al. |
| 9,289,014 | B2 | 3/2016 | Tucker et al. |
| 9,295,286 | B2 | 3/2016 | Shin |
| D753,090 | S | 4/2016 | Langhammer et al. |
| D753,338 | S | 4/2016 | Chen |
| D753,873 | S | 4/2016 | Schuessler |
| D753,874 | S | 4/2016 | Moreno Medina et al. |
| D754,919 | S | 4/2016 | Alarcon et al. |
| 9,301,545 | B2 | 4/2016 | Li et al. |
| 9,301,549 | B2 | 4/2016 | Liu |
| 9,302,800 | B2 | 4/2016 | Holmes et al. |
| 9,302,825 | B2 | 4/2016 | Liu |
| 9,308,336 | B2 | 4/2016 | Newton |
| 9,312,687 | B2 | 4/2016 | Xiang |
| 9,315,890 | B1 | 4/2016 | Frick et al. |
| 9,320,300 | B2 | 4/2016 | Hon |
| D755,057 | S | 5/2016 | Mutter |
| D755,506 | S | 5/2016 | Neely Ill et al. |
| D755,733 | S | 5/2016 | Lkegaya et al. |
| D755,735 | S | 5/2016 | Kashimoto |
| D756,030 | S | 5/2016 | Chen |
| D756,031 | S | 5/2016 | Wu |
| D756,559 | S | 5/2016 | Li |
| D757,352 | S | 5/2016 | Bagai |
| D757,353 | S | 5/2016 | Nunnelly et al. |
| D757,690 | S | 5/2016 | Lee et al. |
| D757,994 | S | 5/2016 | Moradian |
| D757,995 | S | 5/2016 | Liu |
| 9,326,547 | B2 | 5/2016 | Tucker et al. |
| 9,326,549 | B2 | 5/2016 | Hon |
| 9,332,787 | B2 | 5/2016 | Liu |
| 9,345,269 | B2 | 5/2016 | Liu |
| 9,350,102 | B2 | 5/2016 | Wu |
| 9,350,178 | B2 | 5/2016 | Xiang |
| 9,350,181 | B2 | 5/2016 | Xiang |
| 9,351,522 | B2 | 5/2016 | Safari |
| D758,647 | S | 6/2016 | Liu |
| D758,649 | S | 6/2016 | Liu |
| D758,650 | S | 6/2016 | Wu |
| D759,031 | S | 6/2016 | Ozolins et al. |
| D759,297 | S | 6/2016 | Liu |
| D759,303 | S | 6/2016 | Afridi |
| D760,431 | S | 6/2016 | Liu |
| 9,357,802 | B2 | 6/2016 | Liu |
| 9,360,379 | B2 | 6/2016 | Liu |
| 9,364,025 | B2 | 6/2016 | Liu |
| 9,364,026 | B2 | 6/2016 | Liu |
| 9,364,027 | B2 | 6/2016 | Hon |
| 9,364,800 | B2 | 6/2016 | Dubief |
| 9,379,364 | B2 | 6/2016 | Alima |
| D760,952 | S | 7/2016 | Mayor |
| D761,488 | S | 7/2016 | Alarcon et al. |
| D761,999 | S | 7/2016 | Liu |
| D762,000 | S | 7/2016 | Liu |
| D762,001 | S | 7/2016 | Liu |
| D762,003 | S | 7/2016 | Lomeli |
| D762,326 | S | 7/2016 | Liu |
| 9,380,810 | B2 | 7/2016 | Rose et al. |
| 9,380,812 | B2 | 7/2016 | Chung |
| 9,383,053 | B2 | 7/2016 | Liu |
| 9,385,554 | B2 | 7/2016 | Xiang |
| 9,386,803 | B2 | 7/2016 | Burke et al. |
| D763,203 | S | 8/2016 | Ikegaya et al. |
| D763,204 | S | 8/2016 | Ikegaya et al. |
| D763,502 | S | 8/2016 | Verleur et al. |
| D764,098 | S | 8/2016 | Liu |
| D764,703 | S | 8/2016 | Liu |
| D765,307 | S | 8/2016 | Liu |
| D765,308 | S | 8/2016 | Liu |
| D765,309 | S | 8/2016 | Liu |
| 9,408,416 | B2 | 8/2016 | Monsees et al. |
| 9,413,180 | B2 | 8/2016 | Liu |
| 9,414,627 | B2 | 8/2016 | Liu |
| 9,414,628 | B2 | 8/2016 | Liu |
| 9,415,929 | B2 | 8/2016 | Liu |
| 9,417,107 | B2 | 8/2016 | Xiang |
| 9,420,831 | B2 | 8/2016 | Liu |
| 9,427,022 | B2 | 8/2016 | Levin et al. |
| 9,427,023 | B2 | 8/2016 | Liu |
| 9,427,024 | B2 | 8/2016 | Liu |
| 9,427,025 | B2 | 8/2016 | Liu |
| 9,427,026 | B2 | 8/2016 | Wu |
| D765,907 | S | 9/2016 | Liu |
| D766,503 | S | 9/2016 | Liu |
| D766,873 | S | 9/2016 | Washio |
| D767,200 | S | 9/2016 | Liu |
| D767,201 | S | 9/2016 | Starr |
| D767,820 | S | 9/2016 | Jordan et al. |
| D767,822 | S | 9/2016 | Jordan et al. |
| 9,433,242 | B1 | 9/2016 | Buffone |
| 9,438,049 | B2 | 9/2016 | Xiang |
| 9,438,051 | B2 | 9/2016 | Firman, II et al. |
| 9,439,455 | B2 | 9/2016 | Alarcon et al. |
| 9,439,456 | B2 | 9/2016 | Liu |
| 9,440,035 | B2 | 9/2016 | Chung |
| 9,451,790 | B2 | 9/2016 | Liu |
| 9,451,793 | B2 | 9/2016 | Zhou |
| 9,455,579 | B2 | 9/2016 | Xiang |
| D768,331 | S | 10/2016 | Chen |
| D768,920 | S | 10/2016 | Jones et al. |
| D768,980 | S | 10/2016 | Alexander |
| D769,518 | S | 10/2016 | Liu |
| D769,519 | S | 10/2016 | Chen |
| D769,520 | S | 10/2016 | Hua |
| D769,830 | S | 10/2016 | Clymer et al. |
| D770,088 | S | 10/2016 | Abadi et al. |
| 9,456,632 | B2 | 10/2016 | Hon |
| 9,456,633 | B2 | 10/2016 | Liu |
| 9,456,634 | B2 | 10/2016 | Wang et al. |
| 9,459,021 | B2 | 10/2016 | Greim et al. |
| 9,462,832 | B2 | 10/2016 | Lord |
| 9,465,081 | B2 | 10/2016 | Xiang |
| 9,474,305 | B2 | 10/2016 | Liu |
| D770,395 | S | 11/2016 | Clymer et al. |
| D770,676 | S | 11/2016 | Bennett et al. |
| D770,678 | S | 11/2016 | Shin |
| D770,679 | S | 11/2016 | Weigensberg |
| D771,219 | S | 11/2016 | Gilbarte |
| D771,307 | S | 11/2016 | Wu |
| D771,308 | S | 11/2016 | Saydar et al. |
| D772,477 | S | 11/2016 | Shin |
| D772,478 | S | 11/2016 | Liu |
| D772,479 | S | 11/2016 | Stowers et al. |
| D772,480 | S | 11/2016 | Hua |
| D772,879 | S | 11/2016 | Eliyahu |
| D773,115 | S | 11/2016 | Liu |
| D773,116 | S | 11/2016 | Liu et al. |
| 9,480,285 | B2 | 11/2016 | Liu |
| 9,480,286 | B2 | 11/2016 | Liu |
| 9,497,993 | B2 | 11/2016 | Vallar |
| 9,497,994 | B2 | 11/2016 | Liu |

(56) References Cited

U.S. PATENT DOCUMENTS

| | | | |
|---|---|---|---|
| 9,497,995 | B2 | 11/2016 | Liu |
| 9,497,997 | B2 | 11/2016 | Wu |
| 9,497,998 | B2 | 11/2016 | Chen |
| 9,497,999 | B2 | 11/2016 | Lord |
| 9,498,001 | B2 | 11/2016 | Wu |
| 9,498,002 | B1 | 11/2016 | Soreide |
| 9,498,588 | B2 | 11/2016 | Benassayag et al. |
| 9,502,917 | B2 | 11/2016 | Xiang |
| 9,504,278 | B2 | 11/2016 | Liu |
| 9,504,279 | B2 | 11/2016 | Chen |
| D773,391 | S | 12/2016 | Haarburger et al. |
| D773,729 | S | 12/2016 | Jordan et al. |
| D774,247 | S | 12/2016 | Chen |
| D774,248 | S | 12/2016 | Jordan et al. |
| D774,514 | S | 12/2016 | Turksu et al. |
| D774,693 | S | 12/2016 | Liu |
| D774,892 | S | 12/2016 | Liu |
| D775,412 | S | 12/2016 | Di Bari |
| D775,413 | S | 12/2016 | Liu |
| 9,510,624 | B2 | 12/2016 | Li et al. |
| 9,516,898 | B2 | 12/2016 | Liu |
| 9,521,867 | B2 | 12/2016 | Xiang |
| 9,526,272 | B2 | 12/2016 | Liu |
| 9,526,273 | B2 | 12/2016 | Liu |
| 9,531,183 | B2 | 12/2016 | Xiang |
| D776,051 | S | 1/2017 | Wang |
| D776,162 | S | 1/2017 | Beck et al. |
| D776,270 | S | 1/2017 | Wilcox et al. |
| D776,338 | S | 1/2017 | Lomeli |
| D776,340 | S | 1/2017 | Seibel et al. |
| D776,659 | S | 1/2017 | Hou |
| D777,372 | S | 1/2017 | Liu |
| D777,976 | S | 1/2017 | Mahlmeister |
| 9,532,598 | B2 | 1/2017 | Liu |
| 9,532,599 | B2 | 1/2017 | Liu |
| 9,532,601 | B2 | 1/2017 | Liu |
| 9,532,602 | B2 | 1/2017 | Liu |
| 9,532,604 | B2 | 1/2017 | Conley et al. |
| 9,532,605 | B2 | 1/2017 | Yamada et al. |
| 9,538,781 | B2 | 1/2017 | Zheng |
| 9,538,783 | B2 | 1/2017 | Xiang |
| 9,538,787 | B2 | 1/2017 | Liu |
| 9,538,789 | B2 | 1/2017 | Liu |
| 9,545,489 | B2 | 1/2017 | Turner et al. |
| 9,549,572 | B2 | 1/2017 | Dincer et al. |
| 9,549,573 | B2 | 1/2017 | Monsees et al. |
| 9,554,596 | B2 | 1/2017 | Liu |
| 9,554,597 | B2 | 1/2017 | Liu |
| 9,555,203 | B2 | 1/2017 | Terry et al. |
| D778,493 | S | 2/2017 | Scott |
| D778,831 | S | 2/2017 | Chen |
| D779,677 | S | 2/2017 | Chen |
| D779,719 | S | 2/2017 | Qiu |
| D780,179 | S | 2/2017 | Bae et al. |
| D780,372 | S | 2/2017 | Liu |
| 9,560,882 | B2 | 2/2017 | Xiang |
| 9,565,873 | B2 | 2/2017 | Zheng |
| 9,565,876 | B2 | 2/2017 | Tsai |
| 9,572,372 | B2 | 2/2017 | Liu |
| 9,572,373 | B2 | 2/2017 | Chen |
| 9,572,374 | B2 | 2/2017 | Gabbay |
| 9,573,751 | B2 | 2/2017 | Liu |
| 9,578,002 | B2 | 2/2017 | Wu |
| 9,578,898 | B2 | 2/2017 | Liu |
| D780,990 | S | 3/2017 | Liu |
| D780,991 | S | 3/2017 | Liu |
| D782,108 | S | 3/2017 | Jordan et al. |
| D782,728 | S | 3/2017 | Pinder |
| D782,729 | S | 3/2017 | Wright et al. |
| 9,591,876 | B2 | 3/2017 | Alima |
| 9,596,881 | B2 | 3/2017 | Chiolini et al. |
| 9,596,884 | B2 | 3/2017 | Liu |
| 9,596,885 | B2 | 3/2017 | Liu |
| 9,596,886 | B2 | 3/2017 | Liu |
| 9,596,887 | B2 | 3/2017 | Newton |
| 9,602,646 | B2 | 3/2017 | Stanimirovic et al. |
| 9,603,198 | B2 | 3/2017 | Liu |
| 9,603,386 | B2 | 3/2017 | Xiang |
| 9,603,387 | B2 | 3/2017 | Liu |
| 9,603,389 | B2 | 3/2017 | Chen |
| 9,603,390 | B2 | 3/2017 | Li et al. |
| D784,609 | S | 4/2017 | Liu |
| D785,234 | S | 4/2017 | Liu |
| D785,237 | S | 4/2017 | Wu |
| 9,609,893 | B2 | 4/2017 | Novak et al. |
| 9,615,605 | B2 | 4/2017 | Liu |
| 9,615,606 | B2 | 4/2017 | Liu |
| 9,615,607 | B2 | 4/2017 | Liu |
| 9,620,958 | B2 | 4/2017 | Liu |
| 9,622,511 | B2 | 4/2017 | Zhu |
| 9,623,592 | B2 | 4/2017 | Liu |
| 9,627,661 | B2 | 4/2017 | Liu |
| 9,629,391 | B2 | 4/2017 | Dube et al. |
| 9,629,394 | B2 | 4/2017 | Aronie et al. |
| D785,859 | S | 5/2017 | Pang |
| D785,862 | S | 5/2017 | Wu |
| D786,789 | S | 5/2017 | Jordan et al. |
| D787,114 | S | 5/2017 | Scott |
| D788,362 | S | 5/2017 | Qiu |
| 9,635,886 | B2 | 5/2017 | Tu |
| 9,641,208 | B2 | 5/2017 | Sela et al. |
| 9,642,396 | B2 | 5/2017 | Liu |
| 9,642,397 | B2 | 5/2017 | Dai et al. |
| 9,645,134 | B1 | 5/2017 | Farmen et al. |
| 9,648,905 | B2 | 5/2017 | Levitz et al. |
| 9,648,908 | B1 | 5/2017 | Rinehart et al. |
| 9,648,909 | B2 | 5/2017 | Zhou et al. |
| 9,655,383 | B2 | 5/2017 | Holzherr et al. |
| 9,655,890 | B2 | 5/2017 | Hearn et al. |
| 9,661,878 | B2 | 5/2017 | Liu |
| 9,663,266 | B2 | 5/2017 | Schwester |
| D788,697 | S | 6/2017 | Verleur et al. |
| D790,122 | S | 6/2017 | Hawes et al. |
| D790,126 | S | 6/2017 | Bennett et al. |
| D790,129 | S | 6/2017 | Bennett et al. |
| D790,766 | S | 6/2017 | Li |
| 9,668,517 | B2 | 6/2017 | Liu |
| 9,668,518 | B2 | 6/2017 | Esses |
| 9,668,519 | B2 | 6/2017 | Mishra et al. |
| 9,668,520 | B2 | 6/2017 | Boldrini |
| 9,668,521 | B2 | 6/2017 | Kuczaj |
| 9,668,522 | B2 | 6/2017 | Memari et al. |
| 9,668,523 | B2 | 6/2017 | Tucker et al. |
| 9,675,108 | B2 | 6/2017 | Liu |
| 9,675,113 | B2 | 6/2017 | Liu |
| 9,675,114 | B2 | 6/2017 | Timmermans |
| 9,675,115 | B2 | 6/2017 | Liu |
| 9,675,116 | B2 | 6/2017 | Liu |
| 9,675,117 | B2 | 6/2017 | Li et al. |
| 9,675,118 | B2 | 6/2017 | Chen |
| 9,681,687 | B2 | 6/2017 | Liu |
| 9,681,688 | B1 | 6/2017 | Rinehart et al. |
| 9,682,203 | B2 | 6/2017 | Dahne et al. |
| 9,682,204 | B2 | 6/2017 | Matsumoto et al. |
| 9,682,800 | B2 | 6/2017 | Xiang |
| 9,687,025 | B2 | 6/2017 | Cyphert et al. |
| 9,687,027 | B2 | 6/2017 | Poston et al. |
| 9,687,028 | B2 | 6/2017 | Park |
| 9,687,029 | B2 | 6/2017 | Liu |
| D792,021 | S | 7/2017 | Beer et al. |
| D792,022 | S | 7/2017 | Li |
| D792,644 | S | 7/2017 | Jordan et al. |
| D793,004 | S | 7/2017 | Liu |
| 9,693,584 | B2 | 7/2017 | Hearn et al. |
| 9,693,586 | B2 | 7/2017 | Liu |
| 9,693,587 | B2 | 7/2017 | Plojoux et al. |
| 9,693,588 | B2 | 7/2017 | Zhu |
| 9,695,033 | B1 | 7/2017 | Alshouse et al. |
| 9,700,074 | B2 | 7/2017 | Liu |
| 9,700,075 | B2 | 7/2017 | Liu |
| 9,700,076 | B2 | 7/2017 | Xiang |
| 9,713,345 | B2 | 7/2017 | Farine et al. |
| 9,713,346 | B2 | 7/2017 | Hon |
| 9,714,878 | B2 | 7/2017 | Powers et al. |

(56) References Cited

U.S. PATENT DOCUMENTS

D793,620 S 8/2017 Bennett et al.
9,717,274 B2 8/2017 Daehne et al.
9,717,275 B2 8/2017 Liu
9,717,276 B2 8/2017 Brammer et al.
9,717,277 B2 8/2017 Mironov
9,717,278 B2 8/2017 Hon
9,717,279 B2 8/2017 Hon
9,723,872 B2 8/2017 Liu
9,723,873 B2 8/2017 Liu
9,723,874 B2 8/2017 Liu
9,723,875 B2 8/2017 Liu
9,723,876 B2 8/2017 Cadieux et al.
9,723,877 B2 8/2017 Wong et al.
9,730,471 B2 8/2017 Li et al.
9,763,478 B2 9/2017 Cameron et al.
9,770,055 B2 9/2017 Cameron et al.
9,772,216 B2 9/2017 Poole et al.
9,775,380 B2 10/2017 Fernando et al.
9,802,011 B2 10/2017 Davidson et al.
9,806,549 B2 10/2017 Liberti et al.
9,814,263 B2 11/2017 Cochand et al.
9,814,265 B2 11/2017 Rinker et al.
9,814,272 B2 11/2017 Li et al.
9,820,508 B2 11/2017 Arnel et al.
2001/0015209 A1 8/2001 Zielke
2001/0032643 A1 10/2001 Hochrainer et al.
2001/0032795 A1 10/2001 Weinstein et al.
2001/0052480 A1 12/2001 Kawaguchi et al.
2002/0029779 A1 3/2002 Schmidt et al.
2002/0043554 A1 4/2002 White et al.
2002/0078951 A1 6/2002 Nichols et al.
2002/0088469 A1 7/2002 Rennecamp
2002/0142291 A1 10/2002 Bauer et al.
2002/0175164 A1 11/2002 Dees et al.
2003/0004426 A1 1/2003 Melker et al.
2003/0005926 A1 1/2003 Jones et al.
2003/0089377 A1 5/2003 Hajaligol et al.
2003/0149372 A1 8/2003 Smith et al.
2003/0150451 A1 8/2003 Shayan
2003/0154991 A1 8/2003 Fournier et al.
2004/0031495 A1 2/2004 Steinberg
2004/0050382 A1 3/2004 Goodchild
2004/0099266 A1 5/2004 Cross et al.
2004/0129280 A1 7/2004 Woodson et al.
2004/0149296 A1 8/2004 Rostami et al.
2004/0149624 A1 8/2004 Wischusen et al.
2004/0173224 A1 9/2004 Burgard et al.
2004/0173229 A1 9/2004 Crooks et al.
2004/0182403 A1 9/2004 Andersson et al.
2004/0191322 A1 9/2004 Hansson
2004/0221857 A1 11/2004 Dominguez
2004/0226569 A1 11/2004 Yang et al.
2004/0237974 A1 12/2004 Min
2005/0016549 A1 1/2005 Banerjee et al.
2005/0016550 A1 1/2005 Katase
2005/0029137 A1 2/2005 Wang
2005/0034723 A1 2/2005 Bennett et al.
2005/0061759 A1 3/2005 Doucette
2005/0069831 A1 3/2005 St. Charles et al.
2005/0081601 A1 4/2005 Lawson
2005/0090798 A1 4/2005 Clark et al.
2005/0118545 A1 6/2005 Wong
2005/0145533 A1 7/2005 Seligson
2005/0172976 A1 8/2005 Newman et al.
2005/0229918 A1 10/2005 Shim
2005/0236006 A1 10/2005 Cowan
2005/0244521 A1 11/2005 Strickland et al.
2005/0266365 A1 12/2005 Xie
2005/0268911 A1 12/2005 Cross et al.
2006/0016453 A1 1/2006 Kim
2006/0018840 A1 1/2006 Lechuga-Ballesteros et al.
2006/0054676 A1 3/2006 Wischusen
2006/0102175 A1 5/2006 Nelson
2006/0150991 A1 7/2006 Lee
2006/0185687 A1 8/2006 Hearn et al.
2006/0191546 A1 8/2006 Takano et al.
2006/0191548 A1 8/2006 Strickland et al.
2006/0191594 A1* 8/2006 Py ..... A61J 1/18 141/329
2006/0196518 A1 9/2006 Hon
2006/0254948 A1 11/2006 Herbert et al.
2006/0255105 A1 11/2006 Sweet
2007/0006889 A1 1/2007 Kobal et al.
2007/0045288 A1 3/2007 Nelson
2007/0062548 A1 3/2007 Horstmann et al.
2007/0074734 A1 4/2007 Braunshteyn et al.
2007/0089757 A1 4/2007 Bryman
2007/0098148 A1 5/2007 Sherman
2007/0102013 A1 5/2007 Adams et al.
2007/0125765 A1 6/2007 Nelson
2007/0144514 A1 6/2007 Yeates et al.
2007/0163610 A1 7/2007 Lindell et al.
2007/0191756 A1 8/2007 Tapper
2007/0215164 A1 9/2007 Mehio
2007/0215168 A1 9/2007 Banerjee et al.
2007/0235046 A1 10/2007 Gedevanishvili
2007/0267033 A1 11/2007 Mishra et al.
2007/0277816 A1 12/2007 Morrison et al.
2007/0280652 A1 12/2007 Williams
2007/0283972 A1 12/2007 Monsees et al.
2007/0295347 A1 12/2007 Paine et al.
2008/0000763 A1 1/2008 Cove
2008/0023003 A1 1/2008 Rosenthal
2008/0029095 A1 2/2008 Esser
2008/0092912 A1 4/2008 Robinson et al.
2008/0138423 A1 6/2008 Gonda
2008/0149118 A1 6/2008 Oglesby et al.
2008/0207276 A1 8/2008 Burrell
2008/0216828 A1 9/2008 Wensley et al.
2008/0241255 A1 10/2008 Rose et al.
2008/0257367 A1 10/2008 Paterno et al.
2008/0276947 A1 11/2008 Martzel
2008/0286340 A1 11/2008 Andersson et al.
2008/0302375 A1 12/2008 Andersson et al.
2009/0004249 A1 1/2009 Gonda
2009/0095287 A1 4/2009 Emarlou
2009/0095311 A1 4/2009 Han
2009/0111287 A1 4/2009 Lindberg et al.
2009/0126745 A1 5/2009 Hon
2009/0133691 A1 5/2009 Yamada et al.
2009/0133703 A1 5/2009 Strickland et al.
2009/0133704 A1 5/2009 Strickland et al.
2009/0151717 A1 6/2009 Bowen et al.
2009/0188490 A1 7/2009 Han
2009/0230117 A1 9/2009 Fernando et al.
2009/0255534 A1 10/2009 Paterno
2009/0260641 A1 10/2009 Monsees et al.
2009/0260642 A1 10/2009 Monsees et al.
2009/0267251 A1 10/2009 Ikeyama
2009/0272379 A1 11/2009 Thorens et al.
2009/0283103 A1 11/2009 Nielsen et al.
2009/0288668 A1 11/2009 Inagaki
2009/0288669 A1 11/2009 Hutchens
2009/0293892 A1 12/2009 Williams et al.
2009/0293895 A1 12/2009 Axelsson et al.
2010/0000672 A1 1/2010 Fogle
2010/0006092 A1 1/2010 Hale et al.
2010/0024834 A1 2/2010 Oglesby et al.
2010/0031968 A1 2/2010 Sheikh et al.
2010/0059073 A1 3/2010 Hoffmann et al.
2010/0156193 A1 6/2010 Rhodes et al.
2010/0163063 A1 7/2010 Fernando et al.
2010/0186757 A1 7/2010 Crooks et al.
2010/0200006 A1 8/2010 Robinson et al.
2010/0200008 A1 8/2010 Taieb
2010/0236562 A1 9/2010 Hearn et al.
2010/0242974 A1 9/2010 Pan
2010/0242976 A1 9/2010 Katayama et al.
2010/0275938 A1 11/2010 Roth et al.
2010/0276333 A1 11/2010 Couture
2010/0307116 A1 12/2010 Fisher
2010/0307518 A1 12/2010 Wang
2010/0313901 A1 12/2010 Fernando et al.
2011/0005535 A1 1/2011 Xiu

(56) References Cited

U.S. PATENT DOCUMENTS

2011/0011396 A1 1/2011 Fang
2011/0030706 A1 2/2011 Gibson et al.
2011/0036346 A1 2/2011 Cohen et al.
2011/0036363 A1 2/2011 Urtsev et al.
2011/0041861 A1 2/2011 Sebastian et al.
2011/0049226 A1 3/2011 Moreau et al.
2011/0083684 A1 4/2011 Luan et al.
2011/0094523 A1 4/2011 Thorens et al.
2011/0097060 A1 4/2011 Buzzetti
2011/0108023 A1 5/2011 McKinney et al.
2011/0120482 A1 5/2011 Brenneise
2011/0126831 A1 6/2011 Pernia
2011/0155151 A1 6/2011 Newman et al.
2011/0155153 A1 6/2011 Thorens et al.
2011/0162667 A1 7/2011 Burke et al.
2011/0168194 A1 7/2011 Hon
2011/0180433 A1 7/2011 Rennecamp
2011/0192397 A1 8/2011 Saskar et al.
2011/0226236 A1 9/2011 Buchberger
2011/0226266 A1 9/2011 Tao
2011/0232654 A1 9/2011 Mass
2011/0232655 A1 9/2011 Chan et al.
2011/0236002 A1 9/2011 Oglesby et al.
2011/0240047 A1 10/2011 Adamic
2011/0263947 A1 10/2011 Utley et al.
2011/0265806 A1 11/2011 Alarcon et al.
2011/0268809 A1 11/2011 Brinkley et al.
2011/0277780 A1 11/2011 Terry et al.
2011/0278189 A1 11/2011 Terry et al.
2011/0290248 A1 12/2011 Schennum
2011/0290269 A1 12/2011 Shimizu
2011/0308521 A1 12/2011 Kofford
2011/0315152 A1 12/2011 Hearn et al.
2011/0315701 A1 12/2011 Everson
2012/0006342 A1 1/2012 Rose et al.
2012/0060853 A1 3/2012 Robinson et al.
2012/0077849 A1 3/2012 Howson et al.
2012/0086391 A1 4/2012 Smith
2012/0111346 A1 5/2012 Rinker et al.
2012/0111347 A1 5/2012 Hon
2012/0118301 A1 5/2012 Montaser
2012/0118307 A1 5/2012 Tu
2012/0125353 A1 5/2012 Wollin
2012/0138052 A1 6/2012 Hearn et al.
2012/0174914 A1 7/2012 Pirshafiey et al.
2012/0199146 A1 8/2012 Marangos
2012/0199663 A1 8/2012 Qiu
2012/0204889 A1 8/2012 Xiu
2012/0211015 A1 8/2012 Li et al.
2012/0227753 A1 9/2012 Newton
2012/0234315 A1 9/2012 Li et al.
2012/0234821 A1 9/2012 Shimizu
2012/0247494 A1 10/2012 Oglesby et al.
2012/0255567 A1* 10/2012 Rose ..... A61K 9/12
131/273
2012/0260926 A1 10/2012 Tu et al.
2012/0260927 A1 10/2012 Liu
2012/0261286 A1 10/2012 Holloway et al.
2012/0267383 A1 10/2012 Van Rooyen
2012/0279512 A1 11/2012 Hon
2012/0285475 A1 11/2012 Liu
2012/0291791 A1 11/2012 Pradeep
2012/0312313 A1 12/2012 Frija
2012/0318882 A1 12/2012 Abehasera
2012/0325227 A1 12/2012 Robinson et al.
2012/0325228 A1 12/2012 Williams
2013/0008457 A1 1/2013 Zheng et al.
2013/0014755 A1 1/2013 Kumar et al.
2013/0014772 A1 1/2013 Liu
2013/0019887 A1 1/2013 Liu
2013/0025609 A1 1/2013 Liu
2013/0037041 A1 2/2013 Worm et al.
2013/0042865 A1 2/2013 Monsees et al.
2013/0047984 A1 2/2013 Dahne et al.
2013/0056012 A1 3/2013 Hearn et al.
2013/0056013 A1 3/2013 Terry et al.
2013/0068239 A1 3/2013 Youn
2013/0074857 A1 3/2013 Buchberger
2013/0081642 A1 4/2013 Safari
2013/0087160 A1 4/2013 Gherghe
2013/0140200 A1 6/2013 Scatterday
2013/0146489 A1 6/2013 Scatterday
2013/0152922 A1 6/2013 Benassayag et al.
2013/0152954 A1 6/2013 Youn
2013/0167854 A1 7/2013 Shin
2013/0168880 A1 7/2013 Duke
2013/0186416 A1 7/2013 Gao et al.
2013/0192618 A1 8/2013 Li et al.
2013/0199528 A1 8/2013 Goodman et al.
2013/0213417 A1 8/2013 Chong et al.
2013/0213418 A1 8/2013 Tucker et al.
2013/0213419 A1 8/2013 Tucker et al.
2013/0220315 A1 8/2013 Conley et al.
2013/0228190 A1 9/2013 Weiss et al.
2013/0228191 A1 9/2013 Newton
2013/0233086 A1 9/2013 Besling et al.
2013/0247924 A1 9/2013 Scatterday et al.
2013/0248385 A1 9/2013 Scatterday et al.
2013/0255702 A1 10/2013 Griffith, Jr. et al.
2013/0263869 A1 10/2013 Zhu
2013/0276802 A1 10/2013 Scatterday
2013/0284190 A1 10/2013 Scatterday et al.
2013/0284191 A1 10/2013 Scatterday et al.
2013/0298905 A1 11/2013 Levin et al.
2013/0306065 A1 11/2013 Thorens et al.
2013/0312742 A1 11/2013 Monsees et al.
2013/0319431 A1 12/2013 Cyphert et al.
2013/0319435 A1 12/2013 Flick
2013/0319436 A1 12/2013 Liu
2013/0319437 A1 12/2013 Liu
2013/0319440 A1 12/2013 Capuano
2013/0333700 A1 12/2013 Buchberger
2013/0333711 A1 12/2013 Liu
2013/0336358 A1 12/2013 Liu
2013/0340775 A1 12/2013 Juster et al.
2013/0342157 A1 12/2013 Liu
2014/0000638 A1 1/2014 Sebastian et al.
2014/0007891 A1 1/2014 Liu
2014/0007892 A1 1/2014 Liu
2014/0014124 A1 1/2014 Glasberg et al.
2014/0014126 A1 1/2014 Peleg et al.
2014/0020697 A1 1/2014 Liu
2014/0034071 A1 2/2014 Levitz et al.
2014/0035391 A1 2/2014 Kitani
2014/0041655 A1 2/2014 Barron et al.
2014/0041658 A1 2/2014 Goodman et al.
2014/0048086 A1 2/2014 Zhanghua
2014/0053856 A1 2/2014 Liu
2014/0053858 A1 2/2014 Liu
2014/0060528 A1 3/2014 Liu
2014/0060529 A1 3/2014 Zhang
2014/0060552 A1 3/2014 Cohen
2014/0060556 A1 3/2014 Liu
2014/0062417 A1 3/2014 Li et al.
2014/0069424 A1 3/2014 Poston et al.
2014/0069425 A1 3/2014 Zhang
2014/0083442 A1 3/2014 Scatterday
2014/0096782 A1 4/2014 Ampolini et al.
2014/0107815 A1 4/2014 Lamothe
2014/0109898 A1 4/2014 Li et al.
2014/0109921 A1 4/2014 Chen
2014/0116455 A1 5/2014 Youn
2014/0123989 A1 5/2014 Lamothe
2014/0123990 A1 5/2014 Timmermans
2014/0130796 A1 5/2014 Liu
2014/0130797 A1 5/2014 Liu
2014/0130816 A1 5/2014 Liu
2014/0130817 A1 5/2014 Li et al.
2014/0144429 A1 5/2014 Wensley et al.
2014/0144453 A1 5/2014 Capuano et al.
2014/0150784 A1 6/2014 Liu
2014/0150785 A1 6/2014 Malik et al.
2014/0150810 A1 6/2014 Hon
2014/0161301 A1 6/2014 Merenda

(56) References Cited

U.S. PATENT DOCUMENTS

2014/0166028 A1 6/2014 Fuisz et al.
2014/0166029 A1 6/2014 Weigensberg et al.
2014/0166030 A1 6/2014 Li et al.
2014/0166032 A1 6/2014 Gindrat
2014/0174458 A1 6/2014 Katz
2014/0174459 A1 6/2014 Burstyn
2014/0175081 A1 6/2014 Hwa
2014/0178461 A1 6/2014 Rigas
2014/0182609 A1 7/2014 Liu
2014/0182610 A1 7/2014 Liu
2014/0182611 A1 7/2014 Liu
2014/0182612 A1 7/2014 Chen
2014/0190477 A1 7/2014 Qiu
2014/0190478 A1 7/2014 Liu
2014/0190496 A1 7/2014 Wensley et al.
2014/0190501 A1 7/2014 Liu
2014/0190502 A1 7/2014 Liu
2014/0190503 A1 7/2014 Li et al.
2014/0196716 A1 7/2014 Liu
2014/0196718 A1 7/2014 Li et al.
2014/0196731 A1 7/2014 Scatterday
2014/0196733 A1 7/2014 Liu
2014/0196734 A1 7/2014 Liu
2014/0196735 A1 7/2014 Liu
2014/0202454 A1 7/2014 Buchberger
2014/0202474 A1 7/2014 Peleg et al.
2014/0202475 A1 7/2014 Liu
2014/0202477 A1 7/2014 Qi et al.
2014/0209096 A1 7/2014 Cheyene
2014/0209106 A1 7/2014 Liu
2014/0209107 A1 7/2014 Liu
2014/0209108 A1 7/2014 Li et al.
2014/0209109 A1 7/2014 Larson
2014/0216450 A1 8/2014 Liu
2014/0216483 A1 8/2014 Alima
2014/0216484 A1 8/2014 Liu
2014/0224244 A1 8/2014 Liu
2014/0224267 A1 8/2014 Levitz et al.
2014/0230835 A1 8/2014 Saliman
2014/0238421 A1 8/2014 Shapiro
2014/0238422 A1 8/2014 Plunkett et al.
2014/0238423 A1 8/2014 Tucker et al.
2014/0238424 A1 8/2014 MacKo et al.
2014/0246031 A1 9/2014 Liu
2014/0246033 A1 9/2014 Daehne et al.
2014/0251324 A1 9/2014 Xiang
2014/0251325 A1 9/2014 Liu
2014/0251356 A1 9/2014 Xiang
2014/0253144 A1 9/2014 Novak, III et al.
2014/0254055 A1 9/2014 Xiang
2014/0259026 A1 9/2014 Xiang
2014/0261408 A1 9/2014 Depiano et al.
2014/0261474 A1 9/2014 Gonda
2014/0261479 A1 9/2014 Xu et al.
2014/0261483 A1 9/2014 Hopps
2014/0261486 A1 9/2014 Potter et al.
2014/0261487 A1 9/2014 Chapman et al.
2014/0261488 A1 9/2014 Tucker
2014/0261489 A1 9/2014 Cadieux et al.
2014/0261490 A1 9/2014 Kane
2014/0261491 A1 9/2014 Hawes
2014/0261492 A1 9/2014 Kane et al.
2014/0261493 A1 9/2014 Smith et al.
2014/0261494 A1 9/2014 Scatterday
2014/0261497 A1 9/2014 Liu
2014/0261498 A1 9/2014 Liu
2014/0261500 A1 9/2014 Park
2014/0270727 A1 9/2014 Ampolini et al.
2014/0270729 A1 9/2014 Depiano et al.
2014/0270730 A1 9/2014 Depiano et al.
2014/0274940 A1 9/2014 Mishra et al.
2014/0276536 A1 9/2014 Estes
2014/0278250 A1 9/2014 Smith et al.
2014/0278258 A1 9/2014 Shafer
2014/0283823 A1 9/2014 Liu
2014/0283855 A1 9/2014 Hawes et al.
2014/0283856 A1 9/2014 Xiang
2014/0283857 A1 9/2014 Liu
2014/0283858 A1 9/2014 Liu
2014/0290673 A1 10/2014 Liu
2014/0290676 A1 10/2014 Liu
2014/0290677 A1 10/2014 Liu
2014/0299137 A1 10/2014 Kieckbusch et al.
2014/0299138 A1 10/2014 Xiang
2014/0299139 A1 10/2014 Liu
2014/0299140 A1 10/2014 Liu
2014/0301721 A1 10/2014 Ruscio et al.
2014/0305450 A1 10/2014 Xiang
2014/0305451 A1 10/2014 Liu
2014/0305452 A1 10/2014 Liu
2014/0305454 A1 10/2014 Rinker et al.
2014/0311503 A1 10/2014 Liu
2014/0311504 A1 10/2014 Liu
2014/0311505 A1 10/2014 Liu
2014/0332016 A1 11/2014 Bellinger et al.
2014/0332017 A1 11/2014 Liu
2014/0332018 A1 11/2014 Liu
2014/0332019 A1 11/2014 Liu
2014/0332020 A1 11/2014 Li et al.
2014/0332022 A1 11/2014 Li et al.
2014/0334803 A1 11/2014 Li et al.
2014/0338680 A1 11/2014 Abramov et al.
2014/0338681 A1 11/2014 Liu
2014/0338682 A1 11/2014 Liu
2014/0338683 A1 11/2014 Liu
2014/0338684 A1 11/2014 Liu
2014/0338685 A1 11/2014 Amir
2014/0345631 A1 11/2014 Bowen et al.
2014/0345632 A1 11/2014 Scatterday
2014/0345633 A1 11/2014 Talon et al.
2014/0345635 A1 11/2014 Rabinowitz et al.
2014/0352177 A1 12/2014 Rehkemper
2014/0352705 A1 12/2014 Liu
2014/0352707 A1 12/2014 Liu
2014/0353856 A1 12/2014 Dubief
2014/0353867 A1 12/2014 Liu
2014/0354215 A1 12/2014 Xiang
2014/0355969 A1 12/2014 Stern
2014/0356607 A1 12/2014 Woodcock
2014/0360512 A1 12/2014 Xiang
2014/0360516 A1 12/2014 Liu
2014/0366894 A1 12/2014 Liu
2014/0366895 A1 12/2014 Li et al.
2014/0366896 A1 12/2014 Li et al.
2014/0366897 A1 12/2014 Liu
2014/0366898 A1 12/2014 Monsees et al.
2014/0366902 A1 12/2014 Chiolini et al.
2014/0373833 A1 12/2014 Liu
2014/0373855 A1 12/2014 Zheng
2014/0373858 A1 12/2014 Liu
2014/0376895 A1 12/2014 Han
2014/0378790 A1 12/2014 Cohen
2015/0000682 A1 1/2015 Liu
2015/0000683 A1 1/2015 Liu
2015/0007834 A1 1/2015 Liu
2015/0007835 A1 1/2015 Liu
2015/0007836 A1 1/2015 Li et al.
2015/0013692 A1 1/2015 Liu
2015/0013693 A1 1/2015 Fuisz et al.
2015/0013696 A1 1/2015 Plojoux et al.
2015/0013700 A1 1/2015 Liu
2015/0013701 A1 1/2015 Liu
2015/0013702 A1 1/2015 Liu
2015/0015187 A1 1/2015 Xiang
2015/0020822 A1 1/2015 Janardhan et al.
2015/0020823 A1 1/2015 Lipowicz et al.
2015/0020824 A1 1/2015 Bowen et al.
2015/0020825 A1 1/2015 Galloway et al.
2015/0020826 A1 1/2015 Liu
2015/0020827 A1 1/2015 Liu
2015/0020828 A1 1/2015 Liu
2015/0020829 A1 1/2015 Li
2015/0020830 A1 1/2015 Koller
2015/0020831 A1 1/2015 Weigensberg et al.

(56) References Cited

U.S. PATENT DOCUMENTS

2015/0020833 A1 1/2015 Conley et al.
2015/0027454 A1 1/2015 Li et al.
2015/0027455 A1 1/2015 Peleg et al.
2015/0027456 A1 1/2015 Janardhan et al.
2015/0027457 A1 1/2015 Janardhan et al.
2015/0027460 A1 1/2015 Liu
2015/0027461 A1 1/2015 Liu
2015/0027462 A1 1/2015 Liu
2015/0027463 A1 1/2015 Liu
2015/0027464 A1 1/2015 Liu
2015/0027465 A1 1/2015 Liu
2015/0027466 A1 1/2015 Xiang
2015/0027467 A1 1/2015 Liu
2015/0027468 A1 1/2015 Li et al.
2015/0027469 A1 1/2015 Tucker et al.
2015/0027470 A1 1/2015 Kane et al.
2015/0027471 A1 1/2015 Feldman et al.
2015/0027472 A1 1/2015 Amir
2015/0027473 A1 1/2015 Graf
2015/0034102 A1 2/2015 Faramarzian
2015/0034103 A1 2/2015 Hon
2015/0034104 A1 2/2015 Zhou
2015/0034105 A1 2/2015 Liu
2015/0034106 A1 2/2015 Liu
2015/0034107 A1 2/2015 Liu
2015/0034507 A1 2/2015 Liu
2015/0035540 A1 2/2015 Xiang
2015/0038567 A1 2/2015 Herkenroth et al.
2015/0040927 A1 2/2015 Li et al.
2015/0040928 A1 2/2015 Saydar et al.
2015/0040929 A1 2/2015 Hon
2015/0041482 A1 2/2015 Liu
2015/0047658 A1 2/2015 Cyphert et al.
2015/0047659 A1 2/2015 Liu
2015/0047660 A1 2/2015 Liu
2015/0047661 A1 2/2015 Blackley et al.
2015/0047663 A1 2/2015 Liu
2015/0053215 A1 2/2015 Liu
2015/0053216 A1 2/2015 Liu
2015/0053217 A1 2/2015 Steingraber et al.
2015/0053220 A1 2/2015 Levy et al.
2015/0057341 A1 2/2015 Perry
2015/0059779 A1 3/2015 Alarcon et al.
2015/0059780 A1 3/2015 Davis et al.
2015/0059782 A1 3/2015 Liu
2015/0059783 A1 3/2015 Liu
2015/0059784 A1 3/2015 Liu
2015/0059785 A1 3/2015 Liu
2015/0068523 A1 3/2015 Powers et al.
2015/0068543 A1 3/2015 Liu
2015/0068545 A1 3/2015 Moldoveanu et al.
2015/0075545 A1 3/2015 Xiang
2015/0075546 A1 3/2015 Kueny, Sr. et al.
2015/0078735 A1 3/2015 Cormack
2015/0080265 A1 3/2015 Elzinga et al.
2015/0082859 A1 3/2015 Xiang
2015/0083144 A1 3/2015 Xiang
2015/0083145 A1 3/2015 Li et al.
2015/0083146 A1 3/2015 Goldman et al.
2015/0083147 A1 3/2015 Schiff et al.
2015/0090253 A1 4/2015 Farrow
2015/0090256 A1 4/2015 Chung
2015/0090277 A1 4/2015 Xiang
2015/0090278 A1 4/2015 Schiff et al.
2015/0090279 A1 4/2015 Chen
2015/0090280 A1 4/2015 Chen
2015/0090281 A1 4/2015 Chen
2015/0100441 A1 4/2015 Alarcon et al.
2015/0101622 A1 4/2015 Liu
2015/0101623 A1 4/2015 Liu
2015/0101625 A1 4/2015 Newton et al.
2015/0101626 A1 4/2015 Li et al.
2015/0101945 A1 4/2015 Scatterday
2015/0102777 A1 4/2015 Cooper
2015/0105455 A1 4/2015 Bjorncrantz
2015/0107609 A1 4/2015 Liu
2015/0107610 A1 4/2015 Metrangolo et al.
2015/0107611 A1 4/2015 Metrangolo et al.
2015/0107612 A1 4/2015 Liu
2015/0108019 A1 4/2015 Liu
2015/0114407 A1 4/2015 Duncan et al.
2015/0117842 A1 4/2015 Brammer et al.
2015/0122252 A1 5/2015 Frija
2015/0122274 A1 5/2015 Cohen et al.
2015/0122278 A1 5/2015 Hardgrove et al.
2015/0128965 A1 5/2015 Lord
2015/0128966 A1 5/2015 Lord
2015/0128967 A1 5/2015 Robinson et al.
2015/0128969 A1 5/2015 Chapman et al.
2015/0128970 A1 5/2015 Liu
2015/0128971 A1 5/2015 Verleur et al.
2015/0128972 A1 5/2015 Verleur et al.
2015/0128973 A1 5/2015 Li et al.
2015/0128976 A1 5/2015 Verleur et al.
2015/0128977 A1 5/2015 Li et al.
2015/0136153 A1 5/2015 Lord
2015/0136155 A1 5/2015 Verleur et al.
2015/0136156 A1 5/2015 Liu
2015/0136157 A1 5/2015 Liu
2015/0136158 A1 5/2015 Stevens et al.
2015/0142387 A1 5/2015 Alarcon et al.
2015/0144145 A1 5/2015 Chang et al.
2015/0144147 A1 5/2015 Li et al.
2015/0144148 A1 5/2015 Chen
2015/0150302 A1 6/2015 Metrangolo et al.
2015/0150303 A1 6/2015 Jensen
2015/0150305 A1 6/2015 Shenkal
2015/0150306 A1 6/2015 Chen
2015/0150307 A1 6/2015 Liu
2015/0150308 A1 6/2015 Monsees et al.
2015/0157053 A1 6/2015 Mayor
2015/0157054 A1 6/2015 Liu
2015/0157055 A1 6/2015 Lord
2015/0157056 A1 6/2015 Bowen et al.
2015/0163859 A1 6/2015 Schneider et al.
2015/0164138 A1 6/2015 Liu
2015/0164141 A1 6/2015 Newton
2015/0164142 A1 6/2015 Li et al.
2015/0164143 A1 6/2015 Maas
2015/0164144 A1 6/2015 Liu
2015/0164145 A1 6/2015 Zhou
2015/0164146 A1 6/2015 Li et al.
2015/0164147 A1 6/2015 Verleur et al.
2015/0167976 A1 6/2015 Recio
2015/0173124 A1 6/2015 Qiu
2015/0173417 A1 6/2015 Gennrich et al.
2015/0173419 A1 6/2015 Tu
2015/0173421 A1 6/2015 Hsieh
2015/0173422 A1 6/2015 Liu
2015/0181928 A1 7/2015 Liu
2015/0181937 A1 7/2015 Dubief et al.
2015/0181939 A1 7/2015 Liu
2015/0181941 A1 7/2015 Liu
2015/0181943 A1 7/2015 Li et al.
2015/0181944 A1 7/2015 Li et al.
2015/0184846 A1 7/2015 Liu
2015/0186837 A1 7/2015 Bianco et al.
2015/0189695 A1 7/2015 Xiang
2015/0189915 A1 7/2015 Liu
2015/0189918 A1 7/2015 Liu
2015/0189919 A1 7/2015 Liu
2015/0189920 A1 7/2015 Liu
2015/0196055 A1 7/2015 Liu
2015/0196056 A1 7/2015 Liu
2015/0196057 A1 7/2015 Wu
2015/0196058 A1 7/2015 Lord
2015/0196059 A1 7/2015 Liu
2015/0196060 A1 7/2015 Wensley et al.
2015/0196062 A1 7/2015 Li et al.
2015/0200385 A1 7/2015 Liu
2015/0201674 A1 7/2015 Dooly et al.
2015/0201675 A1 7/2015 Lord
2015/0201676 A1 7/2015 Shin
2015/0208724 A1 7/2015 Wu

(56) References Cited

U.S. PATENT DOCUMENTS

2015/0208725 A1 7/2015 Tsai
2015/0208726 A1 7/2015 Liu
2015/0208728 A1 7/2015 Lord
2015/0208729 A1 7/2015 Monsees et al.
2015/0208730 A1 7/2015 Li et al.
2015/0208731 A1 7/2015 Malamud et al.
2015/0216232 A1 8/2015 Bless et al.
2015/0216233 A1 8/2015 Sears et al.
2015/0216234 A1 8/2015 Chung
2015/0216235 A1 8/2015 Liu
2015/0216237 A1 8/2015 Wensley et al.
2015/0217067 A1 8/2015 Hearn et al.
2015/0217068 A1 8/2015 Wakalopulos
2015/0223520 A1 8/2015 Phillips et al.
2015/0223521 A1 8/2015 Menting et al.
2015/0223522 A1 8/2015 Ampolini et al.
2015/0223523 A1 8/2015 McCullough
2015/0224268 A1 8/2015 Henry et al.
2015/0227471 A1 8/2015 Stafford et al.
2015/0237914 A1 8/2015 Han
2015/0237917 A1 8/2015 Lord
2015/0237918 A1 8/2015 Liu
2015/0238723 A1 8/2015 Knudsen
2015/0245654 A1 9/2015 Memari et al.
2015/0245655 A1 9/2015 Memari et al.
2015/0245657 A1 9/2015 Memari et al.
2015/0245658 A1 9/2015 Worm et al.
2015/0245659 A1 9/2015 DePiano et al.
2015/0245660 A1 9/2015 Lord
2015/0245661 A1 9/2015 Milin
2015/0245665 A1 9/2015 Memari et al.
2015/0245666 A1 9/2015 Memari et al.
2015/0245667 A1 9/2015 Memari et al.
2015/0245668 A1 9/2015 Memari et al.
2015/0245669 A1 9/2015 Cadieux et al.
2015/0257441 A1 9/2015 Gerkin
2015/0257444 A1 9/2015 Chung
2015/0257445 A1 9/2015 Henry, Jr. et al.
2015/0257446 A1 9/2015 Chung
2015/0257447 A1 9/2015 Sullivan
2015/0257449 A1 9/2015 Gabbay
2015/0257451 A1 9/2015 Brannon et al.
2015/0258289 A1 9/2015 Henry, Jr. et al.
2015/0272211 A1 10/2015 Chung
2015/0272215 A1 10/2015 Esses
2015/0272217 A1 10/2015 Chen
2015/0272218 A1 10/2015 Chen
2015/0272220 A1 10/2015 Spinka et al.
2015/0272221 A1 10/2015 Liu
2015/0272222 A1 10/2015 Spinka et al.
2015/0272223 A1 10/2015 Weigensberg et al.
2015/0276262 A1 10/2015 Dai et al.
2015/0280273 A1 10/2015 Liu
2015/0282524 A1 10/2015 Elhalwani
2015/0282525 A1 10/2015 Plojoux et al.
2015/0282526 A1 10/2015 Wu
2015/0282527 A1 10/2015 Henry, Jr.
2015/0282529 A1 10/2015 Li et al.
2015/0282530 A1 10/2015 Johnson et al.
2015/0288468 A1 10/2015 Xiang
2015/0289565 A1 10/2015 Cadieux et al.
2015/0289567 A1 10/2015 Liu
2015/0295921 A1 10/2015 Cao
2015/0296883 A1 10/2015 Wu
2015/0296885 A1 10/2015 Liu
2015/0296886 A1 10/2015 Li et al.
2015/0296887 A1 10/2015 Zhu
2015/0296888 A1 10/2015 Liu
2015/0296889 A1 10/2015 Liu
2015/0304401 A1 10/2015 Liu
2015/0304402 A1 10/2015 Liu
2015/0305403 A1 10/2015 Coelho Belo Fernandes De Carvalho
2015/0305404 A1 10/2015 Rosales
2015/0305406 A1 10/2015 Li et al.
2015/0305407 A1 10/2015 Li et al.
2015/0305408 A1 10/2015 Liu
2015/0305409 A1 10/2015 Verleur et al.
2015/0305464 A1 10/2015 Nelson, Jr. et al.
2015/0313275 A1 11/2015 Anderson et al.
2015/0313282 A1 11/2015 Ademe et al.
2015/0313283 A1 11/2015 Collett et al.
2015/0313284 A1 11/2015 Liu
2015/0313285 A1 11/2015 Waller et al.
2015/0313287 A1 11/2015 Verleur et al.
2015/0313288 A1 11/2015 Liu
2015/0313868 A1 11/2015 Morgan
2015/0320114 A1 11/2015 Wu
2015/0320116 A1 11/2015 Bleloch et al.
2015/0322451 A1 11/2015 Kudithipudi et al.
2015/0327595 A1 11/2015 Scatterday
2015/0327596 A1 11/2015 Alarcon et al.
2015/0327597 A1 11/2015 Li et al.
2015/0327598 A1 11/2015 Xiang
2015/0328415 A1 11/2015 Minskoff et al.
2015/0332379 A1 11/2015 Alarcon
2015/0333542 A1 11/2015 Alarcon et al.
2015/0333552 A1 11/2015 Alarcon
2015/0333561 A1 11/2015 Alarcon
2015/0335071 A1 11/2015 Brinkley et al.
2015/0335072 A1 11/2015 Giller
2015/0335074 A1 11/2015 Leung
2015/0335075 A1 11/2015 Minskoff et al.
2015/0336689 A1 11/2015 Brown et al.
2015/0342254 A1 12/2015 Mironov et al.
2015/0342255 A1 12/2015 Wu
2015/0342256 A1 12/2015 Chen
2015/0342257 A1 12/2015 Chen
2015/0342258 A1 12/2015 Chen
2015/0342259 A1 12/2015 Baker et al.
2015/0351449 A1 12/2015 Righetti
2015/0351454 A1 12/2015 Huang
2015/0351455 A1 12/2015 Liu
2015/0351456 A1 12/2015 Johnson et al.
2015/0351457 A1 12/2015 Liu
2015/0357608 A1 12/2015 Huang
2015/0357839 A1 12/2015 Cai et al.
2015/0359258 A1 12/2015 Mishra et al.
2015/0359261 A1 12/2015 Li et al.
2015/0359262 A1 12/2015 Liu et al.
2015/0359263 A1 12/2015 Bellinger
2015/0359264 A1 12/2015 Fernando et al.
2015/0359265 A1 12/2015 Liu
2015/0366250 A1 12/2015 Landau
2015/0366265 A1 12/2015 Lansing
2015/0366266 A1 12/2015 Chen
2015/0366267 A1 12/2015 Liu
2015/0366268 A1 12/2015 Shabat
2015/0374035 A1 12/2015 Sanchez et al.
2015/0374039 A1 12/2015 Zhu
2015/0374040 A1 12/2015 Chen
2016/0000147 A1 1/2016 Li et al.
2016/0000148 A1 1/2016 Liu
2016/0000149 A1 1/2016 Scatterday
2016/0002649 A1 1/2016 Kudithipudi et al.
2016/0007650 A1 1/2016 Duncan et al.
2016/0007651 A1 1/2016 Ampolini et al.
2016/0007653 A1 1/2016 Tu
2016/0007654 A1 1/2016 Zhu
2016/0007655 A1 1/2016 Li et al.
2016/0010103 A1 1/2016 Kudithipudi et al.
2016/0015082 A1 1/2016 Liu
2016/0020048 A1 1/2016 Ware
2016/0021771 A1 1/2016 Zhang et al.
2016/0021931 A1 1/2016 Hawes et al.
2016/0021932 A1 1/2016 Silvestrini et al.
2016/0021933 A1 1/2016 Thorens et al.
2016/0021934 A1 1/2016 Cadieux et al.
2016/0029225 A1 1/2016 Hu
2016/0029694 A1 2/2016 Clements et al.
2016/0029697 A1 2/2016 Shafer
2016/0029698 A1 2/2016 Xiang
2016/0029699 A1 2/2016 Li et al.
2016/0029700 A1 2/2016 Li et al.

(56) References Cited

U.S. PATENT DOCUMENTS

2016/0037826 A1 2/2016 Hearn et al.
2016/0044961 A1 2/2016 Liu
2016/0044964 A1 2/2016 Liu
2016/0044966 A1 2/2016 Li et al.
2016/0044967 A1 2/2016 Bowen et al.
2016/0044968 A1 2/2016 Bowen et al.
2016/0049682 A1 2/2016 Won et al.
2016/0051716 A1 2/2016 Wheelock
2016/0053988 A1 2/2016 Quintana
2016/0057811 A1 2/2016 Alarcon et al.
2016/0058066 A1 3/2016 Banks et al.
2016/0058071 A1 3/2016 Hearn
2016/0058072 A1 3/2016 Liu
2016/0058073 A1 3/2016 Chen
2016/0058074 A1 3/2016 Liu
2016/0073677 A1 3/2016 Kappel et al.
2016/0073678 A1 3/2016 Fujisawa et al.
2016/0073690 A1 3/2016 Liu
2016/0073691 A1 3/2016 Liu
2016/0073692 A1 3/2016 Alarcon et al.
2016/0073693 A1 3/2016 Reevell
2016/0073694 A1 3/2016 Liu
2016/0080469 A1 3/2016 Liu
2016/0081393 A1 3/2016 Black
2016/0081394 A1 3/2016 Alarcon et al.
2016/0081395 A1 3/2016 Thorens et al.
2016/0088874 A1 3/2016 Lipowicz
2016/0089508 A1 3/2016 Smith et al.
2016/0091194 A1 3/2016 Liu
2016/0095352 A1 4/2016 Liu
2016/0095353 A1 4/2016 Liu
2016/0095354 A1 4/2016 Wu
2016/0095355 A1 4/2016 Hearn
2016/0095356 A1* 4/2016 Chan ..... A24F 47/008 131/329
2016/0095357 A1 4/2016 Burton
2016/0099592 A1 4/2016 Gatta et al.
2016/0100456 A1 4/2016 Tsai
2016/0100632 A1 4/2016 Debono et al.
2016/0101909 A1 4/2016 Schennum et al.
2016/0106144 A1 4/2016 Muehlbauer et al.
2016/0106151 A1 4/2016 Swepston et al.
2016/0106152 A1 4/2016 Liu
2016/0106154 A1 4/2016 Lord
2016/0106155 A1 4/2016 Reevell
2016/0106156 A1 4/2016 Qiu
2016/0106936 A1 4/2016 Kimmel
2016/0109115 A1 4/2016 Lipowicz
2016/0113323 A1 4/2016 Liu
2016/0113325 A1 4/2016 Liu
2016/0113326 A1 4/2016 Li et al.
2016/0113327 A1 4/2016 Wu
2016/0120218 A1 5/2016 Schennum et al.
2016/0120220 A1 5/2016 Malgat et al.
2016/0120222 A1 5/2016 Bagai et al.
2016/0120223 A1 5/2016 Keen et al.
2016/0120224 A1 5/2016 Mishra et al.
2016/0120225 A1 5/2016 Mishra et al.
2016/0120226 A1 5/2016 Rado
2016/0120227 A1 5/2016 Levitz et al.
2016/0120228 A1 5/2016 Rostami et al.
2016/0121058 A1 5/2016 Chen
2016/0128384 A1 5/2016 Luciani et al.
2016/0128385 A1 5/2016 Lin
2016/0128387 A1 5/2016 Chen
2016/0128388 A1 5/2016 Liu
2016/0128389 A1 5/2016 Lamb et al.
2016/0128390 A1 5/2016 Liu
2016/0129205 A1 5/2016 Shahaf et al.
2016/0131629 A1 5/2016 Cadieux, Jr. et al.
2016/0132898 A1 5/2016 Cadieux et al.
2016/0134143 A1 5/2016 Liu
2016/0135494 A1 5/2016 Liu et al.
2016/0135500 A1 5/2016 Hearn et al.
2016/0135501 A1 5/2016 Liu
2016/0135503 A1 5/2016 Liu
2016/0135504 A1 5/2016 Li et al.
2016/0135505 A1 5/2016 Li et al.
2016/0135506 A1 5/2016 Sanchez et al.
2016/0135507 A1 5/2016 Thorens et al.
2016/0136153 A1 5/2016 Jenkins
2016/0136213 A1 5/2016 Paul
2016/0138795 A1 5/2016 Meinhart et al.
2016/0143354 A1 5/2016 Liu
2016/0143357 A1 5/2016 Liu
2016/0143358 A1 5/2016 Zhu
2016/0143359 A1 5/2016 Xiang
2016/0143360 A1 5/2016 Sanchez et al.
2016/0143361 A1 5/2016 Juster et al.
2016/0143362 A1 5/2016 Boldrini
2016/0143363 A1 5/2016 Boldrini
2016/0143365 A1 5/2016 Liu
2016/0144458 A1 5/2016 Boldrini
2016/0150820 A1 6/2016 Liu
2016/0150821 A1 6/2016 Liu
2016/0150823 A1 6/2016 Liu
2016/0150824 A1* 6/2016 Memari ..... A24F 15/12 131/329
2016/0150826 A1 6/2016 Liu
2016/0150827 A1 6/2016 Liu
2016/0150828 A1 6/2016 Goldstein et al.
2016/0150872 A1 6/2016 Zayat
2016/0157523 A1 6/2016 Liu
2016/0157524 A1 6/2016 Bowen et al.
2016/0157525 A1 6/2016 Tucker et al.
2016/0158782 A1 6/2016 Henry, Jr. et al.
2016/0165952 A1 6/2016 Liu
2016/0165955 A1 6/2016 Horne
2016/0166564 A1 6/2016 Myers et al.
2016/0167846 A1 6/2016 Zahr et al.
2016/0174076 A1 6/2016 Wu
2016/0174609 A1 6/2016 Mironov
2016/0174611 A1 6/2016 Monsees et al.
2016/0174613 A1 6/2016 Zuber et al.
2016/0176564 A1 6/2016 Garthaffner
2016/0177285 A1 6/2016 Voerman et al.
2016/0183592 A1 6/2016 Liu
2016/0183593 A1 6/2016 Liu
2016/0183594 A1 6/2016 Liu
2016/0183595 A1 6/2016 Grimandi et al.
2016/0183597 A1 6/2016 Li et al.
2016/0189216 A1 6/2016 Liu
2016/0192705 A1 7/2016 Borkovec et al.
2016/0192706 A1 7/2016 Kananen
2016/0192707 A1 7/2016 Li et al.
2016/0192708 A1 7/2016 Demeritt et al.
2016/0192709 A1 7/2016 Liu
2016/0192710 A1 7/2016 Liu
2016/0198759 A1 7/2016 Kuntawala et al.
2016/0198763 A1 7/2016 Adkins et al.
2016/0198765 A1 7/2016 Liu
2016/0198766 A1 7/2016 Liu
2016/0198767 A1 7/2016 Verleur
2016/0198768 A1 7/2016 Liu
2016/0198769 A1 7/2016 Liu
2016/0198770 A1 7/2016 Alarcon
2016/0200463 A1 7/2016 Hodges et al.
2016/0201224 A1 7/2016 Xiang
2016/0204637 A1 7/2016 Alarcon et al.
2016/0205998 A1 7/2016 Matsumoto et al.
2016/0205999 A1 7/2016 Liu
2016/0206000 A1 7/2016 Lord et al.
2016/0206002 A1 7/2016 Borkovec et al.
2016/0206005 A1 7/2016 Yamada et al.
2016/0206006 A1 7/2016 Li et al.
2016/0211693 A1 7/2016 Stevens et al.
2016/0212520 A1 7/2016 Merenda
2016/0213060 A1 7/2016 Thaler
2016/0213061 A1 7/2016 Liu
2016/0213062 A1 7/2016 Doyle
2016/0213065 A1 7/2016 Wensley et al.
2016/0213066 A1 7/2016 Zitzke et al.
2016/0213067 A1 7/2016 Hon
2016/0213866 A1 7/2016 Tan

(56) References Cited

U.S. PATENT DOCUMENTS

2016/0219933 A1 8/2016 Henry, Jr. et al.
2016/0219934 A1 8/2016 Li et al.
2016/0219936 A1 8/2016 Alarcon
2016/0219937 A1 8/2016 Rado
2016/0219938 A1 8/2016 Mamoun et al.
2016/0221707 A1 8/2016 Xu et al.
2016/0226286 A1 8/2016 Xiang
2016/0227837 A1 8/2016 Hammel et al.
2016/0227838 A1 8/2016 Johnson et al.
2016/0227839 A1 8/2016 Zuber et al.
2016/0227840 A1 8/2016 Xiang
2016/0227841 A1 8/2016 Li et al.
2016/0227842 A1 8/2016 Xiang
2016/0233705 A1 8/2016 Liu
2016/0233708 A1 8/2016 Liu
2016/0235119 A1 8/2016 Liu
2016/0235120 A1 8/2016 Liu
2016/0235121 A1 8/2016 Rogan et al.
2016/0235124 A1 8/2016 Krietzman
2016/0235125 A1 8/2016 Safari
2016/0242463 A1 8/2016 Liu
2016/0242464 A1 8/2016 Liu
2016/0242465 A1 8/2016 Zheng et al.
2016/0242466 A1 8/2016 Lord et al.
2016/0242467 A1 8/2016 Vaughn
2016/0242468 A1 8/2016 Liu
2016/0249680 A1 9/2016 Liu
2016/0249682 A1 9/2016 Leadley et al.
2016/0249683 A1 9/2016 Li et al.
2016/0249684 A1 9/2016 Liu
2016/0255876 A1 9/2016 Rostami
2016/0255878 A1 9/2016 Huang et al.
2016/0260156 A1 9/2016 Liu
2016/0261021 A1 9/2016 Marion et al.
2016/0262443 A1 9/2016 Piccirilli et al.
2016/0262445 A1 9/2016 Benjak et al.
2016/0262449 A1 9/2016 Liu
2016/0262450 A1 9/2016 Liu
2016/0262451 A1 9/2016 Liu
2016/0262452 A1 9/2016 Zhu
2016/0262453 A1 9/2016 Ampolini et al.
2016/0262454 A1 9/2016 Sears et al.
2016/0262455 A1 9/2016 Chen
2016/0262456 A1 9/2016 Borkovec et al.
2016/0262457 A1 9/2016 Borkovec et al.
2016/0262459 A1 9/2016 Monsees et al.
2016/0262526 A1 9/2016 Gonzalez
2016/0268824 A1 9/2016 Liu
2016/0270441 A1 9/2016 Lewis et al.
2016/0270442 A1 9/2016 Liu
2016/0270443 A1 9/2016 Liu
2016/0270444 A1 9/2016 Lin
2016/0270445 A1 9/2016 Liu
2016/0270446 A1 9/2016 Shenkal et al.
2016/0270447 A1 9/2016 Borkovec
2016/0271347 A1 9/2016 Raichman
2016/0278163 A1 9/2016 Chen
2016/0278431 A1 9/2016 Liu
2016/0278432 A1 9/2016 Liu
2016/0278433 A1 9/2016 Xiang
2016/0278434 A1 9/2016 Liu
2016/0278435 A1 9/2016 Choukroun et al.
2016/0278436 A1 9/2016 Verleur et al.
2016/0280450 A1 9/2016 Hearn et al.
2016/0284197 A1 9/2016 Liu
2016/0285983 A1 9/2016 Liu
2016/0286856 A1 10/2016 Liu
2016/0286858 A1 10/2016 Liu
2016/0286859 A1 10/2016 Liu
2016/0286860 A1 10/2016 Flayler
2016/0286862 A1 10/2016 Silvetrini
2016/0286863 A1 10/2016 Lin
2016/0286864 A1 10/2016 Lin
2016/0286865 A1 10/2016 King et al.
2016/0295913 A1 10/2016 Guo et al.
2016/0295915 A1 10/2016 Jochnowitz et al.
2016/0295916 A1 10/2016 Malgat et al.
2016/0295917 A1 10/2016 Malgat et al.
2016/0295918 A1 10/2016 Liu
2016/0295920 A1 10/2016 Liu
2016/0295922 A1 10/2016 John et al.
2016/0295923 A1 10/2016 Lin
2016/0295924 A1 10/2016 Liu
2016/0295925 A1 10/2016 Chen
2016/0295926 A1 10/2016 Zuber
2016/0297341 A1 10/2016 Wallace et al.
2016/0302471 A1 10/2016 Bowen et al.
2016/0302483 A1 10/2016 Liu
2016/0302484 A1 10/2016 Gupta et al.
2016/0302485 A1 10/2016 Alima
2016/0302486 A1 10/2016 Eroch
2016/0302487 A1 10/2016 Chen
2016/0302488 A1 10/2016 Fernando et al.
2016/0309775 A1 10/2016 Parker
2016/0309779 A1 10/2016 Liu
2016/0309780 A1 10/2016 Chen et al.
2016/0309781 A1 10/2016 Malgat et al.
2016/0309783 A1 10/2016 Hopps et al.
2016/0309784 A1 10/2016 Silvestrini et al.
2016/0309785 A1 10/2016 Holtz
2016/0309786 A1 10/2016 Holtz et al.
2016/0309789 A1 10/2016 Thomas, Jr.
2016/0315488 A1 10/2016 Moon
2016/0316818 A1 11/2016 Liu
2016/0316820 A1 11/2016 Liu
2016/0316821 A1 11/2016 Liu
2016/0316822 A1 11/2016 Liu
2016/0321879 A1 11/2016 Oh et al.
2016/0323404 A1 11/2016 Liu
2016/0324211 A1 11/2016 Yankelevich
2016/0324213 A1 11/2016 Liu
2016/0324215 A1 11/2016 Mironov et al.
2016/0324217 A1 11/2016 Cameron
2016/0324218 A1 11/2016 Wang et al.
2016/0324219 A1 11/2016 Li et al.
2016/0325055 A1 11/2016 Cameron
2016/0325858 A1 11/2016 Ampolini et al.
2016/0331022 A1 11/2016 Cameron
2016/0331023 A1 11/2016 Cameron
2016/0331024 A1 11/2016 Cameron
2016/0331025 A1 11/2016 Cameron
2016/0331026 A1 11/2016 Cameron
2016/0331027 A1 11/2016 Cameron
2016/0331028 A1 11/2016 Xu
2016/0331029 A1 11/2016 Contreras
2016/0331030 A1 11/2016 Ampolini et al.
2016/0331032 A1 11/2016 Malgat et al.
2016/0331033 A1 11/2016 Hopps et al.
2016/0331034 A1 11/2016 Cameron
2016/0331035 A1 11/2016 Cameron
2016/0331037 A1 11/2016 Cameron
2016/0331038 A1 11/2016 Farine et al.
2016/0331039 A1 11/2016 Thorens et al.
2016/0331040 A1 11/2016 Nakano et al.
2016/0332754 A1 11/2016 Brown et al.
2016/0334847 A1 11/2016 Cameron
2016/0337141 A1 11/2016 Cameron
2016/0337362 A1 11/2016 Cameron
2016/0337444 A1 11/2016 Cameron
2016/0338402 A1 11/2016 Buehler et al.
2016/0338405 A1 11/2016 Liu
2016/0338406 A1 11/2016 Liu
2016/0338407 A1 11/2016 Kerdemelidis
2016/0338408 A1 11/2016 Guenther, Jr. et al.
2016/0338409 A1 11/2016 Varone
2016/0338410 A1 11/2016 Batista et al.
2016/0338411 A1 11/2016 Liu
2016/0338412 A1 11/2016 Monsees et al.
2016/0338413 A1 11/2016 Li et al.
2016/0338945 A1 11/2016 Knight
2016/0345621 A1 12/2016 Li et al.
2016/0345625 A1 12/2016 Liu
2016/0345626 A1 12/2016 Wong et al.
2016/0345627 A1 12/2016 Liu

(56) References Cited

U.S. PATENT DOCUMENTS

2016/0345628 A1 12/2016 Sabet
2016/0345630 A1 12/2016 Mironov et al.
2016/0345631 A1 12/2016 Monsees et al.
2016/0345632 A1 12/2016 Lipowicz
2016/0345633 A1 12/2016 Depiano et al.
2016/0345634 A1 12/2016 Fernando et al.
2016/0345636 A1 12/2016 Liu
2016/0351044 A1 12/2016 Liu
2016/0353798 A1 12/2016 Liu
2016/0353800 A1 12/2016 Di Carlo
2016/0353805 A1 12/2016 Hawes et al.
2016/0356751 A1 12/2016 Blackley
2016/0360784 A1 12/2016 Liu
2016/0360785 A1 12/2016 Bless et al.
2016/0360786 A1 12/2016 Bellinger et al.
2016/0360787 A1 12/2016 Bailey
2016/0360788 A1 12/2016 Wang
2016/0360789 A1 12/2016 Hawes et al.
2016/0360792 A1 12/2016 Liu
2016/0360793 A1 12/2016 Liu
2016/0363570 A1 12/2016 Blackley
2016/0363917 A1 12/2016 Blackley
2016/0366725 A1 12/2016 Tucker et al.
2016/0366927 A1 12/2016 Liu
2016/0366928 A1 12/2016 Liu
2016/0366933 A1 12/2016 Liu
2016/0366935 A1 12/2016 Liu
2016/0366936 A1 12/2016 Liu
2016/0366937 A1 12/2016 Liu
2016/0366938 A1 12/2016 Wu
2016/0366939 A1 12/2016 Alarcon et al.
2016/0366940 A1 12/2016 Liu
2016/0366941 A1 12/2016 Lin
2016/0366942 A1 12/2016 Liu
2016/0366943 A1 12/2016 Li et al.
2016/0366945 A1 12/2016 Rado
2016/0366947 A1 12/2016 Monsees et al.
2016/0367925 A1 12/2016 Blackley
2016/0368670 A1 12/2016 Beardsall
2016/0368677 A1 12/2016 Parsons et al.
2016/0370335 A1 12/2016 Blackley
2016/0371437 A1 12/2016 Alarcon et al.
2016/0371464 A1 12/2016 Bricker
2016/0374390 A1 12/2016 Liu
2016/0374391 A1 12/2016 Liu
2016/0374392 A1 12/2016 Liu
2016/0374393 A1 12/2016 Chen
2016/0374394 A1 12/2016 Hawes et al.
2016/0374395 A1 12/2016 Jordan et al.
2016/0374396 A1 12/2016 Jordan et al.
2016/0374397 A1 12/2016 Jordan et al.
2016/0374398 A1 12/2016 Amir
2016/0374399 A1 12/2016 Monsees et al.
2016/0374400 A1 12/2016 Monsees et al.
2016/0374401 A1 12/2016 Liu
2017/0000190 A1 1/2017 Wu
2017/0000192 A1 1/2017 Li
2017/0006915 A1 1/2017 Li et al.
2017/0006916 A1 1/2017 Liu
2017/0006917 A1 1/2017 Alvarez
2017/0006918 A1 1/2017 Chen et al.
2017/0006919 A1 1/2017 Liu
2017/0006920 A1 1/2017 Liu
2017/0006921 A1 1/2017 Lemay et al.
2017/0006922 A1 1/2017 Wang et al.
2017/0013875 A1 1/2017 Schennum et al.
2017/0013876 A1 1/2017 Schennum et al.
2017/0013878 A1 1/2017 Schuler et al.
2017/0013880 A1 1/2017 O'brien et al.
2017/0013881 A1 1/2017 Liu
2017/0013882 A1 1/2017 Liu
2017/0013883 A1 1/2017 Han et al.
2017/0013885 A1 1/2017 Qiu
2017/0014582 A1 1/2017 Skoda
2017/0018000 A1 1/2017 Cameron
2017/0019951 A1 1/2017 Louveau et al.
2017/0020188 A1 1/2017 Cameron
2017/0020191 A1 1/2017 Lamb et al.
2017/0020193 A1 1/2017 Davis et al.
2017/0020194 A1 1/2017 Renders
2017/0020195 A1 1/2017 Cameron
2017/0020196 A1 1/2017 Cameron
2017/0020197 A1 1/2017 Cameron
2017/0020198 A1 1/2017 Naqwi et al.
2017/0020201 A1 1/2017 Xiang
2017/0020791 A1 1/2017 Moszner et al.
2017/0021969 A1 1/2017 Smith et al.
2017/0023952 A1 1/2017 Henry, Jr. et al.
2017/0027221 A1 2/2017 Liu
2017/0027223 A1 2/2017 Eksouzian
2017/0027224 A1 2/2017 Volodarsky
2017/0027227 A1 2/2017 Lipowicz
2017/0027228 A1 2/2017 Rastogi
2017/0027229 A1 2/2017 Cameron
2017/0027230 A1 2/2017 Fornarelli
2017/0027231 A1 2/2017 Xiang
2017/0027232 A1 2/2017 Scheck et al.
2017/0027233 A1 2/2017 Mironov
2017/0027234 A1 2/2017 Farine et al.
2017/0033568 A1 2/2017 Holzherr
2017/0033836 A1 2/2017 Bernauer et al.
2017/0035101 A1 2/2017 Balder
2017/0035109 A1 2/2017 Liu
2017/0035110 A1 2/2017 Keen
2017/0035111 A1 2/2017 Slurink et al.
2017/0035112 A1 2/2017 Thorens
2017/0035113 A1 2/2017 Thorens
2017/0035114 A1 2/2017 Lord
2017/0035115 A1 2/2017 Monsees et al.
2017/0035117 A1 2/2017 Lin
2017/0035118 A1 2/2017 Liu
2017/0035119 A1 2/2017 Otto
2017/0041646 A1 2/2017 Pizzurro et al.
2017/0042225 A1 2/2017 Liu
2017/0042227 A1 2/2017 Gavrielov et al.
2017/0042228 A1 2/2017 Liu
2017/0042229 A1 2/2017 Liu
2017/0042230 A1 2/2017 Cameron
2017/0042231 A1 2/2017 Cameron
2017/0042242 A1 2/2017 Hon
2017/0042243 A1 2/2017 Plojoux et al.
2017/0042245 A1 2/2017 Buchberger et al.
2017/0042246 A1 2/2017 Lau et al.
2017/0042247 A1 2/2017 Xiang
2017/0042248 A1 2/2017 Xiang
2017/0042250 A1 2/2017 Takeuchi et al.
2017/0046357 A1 2/2017 Cameron
2017/0046722 A1 2/2017 Ertugrul
2017/0046738 A1 2/2017 Cameron
2017/0047756 A1 2/2017 Xiang
2017/0048691 A1 2/2017 Liu
2017/0049149 A1 2/2017 Carty
2017/0049150 A1 2/2017 Xue et al.
2017/0049151 A1 2/2017 Xue et al.
2017/0049152 A1 2/2017 Liu
2017/0049153 A1 2/2017 Guo et al.
2017/0049154 A1 2/2017 Batista
2017/0049155 A1 2/2017 Liu
2017/0049156 A1 2/2017 Wang et al.
2017/0050798 A1 2/2017 Ludewig et al.
2017/0055577 A1 3/2017 Batista
2017/0055579 A1 3/2017 Kuna et al.
2017/0055586 A1 3/2017 Liu
2017/0055588 A1 3/2017 Cameron
2017/0055589 A1 3/2017 Fernando et al.
2017/0064994 A1 3/2017 Xu et al.
2017/0064999 A1 3/2017 Perez et al.
2017/0065000 A1 3/2017 Sears et al.
2017/0065001 A1 3/2017 Li et al.
2017/0066556 A1 3/2017 Liu
2017/0071249 A1 3/2017 Ampolini et al.
2017/0071251 A1 3/2017 Goch
2017/0071252 A1 3/2017 Liu
2017/0071256 A1 3/2017 Verleur et al.

(56) References Cited

U.S. PATENT DOCUMENTS

2017/0071257 A1 3/2017 Lin
2017/0071258 A1 3/2017 Li et al.
2017/0071260 A1 3/2017 Li et al.
2017/0071262 A1 3/2017 Liu
2017/0079110 A1 3/2017 Plattner
2017/0079319 A1 3/2017 Muhammed et al.
2017/0079321 A1 3/2017 Golz
2017/0079322 A1 3/2017 Li et al.
2017/0079323 A1 3/2017 Wang
2017/0079324 A1 3/2017 Eksouzian
2017/0079327 A1 3/2017 Wu et al.
2017/0079328 A1 3/2017 Wu
2017/0079329 A1 3/2017 Zitzke
2017/0079330 A1 3/2017 Mironov et al.
2017/0079331 A1 3/2017 Monsees et al.
2017/0079332 A1 3/2017 Li et al.
2017/0086496 A1 3/2017 Cameron
2017/0086497 A1 3/2017 Cameron
2017/0086498 A1 3/2017 Daryani
2017/0086499 A1 3/2017 Mize
2017/0086500 A1 3/2017 Li et al.
2017/0086501 A1 3/2017 Buehler et al.
2017/0086502 A1 3/2017 Hearn et al.
2017/0086503 A1 3/2017 Cameron
2017/0086504 A1 3/2017 Cameron
2017/0086505 A1 3/2017 Cameron
2017/0086506 A1 3/2017 Rado
2017/0086507 A1 3/2017 Rado
2017/0086508 A1 3/2017 Mironov et al.
2017/0091490 A1 3/2017 Cameron
2017/0091853 A1 3/2017 Cameron
2017/0092106 A1 3/2017 Cameron
2017/0092900 A1 3/2017 Yang
2017/0093960 A1 3/2017 Cameron
2017/0093981 A1 3/2017 Cameron
2017/0094998 A1 4/2017 Bernauer et al.
2017/0094999 A1 4/2017 Hearn et al.
2017/0095000 A1 4/2017 Spirito et al.
2017/0095001 A1 4/2017 Liu
2017/0095002 A1 4/2017 Silvestrini
2017/0095003 A1 4/2017 Mironov
2017/0095004 A1 4/2017 Liu
2017/0095005 A1 4/2017 Monsees et al.
2017/0095518 A1 4/2017 Bjorncrantz
2017/0095623 A1 4/2017 Trzecieski
2017/0099877 A1 4/2017 Worm et al.
2017/0099879 A1 4/2017 Heidl
2017/0099880 A1 4/2017 Hawes
2017/0101256 A1 4/2017 Zeitlin et al.
2017/0102013 A1 4/2017 Wallman et al.
2017/0105448 A1 4/2017 Scarpulla
2017/0105449 A1 4/2017 Hearn et al.
2017/0105450 A1 4/2017 Reed et al.
2017/0105451 A1 4/2017 Fornarelli
2017/0105452 A1 4/2017 Mironov et al.
2017/0105453 A1 4/2017 Li et al.
2017/0105454 A1 4/2017 Li et al.
2017/0105455 A1 4/2017 Qiu
2017/0108210 A1 4/2017 Meinhart et al.
2017/0108840 A1 4/2017 Hawes et al.
2017/0109877 A1 4/2017 Peleg et al.
2017/0112182 A1 4/2017 Arnold
2017/0112190 A1 4/2017 Buchberger
2017/0112192 A1 4/2017 Shan
2017/0112193 A1 4/2017 Chen
2017/0112196 A1 4/2017 Sur et al.
2017/0112197 A1 4/2017 Li et al.
2017/0113819 A1 4/2017 Marz
2017/0117654 A1 4/2017 Cruz
2017/0118292 A1 4/2017 Xiang
2017/0118584 A1 4/2017 Xiang
2017/0119040 A1 5/2017 Cameron
2017/0119044 A1 5/2017 Oligschlaeger et al.
2017/0119050 A1 5/2017 Blandino et al.
2017/0119052 A1 5/2017 Williams et al.
2017/0119053 A1 5/2017 Henry, Jr. et al.
2017/0119054 A1 5/2017 Zinovik et al.
2017/0119055 A1 5/2017 Liu
2017/0119057 A1 5/2017 Liu
2017/0119058 A1 5/2017 Cameron
2017/0119060 A1 5/2017 Li et al.
2017/0119061 A1 5/2017 Li et al.
2017/0127722 A1 5/2017 Davis et al.
2017/0127723 A1 5/2017 Wu
2017/0127724 A1 5/2017 Liu
2017/0127725 A1 5/2017 Buchberger et al.
2017/0127726 A1 5/2017 Xiang
2017/0127728 A1 5/2017 Li et al.
2017/0129661 A1 5/2017 Van Tassell, Iii et al.
2017/0135397 A1 5/2017 Buehler et al.
2017/0135398 A1 5/2017 Scott et al.
2017/0135399 A1 5/2017 Gavrielov et al.
2017/0135400 A1 5/2017 Liu
2017/0135401 A1 5/2017 Dickens
2017/0135402 A1 5/2017 Zitzke
2017/0135403 A1 5/2017 Liu
2017/0135407 A1 5/2017 Cameron
2017/0135408 A1 5/2017 Cameron
2017/0135409 A1 5/2017 Cameron
2017/0135410 A1 5/2017 Cameron
2017/0135411 A1 5/2017 Cameron
2017/0135412 A1 5/2017 Cameron
2017/0136193 A1 5/2017 Cameron
2017/0136194 A1 5/2017 Cameron
2017/0136301 A1 5/2017 Cameron
2017/0143035 A1 5/2017 Pucci
2017/0143037 A9 5/2017 Larson
2017/0143038 A1 5/2017 Dickens
2017/0143040 A1 5/2017 Liu
2017/0143043 A1 5/2017 Liu
2017/0143917 A1 5/2017 Cohen et al.
2017/0144827 A1 5/2017 Batista
2017/0146005 A1 5/2017 Edelen
2017/0150753 A1 6/2017 MacKo
2017/0150754 A1 6/2017 Lin
2017/0150755 A1 6/2017 Batista
2017/0150756 A1 6/2017 Rexroad et al.
2017/0150758 A1 6/2017 Fernando et al.
2017/0156397 A1 6/2017 Sur et al.
2017/0156398 A1 6/2017 Sur et al.
2017/0156400 A1 6/2017 Liu
2017/0156401 A1 6/2017 Liu
2017/0156402 A1 6/2017 Liu
2017/0156403 A1 6/2017 Gill et al.
2017/0156404 A1 6/2017 Novak, III et al.
2017/0156408 A1 6/2017 Li et al.
2017/0158436 A1 6/2017 Slurink
2017/0162523 A1 6/2017 Hu
2017/0162979 A1 6/2017 Liu
2017/0164655 A1 6/2017 Chen
2017/0164656 A1 6/2017 Eusepi et al.
2017/0164657 A1 6/2017 Batista
2017/0164658 A1 6/2017 Lin et al.
2017/0170439 A1 6/2017 Jarvis et al.
2017/0172204 A1 6/2017 Kane et al.
2017/0172205 A1 6/2017 Chang et al.
2017/0172207 A1 6/2017 Liu
2017/0172208 A1 6/2017 Mironov
2017/0172209 A1 6/2017 Saydar et al.
2017/0172213 A1 6/2017 Hon
2017/0172214 A1 6/2017 Li et al.
2017/0172215 A1 6/2017 Li et al.
2017/0181223 A1 6/2017 Sur et al.
2017/0181467 A1 6/2017 Cameron
2017/0181468 A1 6/2017 Bowen et al.
2017/0181470 A1 6/2017 Li
2017/0181471 A1 6/2017 Phillips et al.
2017/0181473 A1 6/2017 Batista et al.
2017/0181474 A1 6/2017 Cameron
2017/0181475 A1 6/2017 Cameron
2017/0181476 A1 6/2017 Li et al.
2017/0181928 A1 6/2017 Collins et al.
2017/0185364 A1 6/2017 Cameron
2017/0186122 A1 6/2017 Levings et al.

(56) References Cited

U.S. PATENT DOCUMENTS

2017/0188626 A1 7/2017 Davis et al.
2017/0188627 A1 7/2017 Sur
2017/0188628 A1 7/2017 Montgomery
2017/0188629 A1 7/2017 Dickens et al.
2017/0188631 A1 7/2017 Lin
2017/0188632 A1 7/2017 Hon
2017/0188634 A1 7/2017 Plojoux et al.
2017/0188635 A1 7/2017 Force et al.
2017/0188636 A1 7/2017 Li et al.
2017/0196263 A1 7/2017 Sur
2017/0196264 A1 7/2017 Liu
2017/0196265 A1 7/2017 Liu
2017/0196267 A1 7/2017 Zou et al.
2017/0196268 A1 7/2017 Reevell
2017/0196269 A1 7/2017 Bernauer et al.
2017/0196270 A1 7/2017 Vick et al.
2017/0196271 A1 7/2017 Levitz et al.
2017/0196272 A1 7/2017 Li et al.
2017/0196273 A1 7/2017 Qiu
2017/0202265 A1 7/2017 Hawes et al.
2017/0202266 A1 7/2017 Sur
2017/0202267 A1 7/2017 Liu
2017/0202268 A1 7/2017 Li et al.
2017/0207499 A1 7/2017 Leadley
2017/0208857 A1 7/2017 Branton et al.
2017/0208858 A1 7/2017 Li
2017/0208862 A1 7/2017 Li et al.
2017/0208863 A1 7/2017 Davis et al.
2017/0208864 A1 7/2017 Anderson, Jr. et al.
2017/0208865 A1 7/2017 Nettenstrom et al.
2017/0208866 A1 7/2017 Liu
2017/0208867 A1 7/2017 Li et al.
2017/0208868 A1 7/2017 Li et al.
2017/0208869 A1 7/2017 Li et al.
2017/0208870 A1 7/2017 Liu
2017/0208882 A1 7/2017 Lambertz
2017/0214261 A1 7/2017 Gratton
2017/0215470 A1 8/2017 Piccirilli et al.
2017/0215473 A1 8/2017 Nakano et al.
2017/0215474 A1 8/2017 Li
2017/0215476 A1 8/2017 Dickens et al.
2017/0215477 A1 8/2017 Reevell
2017/0215478 A1 8/2017 Harrison et al.
2017/0215479 A1 8/2017 Kies
2017/0215480 A1 8/2017 Qiu
2017/0215481 A1 8/2017 Li et al.
2017/0215482 A1 8/2017 Levitz et al.
2017/0215483 A1 8/2017 Li et al.
2017/0215484 A1 8/2017 Xiang
2017/0215485 A1 8/2017 Zitzke
2017/0217607 A1 8/2017 Slurink
2017/0219199 A1 8/2017 Lou et al.
2017/0219391 A1 8/2017 Lin et al.
2017/0222468 A1 8/2017 Schennum et al.
2017/0224013 A1 8/2017 Huang
2017/0224014 A1 8/2017 Fraser
2017/0224016 A1 8/2017 Reevell
2017/0224017 A1 8/2017 Li et al.
2017/0224018 A1 8/2017 Li et al.
2017/0224022 A1 8/2017 Liu
2017/0224023 A1 8/2017 Lin et al.
2017/0224024 A1 8/2017 Jochnowitz et al.
2017/0229885 A1 8/2017 Bernauer
2017/0229888 A1 8/2017 Liu
2017/0231266 A1 8/2017 Mishra et al.
2017/0231267 A1 8/2017 Shi et al.
2017/0231269 A1 8/2017 Besso et al.
2017/0231273 A1 8/2017 Xiang
2017/0231275 A1 8/2017 Guenther
2017/0231276 A1 8/2017 Mironov et al.
2017/0231277 A1 8/2017 Mironov et al.
2017/0231278 A1 8/2017 Mironov et al.
2017/0231279 A1 8/2017 Watson
2017/0231280 A1 8/2017 Anton
2017/0231281 A1 8/2017 Hatton et al.
2017/0231282 A1 8/2017 Bowen et al.
2017/0231283 A1 8/2017 Gadas
2017/0231284 A1 8/2017 Newns
2017/0231285 A1 8/2017 Holzherr et al.
2017/0231286 A1 8/2017 Borkovec et al.
2017/0233114 A1 8/2017 Christensen et al.
2017/0238596 A1 8/2017 Matsumoto et al.
2017/0238605 A1 8/2017 Matsumoto et al.
2017/0238606 A1 8/2017 Matsumoto et al.
2017/0238608 A1 8/2017 Matsumoto et al.
2017/0238609 A1 8/2017 Schlipf
2017/0238611 A1 8/2017 Buchberger
2017/0238612 A1 8/2017 Daryani et al.
2017/0238613 A1 8/2017 Suess et al.
2017/0238614 A1 8/2017 Li et al.
2017/0238617 A1 8/2017 Scatterday
2017/0241857 A1 8/2017 Hearn et al.
2017/0245543 A1 8/2017 Karles et al.
2017/0245546 A1 8/2017 Huang
2017/0245547 A1 8/2017 Lipowicz
2017/0245550 A1 8/2017 Freelander
2017/0245551 A1 8/2017 Reevell
2017/0245554 A1 8/2017 Perez et al.
2017/0246399 A1 8/2017 Forlani et al.
2017/0246405 A1 8/2017 Wensley et al.
2017/0246407 A1 8/2017 Matsumoto et al.
2017/0250552 A1 8/2017 Liu
2017/0251714 A1 9/2017 Mishra et al.
2017/0251718 A1 9/2017 Armoush et al.
2017/0251719 A1 9/2017 Cyphert et al.
2017/0251721 A1 9/2017 Rostami et al.
2017/0251722 A1 9/2017 Kobal et al.
2017/0251723 A1 9/2017 Kobal et al.
2017/0251724 A1 9/2017 Lamb et al.
2017/0251725 A1 9/2017 Buchberger et al.
2017/0251726 A1 9/2017 Nielsen
2017/0251727 A1 9/2017 Nielsen
2017/0251728 A1 9/2017 Peleg et al.
2017/0251729 A1 9/2017 Li et al.
2017/0258129 A1 9/2017 Haun
2017/0258132 A1 9/2017 Rostami et al.
2017/0258134 A1 9/2017 Kane
2017/0258137 A1 9/2017 Smith et al.
2017/0258138 A1 9/2017 Rostami et al.
2017/0258139 A1 9/2017 Rostami et al.
2017/0258140 A1 9/2017 Rostami et al.
2017/0258142 A1 9/2017 Hatton et al.
2017/0258143 A1 9/2017 Lederer
2017/0259170 A1 9/2017 Bowen et al.
2017/0259954 A1 9/2017 Schwester
2017/0261200 A1 9/2017 Stultz
2017/0265517 A1 9/2017 Swede et al.
2017/0265522 A1 9/2017 Li et al.
2017/0265524 A1 9/2017 Cadieux et al.
2017/0265525 A1 9/2017 Li et al.
2017/0266397 A1 9/2017 Mayle et al.
2017/0273353 A1 9/2017 Gindrat
2017/0273354 A1 9/2017 Tucker et al.
2017/0273355 A1 9/2017 Rogers et al.
2017/0273357 A1 9/2017 Barbuck
2017/0273358 A1 9/2017 Batista et al.
2017/0273359 A1 9/2017 Liu
2017/0273360 A1 9/2017 Brinkley et al.
2017/0273361 A1 9/2017 Li et al.
2017/0273914 A1 9/2017 Knudsen
2017/0280767 A1 10/2017 Li et al.
2017/0280768 A1 10/2017 Lipowicz
2017/0280769 A1 10/2017 Li et al.
2017/0280770 A1 10/2017 Wang et al.
2017/0280771 A1 10/2017 Courbat et al.
2017/0280775 A1 10/2017 Manca et al.
2017/0280776 A1 10/2017 Manca et al.
2017/0280778 A1 10/2017 Force
2017/0281883 A1 10/2017 Li et al.
2017/0283154 A1 10/2017 Karles et al.
2017/0285810 A1 10/2017 Krah
2017/0290368 A1 10/2017 Hearn
2017/0290369 A1 10/2017 Norasak
2017/0290370 A1 10/2017 Garthaffner et al.

(56) References Cited

U.S. PATENT DOCUMENTS

| | | | |
|---|---|---|---|
| 2017/0290371 | A1 | 10/2017 | Davis et al. |
| 2017/0290373 | A1 | 10/2017 | Hon |
| 2017/0290998 | A1 | 10/2017 | Poston et al. |
| 2017/0295840 | A1 | 10/2017 | Rath et al. |
| 2017/0295843 | A1 | 10/2017 | Storch |
| 2017/0295844 | A1 | 10/2017 | Thevenaz et al. |
| 2017/0295845 | A1 | 10/2017 | Bajpai et al. |
| 2017/0295846 | A1 | 10/2017 | Liu |
| 2017/0295847 | A1 | 10/2017 | Liu |
| 2017/0295848 | A1 | 10/2017 | Lamothe |
| 2017/0295849 | A1 | 10/2017 | Cadieux et al. |
| 2017/0297892 | A1 | 10/2017 | Li et al. |
| 2017/0301898 | A1 | 10/2017 | Lin et al. |
| 2017/0302089 | A1 | 10/2017 | Bernauer et al. |
| 2017/0302324 | A1 | 10/2017 | Stanimirovic et al. |
| 2017/0303597 | A1 | 10/2017 | Tsui |
| 2017/0311648 | A1 | 11/2017 | Gill et al. |
| 2017/0318860 | A1 | 11/2017 | Adair |
| 2017/0318861 | A1 | 11/2017 | Thorens |
| 2017/0325503 | A1 | 11/2017 | Liu |
| 2017/0325504 | A1 | 11/2017 | Liu |
| 2017/0325506 | A1 | 11/2017 | Batista |
| 2017/0332695 | A1 | 11/2017 | Zappoli et al. |
| 2017/0333415 | A1 | 11/2017 | Williams |
| 2017/0333650 | A1 | 11/2017 | Buchberger et al. |
| 2017/0333651 | A1 | 11/2017 | Qiu |
| 2017/0334605 | A1 | 11/2017 | Murphy et al. |
| 2018/0117268 | A1 | 5/2018 | Selby et al. |
| 2018/0160737 | A1 | 6/2018 | Verleur et al. |

FOREIGN PATENT DOCUMENTS

| | | | |
|---|---|---|---|
| AU | 2017202891 | A1 | 5/2017 |
| CA | 2641869 | A1 | 5/2010 |
| CN | 1122213 | A | 5/1996 |
| CN | 201430916 | Y | 3/2010 |
| CN | 101869356 | A | 10/2010 |
| CN | 301547686 | S | 5/2011 |
| CN | 301970169 | S | 6/2012 |
| CN | 102754924 | A | 10/2012 |
| CN | 302396126 | S | 4/2013 |
| CN | 30279954 | S | 4/2014 |
| CN | 103750571 | A | 4/2014 |
| CN | 302810246 | S | 4/2014 |
| CN | 302884434 | S | 7/2014 |
| CN | 302926289 | S | 8/2014 |
| CN | 302950830 | S | 9/2014 |
| CN | 303091331 | S | 1/2015 |
| CN | 303103390 | S | 2/2015 |
| CN | 303210086 | S | 5/2015 |
| CN | 303568163 | S | 1/2016 |
| DE | 19854005 | A1 | 5/2000 |
| DE | 19854012 | A1 | 5/2000 |
| EP | 0283672 | A2 | 9/1988 |
| EP | 0503767 | A1 | 9/1992 |
| EP | 0532194 | A1 | 3/1993 |
| EP | 0535695 | A2 | 4/1993 |
| EP | 2186507 | A2 | 5/2010 |
| EP | 2399636 | A1 | 12/2011 |
| EP | 2614731 | A1 | 7/2013 |
| EP | 2711006 | A1 | 3/2014 |
| EP | 2641669 | B1 | 5/2014 |
| EP | 2789248 | A1 | 10/2014 |
| EP | 2493342 | B1 | 12/2014 |
| EP | 2856893 | A1 | 4/2015 |
| EP | 2862454 | A1 | 4/2015 |
| EP | 2862457 | A1 | 4/2015 |
| EP | 2944206 | A1 | 11/2015 |
| EP | 2952110 | A1 | 12/2015 |
| EP | 2989912 | A1 | 3/2016 |
| EP | 3001918 | A1 | 4/2016 |
| EP | 3007305 | A1 | 4/2016 |
| EP | 3012213 | A1 | 4/2016 |
| EP | 3016233 | A1 | 5/2016 |
| EP | 3023016 | A1 | 5/2016 |
| EP | 3023351 | A1 | 5/2016 |
| EP | 3023947 | A1 | 5/2016 |
| EP | 3025598 | A1 | 6/2016 |
| EP | 3026779 | A1 | 6/2016 |
| EP | 3031338 | A1 | 6/2016 |
| EP | 3031339 | A1 | 6/2016 |
| EP | 3047742 | A1 | 7/2016 |
| EP | 3056099 | A1 | 8/2016 |
| EP | 3061358 | A1 | 8/2016 |
| EP | 3075270 | A1 | 10/2016 |
| EP | 3075271 | A1 | 10/2016 |
| EP | 3081102 | A1 | 10/2016 |
| EP | 3085638 | A1 | 10/2016 |
| EP | 3087853 | A1 | 11/2016 |
| EP | 3097803 | A1 | 11/2016 |
| EP | 3103355 | A1 | 12/2016 |
| EP | 3103356 | A1 | 12/2016 |
| EP | 3111787 | A1 | 1/2017 |
| EP | 3130238 | A1 | 2/2017 |
| EP | 3132843 | A1 | 2/2017 |
| EP | 3135139 | A1 | 3/2017 |
| EP | 3135603 | A1 | 3/2017 |
| EP | 3143882 | A3 | 3/2017 |
| EP | 3143884 | A3 | 4/2017 |
| EP | 3155908 | A1 | 4/2017 |
| EP | 3158880 | A1 | 4/2017 |
| EP | 3158881 | A1 | 4/2017 |
| EP | 3195738 | A2 | 7/2017 |
| EP | 3165102 | A3 | 8/2017 |
| EP | 3199043 | A1 | 8/2017 |
| EP | 3205220 | A1 | 8/2017 |
| EP | 3205597 | A1 | 8/2017 |
| EP | 3213649 | A1 | 9/2017 |
| EP | 3225118 | A1 | 10/2017 |
| EP | 3228198 | A1 | 10/2017 |
| EP | 3228345 | A1 | 10/2017 |
| ES | 2118034 | A1 | 9/1998 |
| GB | 1025630 | A | 4/1966 |
| GB | 1065678 | A | 4/1967 |
| GB | 2533174 | A | 6/2016 |
| IE | S20050615 | | 9/2005 |
| JP | 62278975 | | 12/1987 |
| JP | H06114105 | A | 4/1994 |
| JP | 09-075058 | | 3/1997 |
| JP | H09075058 | A | 3/1997 |
| JP | 11178563 | | 6/1999 |
| JP | 2000203639 | A | 7/2000 |
| JP | 2000236865 | A | 9/2000 |
| JP | 2001161819 | A | 6/2001 |
| JP | 2001165437 | A | 6/2001 |
| JP | 2006320285 | A | 11/2006 |
| JP | 2006320286 | A | 11/2006 |
| JP | 2009213428 | A | 9/2009 |
| JP | 2010020929 | A | 1/2010 |
| JP | 2011024430 | A | 2/2011 |
| JP | 2012005412 | A | 1/2012 |
| JP | 2015504669 | A | 2/2015 |
| JP | 201712730 | A | 1/2017 |
| TW | 201436722 | A | 10/2014 |
| TW | 201438608 | A | 10/2014 |
| TW | 201524383 | A | 7/2015 |
| WO | WO-9712639 | A1 | 4/1997 |
| WO | WO-2000005976 | A1 | 2/2000 |
| WO | WO-0028842 | A1 | 5/2000 |
| WO | WO-03055486 | A1 | 7/2003 |
| WO | WO-03056948 | A1 | 7/2003 |
| WO | WO-03082031 | A1 | 10/2003 |
| WO | WO-03101454 | A1 | 12/2003 |
| WO | WO-2004064548 | A1 | 8/2004 |
| WO | WO-2004080216 | A1 | 9/2004 |
| WO | WO-2005020726 | A1 | 3/2005 |
| WO | WO-2005060366 | A2 | 7/2005 |
| WO | WO-2006021153 | A1 | 3/2006 |
| WO | WO-2007066374 | A1 | 6/2007 |
| WO | WO-2007078273 | A1 | 7/2007 |
| WO | WO-2007095109 | A2 | 8/2007 |
| WO | WO-2007117675 | A2 | 10/2007 |
| WO | WO-2007/141520 | A1 | 12/2007 |
| WO | WO-2008077271 | A1 | 7/2008 |

(56) References Cited

FOREIGN PATENT DOCUMENTS

| | | | | |
|---|---|---|---|---|
| WO | WO-2008151777 | A2 | 12/2008 | |
| WO | WO-2009003204 | A2 | 1/2009 | |
| WO | WO-2010003480 | A1 | 1/2010 | |
| WO | WO-2010118122 | A1 | 10/2010 | |
| WO | WO-2010118644 | A1 | 10/2010 | |
| WO | WO-2010140841 | A2 | 12/2010 | |
| WO | WO-2010145805 | A1 | 12/2010 | |
| WO | WO-2011010334 | A1 | 1/2011 | |
| WO | WO-2011050964 | A1 | 5/2011 | |
| WO | WO-2011125058 | A1 | 10/2011 | |
| WO | WO-2012019533 | A1 | 2/2012 | |
| WO | WO-2012043941 | A1 | 4/2012 | |
| WO | WO-2012062600 | A1 | 5/2012 | |
| WO | WO-2012088675 | A1 | 7/2012 | |
| WO | WO-2012091249 | A1 | 7/2012 | |
| WO | WO-2012100523 | A1 | 8/2012 | |
| WO | WO-2012129812 | A1 | 10/2012 | |
| WO | WO-2012134117 | A2 | 10/2012 | |
| WO | WO-2012164033 | A1 | 12/2012 | |
| WO | WO-2012173322 | A1 | 12/2012 | |
| WO | WO-2012174677 | A1 | 12/2012 | |
| WO | WO-D079115-0010 | | 12/2012 | |
| WO | WO-2013012157 | A1 | 1/2013 | |
| WO | WO-2013020220 | A1 | 2/2013 | |
| WO | WO-2013030202 | A1 | 3/2013 | |
| WO | WO-2013034453 | A1 | 3/2013 | |
| WO | WO-2013040193 | A2 | 3/2013 | |
| WO | WO-2013044537 | A1 | 4/2013 | |
| WO | WO-2013076750 | A1 | 5/2013 | |
| WO | WO-2013083635 | A1 | 6/2013 | |
| WO | WO-2013089551 | A1 | 6/2013 | |
| WO | WO-2013110208 | A1 | 8/2013 | |
| WO | WO-2013110209 | A1 | 8/2013 | |
| WO | WO-2013110210 | A1 | 8/2013 | |
| WO | WO-2013113173 | A1 | 8/2013 | |
| WO | WO-2013113174 | A1 | 8/2013 | |
| WO | WO-2013113612 | A1 | 8/2013 | |
| WO | WO-2013116983 | A1 | 8/2013 | |
| WO | WO-2013131763 | A1 | 9/2013 | |
| WO | WO-2013142678 | A1 | 9/2013 | |
| WO | WO-2013150406 | A2 | 10/2013 | |
| WO | WO-2013156658 | A1 | 10/2013 | |
| WO | WO-2013171206 | A1 | 11/2013 | |
| WO | WO-2013174001 | A1 | 11/2013 | |
| WO | WO-2014020539 | A1 | 2/2014 | |
| WO | WO-2014020953 | A1 | 2/2014 | |
| WO | WO-2014023171 | A1 | 2/2014 | |
| WO | WO-2014032280 | A1 | 3/2014 | |
| WO | WO-2014040915 | A1 | 3/2014 | |
| WO | WO-2014047948 | A1 | 4/2014 | |
| WO | WO-2014047955 | A1 | 4/2014 | |
| WO | WO-2014067236 | A1 | 5/2014 | |
| WO | WO-2014071747 | A1 | 5/2014 | |
| WO | WO-2014101119 | A1 | 7/2014 | |
| WO | WO-2014101401 | A1 | 7/2014 | |
| WO | WO-2014101734 | A1 | 7/2014 | |
| WO | WO-2014106323 | A1 | 7/2014 | |
| WO | WO-2014110761 | A1 | 7/2014 | |
| WO | WO-2014113949 | A1 | 7/2014 | |
| WO | WO-2014117382 | A1 | 8/2014 | |
| WO | WO-2014121509 | A1 | 8/2014 | |
| WO | WO-2014125340 | A1 | 8/2014 | |
| WO | WO-2014127446 | A1 | 8/2014 | |
| WO | WO-2014134781 | A1 | 9/2014 | |
| WO | WO-2014144678 | A2 | 9/2014 | |
| WO | WO-2014146270 | A1 | 9/2014 | |
| WO | WO-2014147470 | A2 | 9/2014 | |
| WO | WO-2014161181 | A1 | 10/2014 | |
| WO | WO-2014166039 | A1 | 10/2014 | |
| WO | WO-2014167530 | A1 | 10/2014 | |
| WO | WO-2014169437 | A1 | 10/2014 | |
| WO | WO-2014169667 | A1 | 10/2014 | |
| WO | WO-2014185937 | A1 | 11/2014 | |
| WO | WO-2014186983 | A1 | 11/2014 | |
| WO | WO-2014194499 | A1 | 12/2014 | |
| WO | WO-2014195687 | A1 | 12/2014 | |
| WO | WO-2014198042 | A1 | 12/2014 | |
| WO | WO-2014201610 | A1 | 12/2014 | |
| WO | WO-2014201611 | A1 | 12/2014 | |
| WO | WO-2014201646 | A1 | 12/2014 | |
| WO | WO-2014201664 | A1 | 12/2014 | |
| WO | WO-2014201666 | A1 | 12/2014 | |
| WO | WO-2014201668 | A1 | 12/2014 | |
| WO | WO-2014205749 | A1 | 12/2014 | |
| WO | WO-2014205780 | A1 | 12/2014 | |
| WO | WO-2014205807 | A1 | 12/2014 | |
| WO | WO-2014205811 | A1 | 12/2014 | |
| WO | WO-2014206148 | A1 | 12/2014 | |
| WO | WO-2015000125 | A1 | 1/2015 | |
| WO | WO-2015000180 | A1 | 1/2015 | |
| WO | WO-2015003327 | A1 | 1/2015 | |
| WO | WO-2015003372 | A1 | 1/2015 | |
| WO | WO-2015003374 | A1 | 1/2015 | |
| WO | WO-2015006929 | A1 | 1/2015 | |
| WO | WO-2015010242 | A1 | 1/2015 | |
| WO | WO-2015010277 | A1 | 1/2015 | |
| WO | WO-2015010284 | A1 | 1/2015 | |
| WO | WO-2015010291 | A1 | 1/2015 | |
| WO | WO-2015010310 | A1 | 1/2015 | |
| WO | WO-2015010336 | A1 | 1/2015 | |
| WO | WO-2015010345 | A1 | 1/2015 | |
| WO | WO-2015010349 | A1 | 1/2015 | |
| WO | WO-2015013890 | A1 | 2/2015 | |
| WO | WO-2015013891 | A1 | 2/2015 | |
| WO | WO-2015013892 | A1 | 2/2015 | |
| WO | WO-2015013926 | A1 | 2/2015 | |
| WO | WO-2015013950 | A1 | 2/2015 | |
| WO | WO-2015013967 | A1 | 2/2015 | |
| WO | WO-2015015156 | A1 | 2/2015 | |
| WO | WO-2015017971 | A1 | 2/2015 | |
| WO | WO-2015018026 | A1 | 2/2015 | |
| WO | WO-2015018120 | A1 | 2/2015 | |
| WO | WO-2015021612 | A1 | 2/2015 | |
| WO | WO-2015021646 | A1 | 2/2015 | |
| WO | WO-2015021651 | A1 | 2/2015 | |
| WO | WO-2015021652 | A1 | 2/2015 | |
| WO | WO-2015021655 | A1 | 2/2015 | |
| WO | WO-2015021658 | A1 | 2/2015 | |
| WO | WO-2015024239 | A1 | 2/2015 | |
| WO | WO-2015024247 | A1 | 2/2015 | |
| WO | WO-2015026081 | A1 | 2/2015 | |
| WO | WO-2015027383 | A1 | 3/2015 | |
| WO | WO-2015027435 | A1 | 3/2015 | |
| WO | WO-2015027436 | A1 | 3/2015 | |
| WO | WO-2015027470 | A1 | 3/2015 | |
| WO | WO 2015028815 | A1 * | 3/2015 | ..... G07F 13/02 |
| WO | WO-2015028815 | A1 | 3/2015 | |
| WO | WO-2015032050 | A1 | 3/2015 | |
| WO | WO-2015032055 | A1 | 3/2015 | |
| WO | WO-2015032078 | A1 | 3/2015 | |
| WO | WO-2015032093 | A1 | 3/2015 | |
| WO | WO-2015035510 | A1 | 3/2015 | |
| WO | WO-2015035547 | A1 | 3/2015 | |
| WO | WO-2015035557 | A1 | 3/2015 | |
| WO | WO-2015035587 | A1 | 3/2015 | |
| WO | WO-2015035623 | A1 | 3/2015 | |
| WO | WO-2015035689 | A1 | 3/2015 | |
| WO | WO-2015037925 | A1 | 3/2015 | |
| WO | WO-2015039275 | A1 | 3/2015 | |
| WO | WO-2015039280 | A1 | 3/2015 | |
| WO | WO-2015039332 | A1 | 3/2015 | |
| WO | WO-2015042790 | A1 | 4/2015 | |
| WO | WO-2015042811 | A1 | 4/2015 | |
| WO | WO-2015042848 | A1 | 4/2015 | |
| WO | WO-2015042943 | A1 | 4/2015 | |
| WO | WO-2015051509 | A1 | 4/2015 | |
| WO | WO-2015051538 | A1 | 4/2015 | |
| WO | WO-2015054815 | A1 | 4/2015 | |
| WO | WO-2015054961 | A1 | 4/2015 | |
| WO | WO-2015055314 | A1 | 4/2015 | |
| WO | WO-2015058340 | A1 | 4/2015 | |
| WO | WO-2015058341 | A1 | 4/2015 | |
| WO | WO-2015058367 | A1 | 4/2015 | |
| WO | WO-2015058387 | A1 | 4/2015 | |

(56) References Cited

FOREIGN PATENT DOCUMENTS

| | | | |
|---|---|---|---|
| WO | WO-2015062041 | A1 | 5/2015 |
| WO | WO-2015066136 | A1 | 5/2015 |
| WO | WO-2015066927 | A1 | 5/2015 |
| WO | WO-2015070398 | A1 | 5/2015 |
| WO | WO-2015070405 | A1 | 5/2015 |
| WO | WO-2015071703 | A1 | 5/2015 |
| WO | WO-2015073975 | A1 | 5/2015 |
| WO | WO-2015074187 | A1 | 5/2015 |
| WO | WO-2015074265 | A1 | 5/2015 |
| WO | WO-2015074308 | A1 | 5/2015 |
| WO | WO-2015077998 | A1 | 6/2015 |
| WO | WO-2015077999 | A1 | 6/2015 |
| WO | WO-2015078010 | A1 | 6/2015 |
| WO | WO-2015079197 | A1 | 6/2015 |
| WO | WO-2015089711 | A1 | 6/2015 |
| WO | WO-2015091346 | A2 | 6/2015 |
| WO | WO-2015013327 | A3 | 7/2015 |
| WO | WO-2015106434 | A1 | 7/2015 |
| WO | WO-2015106440 | A1 | 7/2015 |
| WO | WO-2015107551 | A2 | 7/2015 |
| WO | WO-2015107552 | A1 | 7/2015 |
| WO | WO-2015109476 | A1 | 7/2015 |
| WO | WO-2015109532 | A1 | 7/2015 |
| WO | WO-2015109540 | A1 | 7/2015 |
| WO | WO-2015109616 | A1 | 7/2015 |
| WO | WO-2015109618 | A1 | 7/2015 |
| WO | WO-2015117285 | A1 | 8/2015 |
| WO | WO-2015120588 | A1 | 8/2015 |
| WO | WO-2015120591 | A1 | 8/2015 |
| WO | WO-2015120623 | A1 | 8/2015 |
| WO | WO-2015123831 | A1 | 8/2015 |
| WO | WO-2015127609 | A1 | 9/2015 |
| WO | WO-2015128599 | A1 | 9/2015 |
| WO | WO-2015137815 | A1 | 9/2015 |
| WO | WO-2015140312 | A1 | 9/2015 |
| WO | WO-2015140768 | A2 | 9/2015 |
| WO | WO-2015143637 | A1 | 10/2015 |
| WO | WO-2015143648 | A1 | 10/2015 |
| WO | WO-2015143749 | A1 | 10/2015 |
| WO | WO-2015143765 | A1 | 10/2015 |
| WO | WO-2015144057 | A1 | 10/2015 |
| WO | WO-2015149311 | A1 | 10/2015 |
| WO | WO-2015149330 | A1 | 10/2015 |
| WO | WO-2015149332 | A1 | 10/2015 |
| WO | WO-2015149338 | A1 | 10/2015 |
| WO | WO-2015149368 | A1 | 10/2015 |
| WO | WO-2015149403 | A1 | 10/2015 |
| WO | WO-2015149406 | A1 | 10/2015 |
| WO | WO-2015150068 | A1 | 10/2015 |
| WO | WO-2015154309 | A1 | 10/2015 |
| WO | WO-2015154619 | A1 | 10/2015 |
| WO | WO-2015157891 | A1 | 10/2015 |
| WO | WO-2015157893 | A1 | 10/2015 |
| WO | WO-2015157900 | A1 | 10/2015 |
| WO | WO-2015157901 | A1 | 10/2015 |
| WO | WO-2015157928 | A1 | 10/2015 |
| WO | WO-2015158522 | A1 | 10/2015 |
| WO | WO-2015158548 | A1 | 10/2015 |
| WO | WO-2015161406 | A1 | 10/2015 |
| WO | WO-2015161407 | A1 | 10/2015 |
| WO | WO-2015161485 | A1 | 10/2015 |
| WO | WO-2015161486 | A1 | 10/2015 |
| WO | WO-2015161491 | A1 | 10/2015 |
| WO | WO-2015161514 | A1 | 10/2015 |
| WO | WO-2015161553 | A1 | 10/2015 |
| WO | WO-2015161555 | A1 | 10/2015 |
| WO | WO-2015161557 | A1 | 10/2015 |
| WO | WO-2015068044 | A3 | 11/2015 |
| WO | WO-2015165067 | A1 | 11/2015 |
| WO | WO-2015165081 | A1 | 11/2015 |
| WO | WO-2015165083 | A1 | 11/2015 |
| WO | WO-2015165086 | A1 | 11/2015 |
| WO | WO-2015165105 | A1 | 11/2015 |
| WO | WO-2015165146 | A1 | 11/2015 |
| WO | WO-2015168827 | A1 | 11/2015 |
| WO | WO-2015168828 | A1 | 11/2015 |
| WO | WO-2015168853 | A1 | 11/2015 |
| WO | WO-2015168904 | A1 | 11/2015 |
| WO | WO-2015168912 | A1 | 11/2015 |
| WO | WO-2015172331 | A1 | 11/2015 |
| WO | WO-2015172361 | A1 | 11/2015 |
| WO | WO-2015172368 | A1 | 11/2015 |
| WO | WO-2015172382 | A1 | 11/2015 |
| WO | WO-2015172383 | A1 | 11/2015 |
| WO | WO-2015172384 | A1 | 11/2015 |
| WO | WO-2015172387 | A1 | 11/2015 |
| WO | WO-2015172388 | A1 | 11/2015 |
| WO | WO-2015172389 | A1 | 11/2015 |
| WO | WO-2015172390 | A1 | 11/2015 |
| WO | WO-2015172606 | A1 | 11/2015 |
| WO | WO-2015174657 | A1 | 11/2015 |
| WO | WO-2015174708 | A1 | 11/2015 |
| WO | WO-2015175979 | A1 | 11/2015 |
| WO | WO-2015176210 | A1 | 11/2015 |
| WO | WO-2015176230 | A1 | 11/2015 |
| WO | WO-2015176300 | A1 | 11/2015 |
| WO | WO-2015176580 | A1 | 11/2015 |
| WO | WO-2015180027 | A1 | 12/2015 |
| WO | WO-2015180061 | A1 | 12/2015 |
| WO | WO-2015180062 | A1 | 12/2015 |
| WO | WO-2015180071 | A1 | 12/2015 |
| WO | WO-2015180088 | A1 | 12/2015 |
| WO | WO-2015180089 | A1 | 12/2015 |
| WO | WO-2015180145 | A1 | 12/2015 |
| WO | WO-2015184580 | A1 | 12/2015 |
| WO | WO-2015184590 | A1 | 12/2015 |
| WO | WO-2015184620 | A1 | 12/2015 |
| WO | WO-2015184747 | A1 | 12/2015 |
| WO | WO-2015188295 | A1 | 12/2015 |
| WO | WO-2015188296 | A1 | 12/2015 |
| WO | WO-2015189613 | A1 | 12/2015 |
| WO | WO-2015190810 | A1 | 12/2015 |
| WO | WO-2015192301 | A1 | 12/2015 |
| WO | WO-2015192326 | A1 | 12/2015 |
| WO | WO-2015192336 | A1 | 12/2015 |
| WO | WO-2015192337 | A1 | 12/2015 |
| WO | WO-2015192377 | A1 | 12/2015 |
| WO | WO-2015193456 | A1 | 12/2015 |
| WO | WO-2015196331 | A1 | 12/2015 |
| WO | WO-2015196332 | A1 | 12/2015 |
| WO | WO-2015196357 | A1 | 12/2015 |
| WO | WO-2015196367 | A1 | 12/2015 |
| WO | WO-2015196395 | A1 | 12/2015 |
| WO | WO-2015196463 | A1 | 12/2015 |
| WO | WO-2015148649 | A3 | 1/2016 |
| WO | WO-2016000113 | A1 | 1/2016 |
| WO | WO-2016000130 | A1 | 1/2016 |
| WO | WO-2016000135 | A1 | 1/2016 |
| WO | WO-2016000136 | A1 | 1/2016 |
| WO | WO-2016000139 | A1 | 1/2016 |
| WO | WO-2016000206 | A1 | 1/2016 |
| WO | WO-2016000207 | A1 | 1/2016 |
| WO | WO-2016000214 | A1 | 1/2016 |
| WO | WO-2016000232 | A1 | 1/2016 |
| WO | WO-2016000233 | A1 | 1/2016 |
| WO | WO-2016000305 | A1 | 1/2016 |
| WO | WO-2016008067 | A1 | 1/2016 |
| WO | WO-2016008096 | A1 | 1/2016 |
| WO | WO-2016008217 | A1 | 1/2016 |
| WO | WO-2016011573 | A1 | 1/2016 |
| WO | WO-2016012769 | A1 | 1/2016 |
| WO | WO-2016015196 | A1 | 2/2016 |
| WO | WO-2016015245 | A1 | 2/2016 |
| WO | WO-2016015246 | A1 | 2/2016 |
| WO | WO-2016015247 | A1 | 2/2016 |
| WO | WO-2016015264 | A1 | 2/2016 |
| WO | WO-2016015712 | A1 | 2/2016 |
| WO | WO-2016019508 | A1 | 2/2016 |
| WO | WO-2016019550 | A1 | 2/2016 |
| WO | WO-2016019573 | A1 | 2/2016 |
| WO | WO-2016020675 | A1 | 2/2016 |
| WO | WO-2016023173 | A1 | 2/2016 |
| WO | WO-2016023176 | A1 | 2/2016 |
| WO | WO-2016023177 | A1 | 2/2016 |

(56) References Cited

FOREIGN PATENT DOCUMENTS

| | | | |
|---|---|---|---|
| WO | WO-2016023181 | A1 | 2/2016 |
| WO | WO-2016023182 | A1 | 2/2016 |
| WO | WO-2016023183 | A1 | 2/2016 |
| WO | WO-2016023212 | A1 | 2/2016 |
| WO | WO-2016023651 | A1 | 2/2016 |
| WO | WO-2016023824 | A1 | 2/2016 |
| WO | WO-2016023965 | A1 | 2/2016 |
| WO | WO-2016026104 | A1 | 2/2016 |
| WO | WO-2016026105 | A1 | 2/2016 |
| WO | WO-2016026156 | A1 | 2/2016 |
| WO | WO-2016026811 | A1 | 2/2016 |
| WO | WO-2016028544 | A1 | 2/2016 |
| WO | WO-2016029344 | A1 | 3/2016 |
| WO | WO-2016029382 | A1 | 3/2016 |
| WO | WO-2016029386 | A1 | 3/2016 |
| WO | WO-2016029389 | A1 | 3/2016 |
| WO | WO-2016029429 | A1 | 3/2016 |
| WO | WO-2016029464 | A1 | 3/2016 |
| WO | WO-2016029468 | A1 | 3/2016 |
| WO | WO-2016029470 | A1 | 3/2016 |
| WO | WO-2016029473 | A1 | 3/2016 |
| WO | WO-2016029567 | A1 | 3/2016 |
| WO | WO-2016030661 | A1 | 3/2016 |
| WO | WO-2016033721 | A1 | 3/2016 |
| WO | WO-2016033734 | A1 | 3/2016 |
| WO | WO-2016033783 | A1 | 3/2016 |
| WO | WO-2016033817 | A1 | 3/2016 |
| WO | WO-2016034100 | A1 | 3/2016 |
| WO | WO-2016038029 | A1 | 3/2016 |
| WO | WO-2016040575 | A1 | 3/2016 |
| WO | WO-2016041114 | A1 | 3/2016 |
| WO | WO-2016041140 | A1 | 3/2016 |
| WO | WO-2016041141 | A1 | 3/2016 |
| WO | WO-2016041207 | A1 | 3/2016 |
| WO | WO-2016041209 | A1 | 3/2016 |
| WO | WO-2016045058 | A1 | 3/2016 |
| WO | WO-2016046116 | A1 | 3/2016 |
| WO | WO-2015192834 | A3 | 4/2016 |
| WO | WO-2016049822 | A1 | 4/2016 |
| WO | WO-2016049823 | A1 | 4/2016 |
| WO | WO-2016049855 | A1 | 4/2016 |
| WO | WO-2016049863 | A1 | 4/2016 |
| WO | WO-2016050246 | A1 | 4/2016 |
| WO | WO-2016050247 | A1 | 4/2016 |
| WO | WO-2016054793 | A1 | 4/2016 |
| WO | WO-2016055653 | A1 | 4/2016 |
| WO | WO-2016058139 | A1 | 4/2016 |
| WO | WO-2016058187 | A1 | 4/2016 |
| WO | WO-2016058189 | A1 | 4/2016 |
| WO | WO-2016059000 | A1 | 4/2016 |
| WO | WO-2016060576 | A1 | 4/2016 |
| WO | WO-2016061729 | A1 | 4/2016 |
| WO | WO-2016061730 | A1 | 4/2016 |
| WO | WO-2016061822 | A1 | 4/2016 |
| WO | WO-2016061859 | A1 | 4/2016 |
| WO | WO-2016062168 | A1 | 4/2016 |
| WO | WO-2016062777 | A1 | 4/2016 |
| WO | WO-2016063775 | A1 | 4/2016 |
| WO | WO-2016065520 | A1 | 5/2016 |
| WO | WO-2016065521 | A1 | 5/2016 |
| WO | WO-2016065532 | A1 | 5/2016 |
| WO | WO-2016065533 | A1 | 5/2016 |
| WO | WO-2016065596 | A1 | 5/2016 |
| WO | WO-2016065598 | A1 | 5/2016 |
| WO | WO-2016065599 | A1 | 5/2016 |
| WO | WO-2016065605 | A1 | 5/2016 |
| WO | WO-2016065606 | A1 | 5/2016 |
| WO | WO-2016065607 | A1 | 5/2016 |
| WO | WO-2016070553 | A1 | 5/2016 |
| WO | WO-2016071027 | A1 | 5/2016 |
| WO | WO-2016071705 | A1 | 5/2016 |
| WO | WO-2016071706 | A1 | 5/2016 |
| WO | WO-2016074228 | A1 | 5/2016 |
| WO | WO-2016074229 | A1 | 5/2016 |
| WO | WO-2016074230 | A1 | 5/2016 |
| WO | WO-2016074234 | A1 | 5/2016 |
| WO | WO-2016074237 | A1 | 5/2016 |
| WO | WO-2016076178 | A1 | 5/2016 |
| WO | WO-2016079001 | A1 | 5/2016 |
| WO | WO-2016079151 | A1 | 5/2016 |
| WO | WO-2016079152 | A1 | 5/2016 |
| WO | WO-2016079155 | A1 | 5/2016 |
| WO | WO-2016079468 | A1 | 5/2016 |
| WO | WO-2016079533 | A1 | 5/2016 |
| WO | WO-2016079729 | A1 | 5/2016 |
| WO | WO-2016058992 | A3 | 6/2016 |
| WO | WO-2016059003 | A3 | 6/2016 |
| WO | WO-2016082074 | A1 | 6/2016 |
| WO | WO-2016082103 | A1 | 6/2016 |
| WO | WO-2016082116 | A1 | 6/2016 |
| WO | WO-2016082136 | A1 | 6/2016 |
| WO | WO-2016082158 | A1 | 6/2016 |
| WO | WO-2016082179 | A1 | 6/2016 |
| WO | WO-2016082180 | A1 | 6/2016 |
| WO | WO-2016082183 | A1 | 6/2016 |
| WO | WO-2016082217 | A1 | 6/2016 |
| WO | WO-2016082232 | A1 | 6/2016 |
| WO | WO-2016082479 | A1 | 6/2016 |
| WO | WO-2016086382 | A1 | 6/2016 |
| WO | WO-2016090426 | A1 | 6/2016 |
| WO | WO-2016090531 | A1 | 6/2016 |
| WO | WO-2016090533 | A1 | 6/2016 |
| WO | WO-2016090593 | A1 | 6/2016 |
| WO | WO-2016090601 | A1 | 6/2016 |
| WO | WO-2016090602 | A1 | 6/2016 |
| WO | WO-2016090962 | A1 | 6/2016 |
| WO | WO-2016092259 | A1 | 6/2016 |
| WO | WO-2016095101 | A1 | 6/2016 |
| WO | WO-2016095206 | A1 | 6/2016 |
| WO | WO-2016095220 | A1 | 6/2016 |
| WO | WO-2016095234 | A1 | 6/2016 |
| WO | WO-2016095297 | A1 | 6/2016 |
| WO | WO-2016096337 | A1 | 6/2016 |
| WO | WO-2016096482 | A1 | 6/2016 |
| WO | WO-2016096497 | A1 | 6/2016 |
| WO | WO-2016096733 | A1 | 6/2016 |
| WO | WO-2016096762 | A1 | 6/2016 |
| WO | WO-2016099045 | A1 | 6/2016 |
| WO | WO-2016099276 | A1 | 6/2016 |
| WO | WO-2016101141 | A1 | 6/2016 |
| WO | WO-2016101142 | A1 | 6/2016 |
| WO | WO-2016101143 | A1 | 6/2016 |
| WO | WO-2016101144 | A1 | 6/2016 |
| WO | WO-2016101150 | A1 | 6/2016 |
| WO | WO-2016101183 | A1 | 6/2016 |
| WO | WO-2016101200 | A1 | 6/2016 |
| WO | WO-2016101202 | A1 | 6/2016 |
| WO | WO-2016101203 | A1 | 6/2016 |
| WO | WO-2016101248 | A1 | 6/2016 |
| WO | WO-2016103202 | A1 | 6/2016 |
| WO | WO-2016105191 | A1 | 6/2016 |
| WO | WO-2016036236 | A3 | 7/2016 |
| WO | WO-2016106476 | A1 | 7/2016 |
| WO | WO-2016106483 | A1 | 7/2016 |
| WO | WO-2016106493 | A1 | 7/2016 |
| WO | WO-2016106495 | A1 | 7/2016 |
| WO | WO-2016106499 | A1 | 7/2016 |
| WO | WO-2016106500 | A1 | 7/2016 |
| WO | WO-2016106512 | A1 | 7/2016 |
| WO | WO-2016108693 | A1 | 7/2016 |
| WO | WO-2016108694 | A1 | 7/2016 |
| WO | WO-2016109929 | A1 | 7/2016 |
| WO | WO-2016109930 | A1 | 7/2016 |
| WO | WO-2016109931 | A1 | 7/2016 |
| WO | WO-2016109932 | A1 | 7/2016 |
| WO | WO-2016109933 | A1 | 7/2016 |
| WO | WO-2016109942 | A1 | 7/2016 |
| WO | WO-2016109964 | A1 | 7/2016 |
| WO | WO-2016109965 | A1 | 7/2016 |
| WO | WO-2016110522 | A1 | 7/2016 |
| WO | WO-2016112491 | A1 | 7/2016 |
| WO | WO-2016112493 | A1 | 7/2016 |
| WO | WO-2016112533 | A1 | 7/2016 |
| WO | WO-2016112534 | A1 | 7/2016 |

(56) References Cited

FOREIGN PATENT DOCUMENTS

| | | | |
|---|---|---|---|
| WO | WO-2016112541 | A1 | 7/2016 |
| WO | WO-2016112542 | A1 | 7/2016 |
| WO | WO-2016112561 | A1 | 7/2016 |
| WO | WO-2016112579 | A1 | 7/2016 |
| WO | WO-2016115689 | A1 | 7/2016 |
| WO | WO-2016115691 | A1 | 7/2016 |
| WO | WO-2016115701 | A1 | 7/2016 |
| WO | WO-2016115715 | A1 | 7/2016 |
| WO | WO-2016116754 | A1 | 7/2016 |
| WO | WO-2016116755 | A1 | 7/2016 |
| WO | WO-2016118005 | A1 | 7/2016 |
| WO | WO-2016119098 | A1 | 8/2016 |
| WO | WO-2016119099 | A1 | 8/2016 |
| WO | WO-2016119101 | A1 | 8/2016 |
| WO | WO-2016119119 | A1 | 8/2016 |
| WO | WO-2016119121 | A1 | 8/2016 |
| WO | WO-2016119144 | A1 | 8/2016 |
| WO | WO-2016119145 | A1 | 8/2016 |
| WO | WO-2016119163 | A1 | 8/2016 |
| WO | WO-2016119167 | A1 | 8/2016 |
| WO | WO-2016119170 | A1 | 8/2016 |
| WO | WO-2016119225 | A1 | 8/2016 |
| WO | WO-2016119248 | A1 | 8/2016 |
| WO | WO-2016119273 | A1 | 8/2016 |
| WO | WO-2016119496 | A1 | 8/2016 |
| WO | WO-2016122417 | A1 | 8/2016 |
| WO | WO-2016123763 | A1 | 8/2016 |
| WO | WO-2016123764 | A1 | 8/2016 |
| WO | WO-2016123770 | A1 | 8/2016 |
| WO | WO-2016123779 | A1 | 8/2016 |
| WO | WO-2016123780 | A1 | 8/2016 |
| WO | WO-2016123781 | A1 | 8/2016 |
| WO | WO-2016124017 | A1 | 8/2016 |
| WO | WO-2016124019 | A1 | 8/2016 |
| WO | WO-2016124695 | A1 | 8/2016 |
| WO | WO-2016124740 | A1 | 8/2016 |
| WO | WO-2016124741 | A1 | 8/2016 |
| WO | WO-2016127287 | A1 | 8/2016 |
| WO | WO-2016127293 | A1 | 8/2016 |
| WO | WO-2016127327 | A1 | 8/2016 |
| WO | WO-2016127360 | A1 | 8/2016 |
| WO | WO-2016127361 | A1 | 8/2016 |
| WO | WO-2016127389 | A1 | 8/2016 |
| WO | WO-2016127390 | A1 | 8/2016 |
| WO | WO-2016127396 | A1 | 8/2016 |
| WO | WO-2016127397 | A1 | 8/2016 |
| WO | WO-2016127401 | A1 | 8/2016 |
| WO | WO-2016127406 | A1 | 8/2016 |
| WO | WO-2016127468 | A1 | 8/2016 |
| WO | WO-2016127839 | A1 | 8/2016 |
| WO | WO-2016128562 | A1 | 8/2016 |
| WO | WO-2016131755 | A1 | 8/2016 |
| WO | WO-2016132026 | A1 | 8/2016 |
| WO | WO-2016134544 | A1 | 9/2016 |
| WO | WO-2016135503 | A1 | 9/2016 |
| WO | WO-2016138608 | A1 | 9/2016 |
| WO | WO-2016138665 | A1 | 9/2016 |
| WO | WO-2016138689 | A1 | 9/2016 |
| WO | WO-2016141508 | A1 | 9/2016 |
| WO | WO-2016141555 | A1 | 9/2016 |
| WO | WO-2016141556 | A1 | 9/2016 |
| WO | WO-2016141581 | A1 | 9/2016 |
| WO | WO-2016141592 | A1 | 9/2016 |
| WO | WO-2016141593 | A1 | 9/2016 |
| WO | WO-2016145611 | A1 | 9/2016 |
| WO | WO-2016145612 | A1 | 9/2016 |
| WO | WO-2016145613 | A1 | 9/2016 |
| WO | WO-2016145634 | A1 | 9/2016 |
| WO | WO-2016145656 | A1 | 9/2016 |
| WO | WO-2016145663 | A1 | 9/2016 |
| WO | WO-2016149896 | A1 | 9/2016 |
| WO | WO-2016149932 | A1 | 9/2016 |
| WO | WO-2016149942 | A1 | 9/2016 |
| WO | WO-2016150019 | A1 | 9/2016 |
| WO | WO-2016150979 | A1 | 9/2016 |
| WO | WO-2016154792 | A1 | 10/2016 |
| WO | WO-2016154797 | A1 | 10/2016 |
| WO | WO-2016154798 | A1 | 10/2016 |
| WO | WO-2016154815 | A1 | 10/2016 |
| WO | WO-2016154895 | A1 | 10/2016 |
| WO | WO-2016154896 | A1 | 10/2016 |
| WO | WO-2016154897 | A1 | 10/2016 |
| WO | WO-2016154900 | A1 | 10/2016 |
| WO | WO-2016154994 | A1 | 10/2016 |
| WO | WO-2016155003 | A1 | 10/2016 |
| WO | WO-2016155103 | A1 | 10/2016 |
| WO | WO-2016155104 | A1 | 10/2016 |
| WO | WO-2016155105 | A1 | 10/2016 |
| WO | WO-2016155316 | A1 | 10/2016 |
| WO | WO-2016156103 | A1 | 10/2016 |
| WO | WO-2016156217 | A1 | 10/2016 |
| WO | WO-2016156413 | A1 | 10/2016 |
| WO | WO-2016161554 | A1 | 10/2016 |
| WO | WO-2016161673 | A1 | 10/2016 |
| WO | WO-2016162446 | A1 | 10/2016 |
| WO | WO-2016162492 | A1 | 10/2016 |
| WO | WO-2016165055 | A1 | 10/2016 |
| WO | WO-2016165057 | A1 | 10/2016 |
| WO | WO-2016165063 | A1 | 10/2016 |
| WO | WO-2016165125 | A1 | 10/2016 |
| WO | WO-2016166049 | A1 | 10/2016 |
| WO | WO-2016166456 | A1 | 10/2016 |
| WO | WO-2016166661 | A1 | 10/2016 |
| WO | WO-2016166670 | A1 | 10/2016 |
| WO | WO-2016168986 | A1 | 10/2016 |
| WO | WO-2016169019 | A1 | 10/2016 |
| WO | WO-2016169052 | A1 | 10/2016 |
| WO | WO-2016169063 | A1 | 10/2016 |
| WO | WO-2016169669 | A1 | 10/2016 |
| WO | WO-2016169796 | A1 | 10/2016 |
| WO | WO-2016169797 | A1 | 10/2016 |
| WO | WO-2016172802 | A1 | 11/2016 |
| WO | WO-2016172821 | A1 | 11/2016 |
| WO | WO-2016172843 | A1 | 11/2016 |
| WO | WO-2016172847 | A1 | 11/2016 |
| WO | WO-2016172867 | A1 | 11/2016 |
| WO | WO-2016172898 | A1 | 11/2016 |
| WO | WO-2016172907 | A1 | 11/2016 |
| WO | WO-2016172908 | A1 | 11/2016 |
| WO | WO-2016172909 | A1 | 11/2016 |
| WO | WO-2016172954 | A1 | 11/2016 |
| WO | WO-2016174179 | A1 | 11/2016 |
| WO | WO-2016176800 | A1 | 11/2016 |
| WO | WO-2016177604 | A1 | 11/2016 |
| WO | WO-2016179356 | A1 | 11/2016 |
| WO | WO-2016179664 | A1 | 11/2016 |
| WO | WO-2016179776 | A1 | 11/2016 |
| WO | WO-2016179828 | A1 | 11/2016 |
| WO | WO-2016183724 | A1 | 11/2016 |
| WO | WO-2016184247 | A1 | 11/2016 |
| WO | WO-2016184824 | A1 | 11/2016 |
| WO | WO-2016171997 | A3 | 12/2016 |
| WO | WO-2016187803 | A1 | 12/2016 |
| WO | WO-2016187943 | A1 | 12/2016 |
| WO | WO-2016188140 | A1 | 12/2016 |
| WO | WO-2016188141 | A1 | 12/2016 |
| WO | WO-2016188142 | A1 | 12/2016 |
| WO | WO-2016188967 | A1 | 12/2016 |
| WO | WO-2016189086 | A1 | 12/2016 |
| WO | WO-2016191946 | A1 | 12/2016 |
| WO | WO-2016193336 | A1 | 12/2016 |
| WO | WO-2016193365 | A1 | 12/2016 |
| WO | WO-2016193743 | A1 | 12/2016 |
| WO | WO-2016197485 | A1 | 12/2016 |
| WO | WO-2016197658 | A1 | 12/2016 |
| WO | WO-2016198417 | A1 | 12/2016 |
| WO | WO-2016198459 | A1 | 12/2016 |
| WO | WO-2016198879 | A1 | 12/2016 |
| WO | WO-2016199062 | A1 | 12/2016 |
| WO | WO-2016199065 | A1 | 12/2016 |
| WO | WO-2016199066 | A1 | 12/2016 |
| WO | WO-2016200252 | A1 | 12/2016 |
| WO | WO-2016200253 | A1 | 12/2016 |
| WO | WO-2016200255 | A1 | 12/2016 |

(56) References Cited

FOREIGN PATENT DOCUMENTS

| | | | |
|---|---|---|---|
| WO | WO-2016200259 | A1 | 12/2016 |
| WO | WO-2016200382 | A1 | 12/2016 |
| WO | WO-2016201602 | A1 | 12/2016 |
| WO | WO-2016201606 | A1 | 12/2016 |
| WO | WO-2016201911 | A1 | 12/2016 |
| WO | WO-2016202028 | A1 | 12/2016 |
| WO | WO-2016202033 | A1 | 12/2016 |
| WO | WO-2016202301 | A1 | 12/2016 |
| WO | WO-2016202302 | A1 | 12/2016 |
| WO | WO-2016202303 | A1 | 12/2016 |
| WO | WO-2016202304 | A1 | 12/2016 |
| WO | WO-2016207357 | A1 | 12/2016 |
| WO | WO-2016208757 | A1 | 12/2016 |
| WO | WO-2016208760 | A1 | 12/2016 |
| WO | WO-2016193705 | A3 | 1/2017 |
| WO | WO-2017000239 | A1 | 1/2017 |
| WO | WO-2017001270 | A1 | 1/2017 |
| WO | WO-2017001817 | A1 | 1/2017 |
| WO | WO-2017001818 | A1 | 1/2017 |
| WO | WO-2017001819 | A1 | 1/2017 |
| WO | WO-2017001820 | A1 | 1/2017 |
| WO | WO-2017005835 | A1 | 1/2017 |
| WO | WO-2017007252 | A1 | 1/2017 |
| WO | WO-2017008616 | A1 | 1/2017 |
| WO | WO-2017009002 | A1 | 1/2017 |
| WO | WO-2017011419 | A1 | 1/2017 |
| WO | WO-2017012099 | A1 | 1/2017 |
| WO | WO-2017012105 | A1 | 1/2017 |
| WO | WO-2017012257 | A1 | 1/2017 |
| WO | WO-2017012335 | A1 | 1/2017 |
| WO | WO-2016172921 | A8 | 2/2017 |
| WO | WO-2016178098 | A3 | 2/2017 |
| WO | WO-2017015791 | A1 | 2/2017 |
| WO | WO-2017015794 | A1 | 2/2017 |
| WO | WO-2017015832 | A1 | 2/2017 |
| WO | WO-2017015859 | A1 | 2/2017 |
| WO | WO-2017016323 | A1 | 2/2017 |
| WO | WO-2017017970 | A1 | 2/2017 |
| WO | WO-2017020220 | A1 | 2/2017 |
| WO | WO-2017020221 | A1 | 2/2017 |
| WO | WO-2017020275 | A1 | 2/2017 |
| WO | WO-2017020290 | A1 | 2/2017 |
| WO | WO-2017023589 | A1 | 2/2017 |
| WO | WO-2017024477 | A1 | 2/2017 |
| WO | WO-2017024478 | A1 | 2/2017 |
| WO | WO-2017024799 | A1 | 2/2017 |
| WO | WO-2017024926 | A1 | 2/2017 |
| WO | WO-2017025383 | A1 | 2/2017 |
| WO | WO-2017028167 | A1 | 2/2017 |
| WO | WO-2017028295 | A1 | 2/2017 |
| WO | WO-2017029268 | A1 | 2/2017 |
| WO | WO-2017029269 | A1 | 2/2017 |
| WO | WO-2017029270 | A1 | 2/2017 |
| WO | WO-2017021536 | A3 | 3/2017 |
| WO | WO-2017031662 | A1 | 3/2017 |
| WO | WO-2017031678 | A1 | 3/2017 |
| WO | WO-2017031681 | A1 | 3/2017 |
| WO | WO-2017033007 | A1 | 3/2017 |
| WO | WO-2017033021 | A1 | 3/2017 |
| WO | WO-2017033132 | A1 | 3/2017 |
| WO | WO-2017035720 | A1 | 3/2017 |
| WO | WO-2017036818 | A1 | 3/2017 |
| WO | WO-2017036819 | A1 | 3/2017 |
| WO | WO-2017036828 | A1 | 3/2017 |
| WO | WO-2017036829 | A1 | 3/2017 |
| WO | WO-2017036865 | A1 | 3/2017 |
| WO | WO-2017036879 | A1 | 3/2017 |
| WO | WO-2017041251 | A1 | 3/2017 |
| WO | WO-2017042081 | A1 | 3/2017 |
| WO | WO-2017045132 | A1 | 3/2017 |
| WO | WO-2017045897 | A1 | 3/2017 |
| WO | WO-2017045898 | A1 | 3/2017 |
| WO | WO-2017045899 | A1 | 3/2017 |
| WO | WO-2017046247 | A1 | 3/2017 |
| WO | WO-2017046334 | A1 | 3/2017 |
| WO | WO-2017046363 | A1 | 3/2017 |
| WO | WO-2017046566 | A1 | 3/2017 |
| WO | WO-2017049653 | A1 | 3/2017 |
| WO | WO-2017049654 | A1 | 3/2017 |
| WO | WO-2017051150 | A1 | 3/2017 |
| WO | WO-2017051174 | A1 | 3/2017 |
| WO | WO-2017051348 | A1 | 3/2017 |
| WO | WO-2017051349 | A1 | 3/2017 |
| WO | WO-2017046593 | A3 | 4/2017 |
| WO | WO-2017054424 | A1 | 4/2017 |
| WO | WO-2017054627 | A1 | 4/2017 |
| WO | WO-2017054634 | A1 | 4/2017 |
| WO | WO-2017055564 | A1 | 4/2017 |
| WO | WO-2017055584 | A1 | 4/2017 |
| WO | WO-2017055793 | A1 | 4/2017 |
| WO | WO-2017055795 | A1 | 4/2017 |
| WO | WO-2017055799 | A1 | 4/2017 |
| WO | WO-2017055801 | A1 | 4/2017 |
| WO | WO-2017055802 | A1 | 4/2017 |
| WO | WO-2017055803 | A1 | 4/2017 |
| WO | WO-2017055866 | A1 | 4/2017 |
| WO | WO-2017056103 | A1 | 4/2017 |
| WO | WO-2017057286 | A1 | 4/2017 |
| WO | WO-2017059571 | A1 | 4/2017 |
| WO | WO-2017060279 | A1 | 4/2017 |
| WO | WO-2017063256 | A1 | 4/2017 |
| WO | WO-2017063535 | A1 | 4/2017 |
| WO | WO-2017064051 | A1 | 4/2017 |
| WO | WO-2017064322 | A1 | 4/2017 |
| WO | WO-2017064323 | A1 | 4/2017 |
| WO | WO-2017064324 | A1 | 4/2017 |
| WO | WO-2017064487 | A1 | 4/2017 |
| WO | WO-2017066938 | A1 | 4/2017 |
| WO | WO-2017066955 | A1 | 4/2017 |
| WO | WO-2017067066 | A1 | 4/2017 |
| WO | WO-2017067326 | A1 | 4/2017 |
| WO | WO-2017068098 | A1 | 4/2017 |
| WO | WO-2017068099 | A1 | 4/2017 |
| WO | WO-2017068100 | A1 | 4/2017 |
| WO | WO-2016096745 | A9 | 5/2017 |
| WO | WO-2016173568 | A3 | 5/2017 |
| WO | WO-2016198026 | A3 | 5/2017 |
| WO | WO-2017051350 | A3 | 5/2017 |
| WO | WO-2017070871 | A1 | 5/2017 |
| WO | WO-2017071297 | A1 | 5/2017 |
| WO | WO-2017071298 | A1 | 5/2017 |
| WO | WO-2017072239 | A1 | 5/2017 |
| WO | WO-2017072277 | A1 | 5/2017 |
| WO | WO-2017072284 | A1 | 5/2017 |
| WO | WO-2017075753 | A1 | 5/2017 |
| WO | WO-2017075759 | A1 | 5/2017 |
| WO | WO-2017075827 | A1 | 5/2017 |
| WO | WO-2017075883 | A1 | 5/2017 |
| WO | WO-2017075975 | A1 | 5/2017 |
| WO | WO-2017076247 | A1 | 5/2017 |
| WO | WO-2017076590 | A1 | 5/2017 |
| WO | WO-2017081480 | A1 | 5/2017 |
| WO | WO-2017082728 | A1 | 5/2017 |
| WO | WO-2017084107 | A1 | 5/2017 |
| WO | WO-2017084488 | A1 | 5/2017 |
| WO | WO-2017084489 | A1 | 5/2017 |
| WO | WO-2017084818 | A1 | 5/2017 |
| WO | WO-2017084848 | A1 | 5/2017 |
| WO | WO-2017084849 | A1 | 5/2017 |
| WO | WO-2017084920 | A2 | 5/2017 |
| WO | WO-2017085240 | A1 | 5/2017 |
| WO | WO-2017085242 | A1 | 5/2017 |
| WO | WO-2017081176 | A3 | 6/2017 |
| WO | WO-2017088660 | A1 | 6/2017 |
| WO | WO-2017089931 | A1 | 6/2017 |
| WO | WO-2017091926 | A1 | 6/2017 |
| WO | WO-2017092144 | A1 | 6/2017 |
| WO | WO-2017093452 | A1 | 6/2017 |
| WO | WO-2017093535 | A1 | 6/2017 |
| WO | WO-2017096512 | A1 | 6/2017 |
| WO | WO-2017096971 | A1 | 6/2017 |
| WO | WO-2017096988 | A1 | 6/2017 |
| WO | WO-2017097172 | A1 | 6/2017 |
| WO | WO-2017097173 | A1 | 6/2017 |

(56) References Cited

FOREIGN PATENT DOCUMENTS

| | | | |
|---|---|---|---|
| WO | WO-2017097821 | A1 | 6/2017 |
| WO | WO-2017101030 | A1 | 6/2017 |
| WO | WO-2017101058 | A1 | 6/2017 |
| WO | WO-2017101705 | A1 | 6/2017 |
| WO | WO-2017102633 | A1 | 6/2017 |
| WO | WO-2017102686 | A1 | 6/2017 |
| WO | WO-2017102969 | A1 | 6/2017 |
| WO | WO-2017107546 | A1 | 6/2017 |
| WO | WO-2017108268 | A1 | 6/2017 |
| WO | WO-2017108392 | A1 | 6/2017 |
| WO | WO-2017108394 | A1 | 6/2017 |
| WO | WO-2017108429 | A1 | 6/2017 |
| WO | WO-2017109448 | A2 | 6/2017 |
| WO | WO-2017109868 | A1 | 6/2017 |
| WO | WO-2017110713 | A1 | 6/2017 |
| WO | WO-2017036426 | A3 | 7/2017 |
| WO | WO-2017113106 | A1 | 7/2017 |
| WO | WO-2017113513 | A1 | 7/2017 |
| WO | WO-2017113845 | A1 | 7/2017 |
| WO | WO-2017114389 | A1 | 7/2017 |
| WO | WO-2017117725 | A1 | 7/2017 |
| WO | WO-2017117742 | A1 | 7/2017 |
| WO | WO-2017118135 | A1 | 7/2017 |
| WO | WO-2017118138 | A1 | 7/2017 |
| WO | WO-2017118347 | A1 | 7/2017 |
| WO | WO-2017121156 | A1 | 7/2017 |
| WO | WO-2017121253 | A1 | 7/2017 |
| WO | WO-2017121296 | A1 | 7/2017 |
| WO | WO-2017121546 | A1 | 7/2017 |
| WO | WO-2017121979 | A1 | 7/2017 |
| WO | WO-2017122196 | A1 | 7/2017 |
| WO | WO-2017124419 | A1 | 7/2017 |
| WO | WO-2017124662 | A1 | 7/2017 |
| WO | WO-2017124957 | A1 | 7/2017 |
| WO | WO-2017128038 | A1 | 8/2017 |
| WO | WO-2017133056 | A1 | 8/2017 |
| WO | WO-2017137138 | A1 | 8/2017 |
| WO | WO-2017137554 | A1 | 8/2017 |
| WO | WO-2017139963 | A1 | 8/2017 |
| WO | WO-2017141017 | A1 | 8/2017 |
| WO | WO-2017141018 | A1 | 8/2017 |
| WO | WO-2017141358 | A1 | 8/2017 |
| WO | WO-2017143494 | A1 | 8/2017 |
| WO | WO-2017143495 | A1 | 8/2017 |
| WO | WO-2017143515 | A1 | 8/2017 |
| WO | WO-2017143865 | A1 | 8/2017 |
| WO | WO-2017143953 | A1 | 8/2017 |
| WO | WO-2017144400 | A1 | 8/2017 |
| WO | WO-2017144861 | A1 | 8/2017 |
| WO | WO-2017149288 | A1 | 9/2017 |
| WO | WO-2017152481 | A1 | 9/2017 |
| WO | WO-2017153051 | A1 | 9/2017 |
| WO | WO-2017153270 | A1 | 9/2017 |
| WO | WO-2017156694 | A1 | 9/2017 |
| WO | WO-2017156695 | A1 | 9/2017 |
| WO | WO-2017156696 | A1 | 9/2017 |
| WO | WO-2017156733 | A1 | 9/2017 |
| WO | WO-2017156743 | A1 | 9/2017 |
| WO | WO-2017161715 | A1 | 9/2017 |
| WO | WO-2017161725 | A1 | 9/2017 |
| WO | WO-2017163044 | A1 | 9/2017 |
| WO | WO-2017163045 | A1 | 9/2017 |
| WO | WO-2017163046 | A1 | 9/2017 |
| WO | WO-2017163047 | A1 | 9/2017 |
| WO | WO-2017163050 | A1 | 9/2017 |
| WO | WO-2017163051 | A1 | 9/2017 |
| WO | WO-2017163052 | A1 | 9/2017 |
| WO | WO-2017164474 | A1 | 9/2017 |
| WO | WO-2017166263 | A1 | 10/2017 |
| WO | WO-2017166334 | A1 | 10/2017 |
| WO | WO-2017167169 | A1 | 10/2017 |
| WO | WO-2017167513 | A1 | 10/2017 |
| WO | WO-2017173669 | A1 | 10/2017 |
| WO | WO-2017173947 | A1 | 10/2017 |
| WO | WO-2017173951 | A1 | 10/2017 |
| WO | WO-2017174754 | A1 | 10/2017 |
| WO | WO-2017175166 | A1 | 10/2017 |
| WO | WO-2017176111 | A1 | 10/2017 |
| WO | WO-2017176113 | A1 | 10/2017 |
| WO | WO-2017177897 | A1 | 10/2017 |

OTHER PUBLICATIONS

"Guideline Accompanying Commission Regulation (EC) No. 1275/2008,"Official Journal of the European Union, Oct. 2009.

"Lighter." Merriam-Webster Online Dictionary. 2009. Merriam-Webster Online. Jun. 8, 2009 [http://www.merriam-webster.com/dictionary/lighter]. cited byapplicant.

AMB. Manual:TranX160/Rev.10-06. published 2004-2006.

Baker et al., "The pyrolysis of tobacco ingredients,"J. Anal. Appl. Pyrolysis, vol. 71, pp. 223-311 (2004).

Bombick, et al. Chemical and biological studies of a new cigarette that primarily heats tobacco. Part 2. In vitro toxicology of mainstream smoke condensate. Food and Chemical Toxicology. 1997; 36:183-190.

Bombick, et al. Chemical and biological studies of a new cigarette that primarily heats tobacco. Part 3. In vitro toxicity of whole smoke. Food and Chemical Toxicology. 1998; 36:191-197.

Borgerding, et al. Chemical and biological studies of a new cigarette that primarily heats tobacco. Part 1. Chemical composition of mainstream smoke. Food and Chemical Toxicology; 1997; 36:169-182.

Breland, Alison, et al. "Electronic cigarettes: what are they and what do they do?." Annals of the New York Academy of Sciences 1394.1 (2017): 5-30.

Brown, Christopher J., and James M. Cheng. "Electronic cigarettes: product characterisation and design considerations."Tobacco control 23.suppl 2 (2014): ii4-ii10.

Bullen, et al., "Effect of an electronic nicotine delivery device (e cigarette) on desire to smoke and withdrawal, user preferences and nicotine delivery: randomized cross-over trial,"Tobacco Control, 19(2), pp. 98-103. Apr. 2010.

Burch, et al., "Effect of pH on nicotine absorption and side effects produced by areosolized nicotine,"Journal of Aerosol Medicine: Deposition, Clearance, and Effects in the Lung, 6(1), pp. 45-52. 1993.

Capponnetto, et al., "Successful smoking cessation with cigarettes in smokers with a documented history of recurring relapses: a case series,"Journal of Medical Case Reports; 5(1), 6 pages. 2011.

Davis & Nielsen, "Marketing, Processing and Storage: Green Leaf Threshing and Redrying Tobacco,"Tobacco Production, Chemistry and Technology, (1999) Section 10B, pp. 330-333, Bill Ward, Expert Leaf Tobacco Company, Wilson, North Carolina, USA.

E-Cigarette Forum; pg-gv-peg (discussion/posting); retrieved from the Internet: https://e-cigarette-forum.com/forum/threads/pg-vg-peg.177551; 7 pgs.; Apr. 8, 2011.

ECF; Any interest in determining nicotine—by Dvap; (https://www.e-cigarette-forum.com/forum/threads/any-interest-in-determin—ing-nicotine-by-dvap.35922/); blog posts dated: 2009; 8 pgs.; print/retrieval date: Jul. 31, 2014.

Electronic Vaporization Device with Cartridge|JUUL Pod |JUUL Vapor, Posted Jun. 3, 2015, © 2015, Juulvapor.com, retrieved Nov. 24, 2015, https://www.juulvapor.com/shopjuul/.

Electronic Vaporization Device/ Gizmodo Pax 2 Vaporizer/ Gizmodo; retrieved from http://gizmodo.com/pax-2-vaporizer-reviews-its-like-smoking-in-the-future-1718310779; posted Jul. 23, 2015, retrieved Oct. 17, 2016.

Farsalinos, et al., "Electronic cigarettes do not damage the heart,"European Society of Cardiology, 4 pages, (http://www.escardio.org/The-ESC/Press-Office/Press-releases/Electronic-cigarettes-do-not-damage-the-heart). Aug. 25, 2012.

Farsalinos, Konstantinos E., et al. "Protocol proposal for, and evaluation of, consistency in nicotine delivery from the liquid to the aerosol of electronic cigarettes atomizers: regulatory implications. "Addiction 111.6 (2016): 1069-1076.

(56) References Cited

OTHER PUBLICATIONS

FC Vaporizer Review Forum; Pax Vaporizer by Ploom; retrieved from : http://fuckcombustion.com/threads/pax-vaporizer-by-ploom.6223/; pgs. 2 & 11 (2 pgs.); retrieval date: Nov. 16, 2015.
Flouris, et al., "Acute impact of active and passive electronic cigarette smoking on serum cotinine and lung function,"Inhal. Toxicol., 25(2), pp. 91-101. Feb. 2013.
Food & Drug Administration; Warning letter to the Compounding Pharmacy, retrieved Oct. 10, 2014 from http://www.fda.gov/ICECl/EnforcementActions/WarningLetters/2002/ucm144843.htm, 3 pages. Apr. 9, 2002.
Goniewicz, et al., "Nicotine levels in electronic cigarettes,"Nicotine Tobacco Research, 15(1), pp. 158-166, Jan. 2013.
Gregory, Andrew, "E-cigarettes to go on prescription under move to class them as medicines,"Mirror, Jun. 12, 2013. http://www.mirror.co.uk/news/uk-news/e-cigarettes-go-prescription-under-move-1949018.
Grotenhermen, et al., Developing science-based per se limits for driving under the influence of cannabis (DUIC): findings and recommendations by an expert panel; retreived Feb. 9, 2017 from (http://www.canorml.org/healthfacts/DUICreport.2005.pdf); Sep. 2005.
Harvest Vapor, American Blend Tobacco (product info), retrieved from the internet (http://harvestvapor.com/), 2 pages. Oct. 10, 2014.
Hurt, et al., "Treating tobacco dependence in a medical setting,"CA: A Cancer Journal for Clinicians, 59(5), pp. 314-326. Sep. 2009.
INCHEM; Benzoic Acid; JECFA Evaluation Summary; retrieved Oct. 10, 2014 from http://www.inchem.org/documents/jecfa/feceval/jec_184.htm, 2 pages. May 28, 2005.
INCHEM; Levulinic Acid; JECFA Evaluation Summary; retrieved Oct. 10, 2014 from http://www.inchem.org/documents/jecfa/feceval/jec _1266.htm, 2 pages. Mar. 10, 2003.
INCHEM; Pyruvic Acid; JECFA Evaluation Summary; retrieved Oct. 10, 2014 from http://www.inchem.org/documents/jecfa/feceval/jec_2072.htm, 2 pages. Jan. 29, 2003.
INCHEM; Sorbic Acid; JECFA Evaluation Summary; retrieved Oct. 10, 2014 from http://www.inchem.org/documents/jecfa/feceval/jec_2181.htm, 2 pages. May 29, 2005.
lngebrethsen et al., "Electronic Cigarette aerosol particle size distribution measurements", Inhalation Toxicology, 2012; 24 (14): 976-984.
Kuo et al. Applications of Turbulent and Multiphase Combustion, Appendix D: Particle Size—U.S. Sieve Size and Tyler Screen Mesh Equivalents, 2012, p. 541-543.
McCann et al., "Detection of carcinogens as mutagens in the Salmonella/microsome test: Assay of 300 chemicals: discussion. "Proct. Nat. Acad. Sci, USA, Mar. 1976, vol. 73 (3), 950-954.
MYLAPS, "Rechargeable Transponder Battery Status and Charging Instructions,"Sep. 9, 2010.
Nicoli et al., Mammalian tumor xenografts induce neovascularization in Zebrafish embryos. Cancer Research, 67:2927-2931 (2007).
PAX Labs, Inc.; Juul product information ©2016; retrieved from https://www.juulvapor.com/shop-juul;6pgs.; retrieved Mar. 9, 2016.
Perfetti, "Structural study of nicotine salts,"Beitrage Zur Tabakforschung International, Contributions to Tobacco Research, 12(2), pp. 43-54. Jun. 1983.
Poynton, Simon, et al. "A novel hybrid tobacco product that delivers a tobacco flavour note with vapour aerosol (part 1): Product operation and preliminary aerosol chemistry assessment."Food and Chemical Toxicology (2017).
Seeman, et al., "The form of nicotine in tobacco. Thermal transfer of nicotine and nicotine acid salts to nicotine in the gas phase,"J Aric Food Chem, 47(12), pp. 5133-5145. Dec. 1999.
SRNT Subcommittee on Biochemical Verification, "Biochemical verification of tobacco use and cessation,"Nicotine & Tobacco Research 4, pp. 149-159, 2002.
Torikai et al., "Effects of temperature, atmosphere and pH on the generation of smoke compounds during tobacco pyrolysis,"Food and Chemical Toxicology 42 (2004) 1409-1417.
Vansickel, et al. "A clinical laboratory model for evaluating the acute effects of electronic cigarettes: Nicotine delivery profile and cardiovascular and subjective effects,"Cancer Epidemiology Biomarkers Prevention, 19(9), pp. 1945-1953. Jul. 20, 2010.
Vansickel, et al., "Electronic cigarettes: effective nicotine delivery after acute administration,"Nicotine & Tobacco Research, 15(1), pp. 267-270. Jan. 2013.
VapeWorld; Original PAX Vaporizers for Portable and Home Use; retrieved from: https://www.vapeworld.com/pax-vaporizer-by-ploom?gclid=CPCi1PKojskCFU06gQodPr; 9 pgs.; retrieved Nov. 13, 2015.
Wells. "Glycerin as a Constituent of Cosmetics and Toilet Preparations. "Journal of Society of Cosmetic Chemists, 1958; 9(1): 19-25.
Williams, Monique, and Prue Talbot. "Variability among electronic cigarettes in the pressure drop, airflow rate, and aerosol production. "Nicotine & Tobacco Research 13.12 (2011).
YouTube; Firefly Vaporizor Review w/ Usage Tips by the Vape Critic; retrieved from the internet (http://www.youtube.com/watch?v=1J38N0AV7w1); published Dec. 10, 2013; download/ print date: Feb. 18, 2015.
Youtube; Pax by Ploom Vaporizer Review; posted Aug. 14, 2013, retrieved Sep. 8, 2016, https://www.youtube.com/watch?v=Jm06zW3-cxQ.
Zhang, et al., "In vitro partical size distributions in electronic and conventional cigarette aerosols suggest comparable deposition patterns,"Nicotine Tobacci Research, 15(2), pp. 501508. Feb. 2013.

* cited by examiner

FIG. 5A
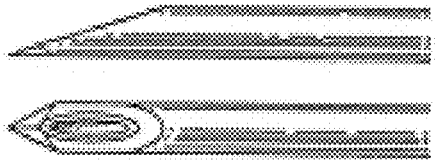
Quincke
FIG. 5B
FIG. 6A
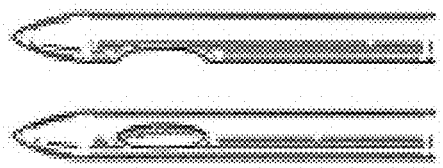
Sprotte
FIG. 6B
FIG. 7A
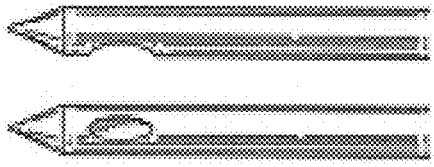
Whitacre
FIG. 7B

FILLABLE VAPORIZER CARTRIDGE AND METHOD OF FILLING

CROSS REFERENCE TO RELATED APPLICATIONS

This application claims priority to U.S. provisional application No. 62/294,285, titled "FILLABLE ELECTRONIC CIGARETTE CARTRIDGE AND METHOD OF FILLING," filed on Feb. 11, 2016 which is herein incorporated by reference in its entirety.

This application may be related to or may be used with the inventions in one or more of the following patent applications: U.S. patent application Ser. No. 14/578,193, filed on Dec. 19, 2014 and titled "METHOD AND SYSTEM FOR VAPORIZATION OF A SUBSTANCE"; U.S. patent application Ser. No. 14/625,042, filed on Feb. 18, 2015, and titled "AEROSOL DEVICES AND METHODS FOR INHALING A SUBSTANCE AND USES THEREOF"; U.S. patent application Ser. No. 13/837,438, filed on Mar. 15, 2013, and titled "LOW TEMPERATURE ELECTRONIC VAPORIZATION DEVICE AND METHODS"; U.S. patent application Ser. No. 14/271,071, filed on May 6, 2014, and titled "NICOTINE SALT FORMULATIONS FOR AEROSOL DEVICES AND METHODS THEREOF"; U.S. patent application Ser. No. 14/304,847, filed on Jun. 13, 2014, and titled "MULTIPLE HEATING ELEMENTS WITH SEPARATE VAPORIZABLE MATERIALS IN AN ELECTRIC VAPORIZATION DEVICE"; U.S. patent application Ser. No. 14/461,284, filed on Aug. 15, 2014 and titled "METHODS AND DEVICES FOR DELIVERING AND MONITORING OF TOBACCO, NICOTINE, OR OTHER SUBSTANCES"; U.S. patent application Ser. No. 14/581,666, filed on Dec. 23, 2014, and titled "VAPORIZATION DEVICE SYSTEMS AND METHODS"; PCT Patent Application No. PCT/US2015/031152, filed on May 15, 2015, and titled "SYSTEMS AND METHODS FOR AEROSOLIZING A SMOKABLE MATERIAL"; PCT Patent Application No. PCT/US2014/064690, filed on Nov. 7, 2014, and titled "NICOTINE LIQUID FORMULATIONS FOR AEROSOL DEVICES AND METHODS THEREOF"; U.S. patent application Ser. No. 14/960,259, filed on Dec. 4, 2015, and titled "CALIBRATED DOSE CONTROL". Each of these applications is herein incorporated by reference in their entirety.

INCORPORATION BY REFERENCE

All publications and patent applications mentioned in this specification are herein incorporated by reference in their entirety to the same extent as if each individual publication or patent application was specifically and individually indicated to be incorporated by reference.

FIELD

This invention relates to electronic cigarette cartridges, and in particular to cartridges and methods of filling of electronic cartridges.

BACKGROUND

Electronic cigarettes and cartridges that contain their vaporizable liquid in a "tank" structure or reservoir have performance and usability advantages over those which hold the liquid inside of a sponge or other medium. Unfortunately, tank-type cigarettes and cartridges have some unique difficulties associated with filling them. These problems are particularly acute because of the need for a porous wick that is in contact with the tank in the cartridge and/or electronic cigarette.

For example, tank-type cartridges may leak when subjected to a change in atmospheric pressure (such as may occur during air shipment), which can cause liquid to leak through the necessary porous wick, due to expansion of any captive air. If the cartridge could be filled completely with no captive air, this issue can be eliminated, at least at the time of initial shipment. As a result there is significant incentive to attempt to fill the cartridge as completely as possible.

There are currently two main approaches to filling a tank-type cartridge. The first approach is to make use of one or more elastomeric "plug" components that are removed and leave sufficient clearance at the time of filling that any air that is captured in the cartridge is able to freely vent through the same hole or holes that liquid is being added to. A secondary operation is required to install the plug, along with in many cases an additional cosmetic part that conceals the plug.

Unfortunately, the approach of filling with a plug part removed has a few problems. First, it requires that the cartridge be partially disassembled at the time of filling. This can result in supply chain complexity of shipping components separately as well as additional costs associated with the additional capping operation, especially if the cartridges are assembled in different locations as is often the case where it may be cheaper to manufacture in a first location and assemble in a second location. Second, a plug may potentially take up volume in the cartridge, and finally, inserting the cap my itself displace fluid and introduce air; inserting the plug may force the displaced volume of liquid through the porous wick to the outside of the tank area. The non-zero time between the filling operation and the capping operation can create a potential failure mode where liquid is allowed to slowly leak out through the wick without the negative backpressure provided by the sealed reservoir. The amount of liquid that can leak through during even a controlled time frame is a function of the viscosity of the liquid (which can be variable based on the liquid used) and therefore can be difficult to control.

The second approach, discussed in patent application no. WO2015028815 A1, is to use a sufficiently large elastomeric component of sufficiently low durometer that it can be pierced simultaneously by two hypodermic style needles whose pierce sites will reseal sufficiently after the needles are removed. This approach assumes an effective seal between the elastomeric component and the filling needle but requires a second, venting needle. One needle is described as being the inlet for liquid into the interior of the cartridge, while the other for the evacuation of the air that is inside the cartridge before filling. This approach allows the cartridges to be fully assembled at the time of fill.

Although this two needle approach may alleviate the need to perform a separate capping operation, it also has issues in terms of its ability to fill the cartridge completely and with a precise volume of liquid. Each pierce location is a potential failure site in the final product, and thus using a secondary vent pierce site doubles the chance of a problem with the final product and during the piercing process. In addition, if passive venting is chosen through the second needle, the level of fill must be sufficiently low to prevent liquid ever reaching the second needle, because although air can easily vent through the small diameter needle; liquid in the needle constitutes a significant blockage. Once liquid enters the second needle, air may no longer flow, even if still trapped within the electronic cigarette or cartridge reservoir. If active venting is chosen, there is a similar risk that the vacuum will pull liquid out of the cartridge, causing waste and introducing additional randomness to the final fill volume.

Finally, in all cases the secondary vent pierce limits how full the container can be filled since the needle has to pierce sufficiently deeply to ensure that it's opening is fully below the surface of the elastomeric component, which inherently means that there is some cavity of air left above it that can never be displaced. This issue persists even if a production method is created that can tolerate the liquid front reaching all the way to the vent location. Once the liquid front reaches the vent location any incremental liquid added to the system either gets forced through the vents or through the porous wick to the outside of the tank.

For example, FIGS. 1A-1G illustrate the use of the current two-needle approach and its shortcomings. In this example, the cartridge includes an elastomeric cap, and is preassembled with the wick, polymeric reservoir (rigid tank), and elastomeric (piercable) resealable cap. In FIG. 1A the assembled cartridge is ready to be filled by receiving the needles. In FIG. 1B the needle pierces the elastomeric cap to a distance that is large enough to ensure that the needle opening is exposed and open within the cartridge, then begins to fill. In FIG. 1C, the front of liquid being filled reaches one end of the cartridge and one side of the wick. In FIG. 1D the liquid front has occluded both sides of the porous wick. In FIG. 1E the liquid front has risen until it is nearly at the vent needle. This may be an ideal time to stop if (e.g., passive filling) the needle will clog and stop passing air once fluid contacts it (e.g., cannot tolerate liquid in the vent line). In FIG. 1F the liquid front has occluded all of the vent locations, and any incremental liquid pumped into the cartridge past this point (even with active venting through the vent needle) will either pass through the vent needle or leak out of the porous wick. No additional air can be displaced. Finally in FIG. 1G, once no more liquid can be added to the system, the needles are retracted and the filling is complete, leaving a substantial amount of captive air.

Thus, there is a need for methods and apparatuses (e.g., cartridges, filling devices and the like) for filling electronic cigarette and/or cartridge reservoirs so that they do not trap any air within the otherwise sealed reservoir, and particularly in reservoirs including a porous wick. Described herein are methods and apparatuses to address this need.

SUMMARY OF THE DISCLOSURE

Described herein are apparatuses including tanks to be filled with a vaporizable liquid and methods of filing them. Also described are systems for filling one or a plurality of cartridges having tanks without entrapping air within the tank volume. For example, described herein are methods of filling a tank volume of a cartridge for an electronic cigarette from a bottom or side surface opposite a wick so that the wick remains at least partially dry and can vent air during filling until the tank volume is full.

A method of filling a tank volume of an electronic cigarette cartridge with a liquid vaporizable material, wherein the cartridge includes a porous wick at a first end of the tank volume, may include: positioning the cartridge on a surface so that the porous wick is positioned on a top or side surface; inserting a needle into the tank volume from a bottom or side surface, opposite from the porous wick; injecting a vaporizable liquid into the tank volume; and venting air out of the tank through the porous wick until the tank volume is full of the vaporizable liquid and no air is entrapped within the tank volume.

A method of filling a tank volume of an electronic cigarette cartridge with a liquid vaporizable material, wherein the cartridge includes a porous wick at a first end of the tank volume, may include: positioning the cartridge on a surface so that the porous wick is oriented on a top opposite from the surface; inserting a needle into the tank volume from a bottom of the cartridge, opposite from the porous wick; injecting a vaporizable liquid into the tank volume through the needle; and venting air out of the tank through the porous wick as the tank volume fills, until the tank volume is full of the vaporizable liquid and no air is entrapped within the tank volume.

A method of filling a tank volume of an electronic cigarette cartridge with a liquid vaporizable material, wherein the cartridge includes a porous wick at a first end of the tank volume, may include: positioning the cartridge on a surface so that the porous wick is positioned on a side above the surface; inserting a needle into the tank volume from a side of the cartridge that is opposite from the porous wick; injecting a vaporizable liquid into the tank volume through the needle; and venting air out of the tank through the porous wick as the tank volume fills, until the tank volume is full of the vaporizable liquid and no air is entrapped within the tank volume.

In any of the methods described herein, the cartridge may be positioned flat against the surface, on a long side, on a short side, or on its top. In general the cartridges described herein may be rectangular in outer cross-section.

Any appropriate needle may be used. For example, the needle may have a beveled distal tip and a front-facing aperture. The needle may have a beveled distal tip and one or more side-facing aperture(s). The needle may be blunt.

Inserting the needle may include inserting through a septum, such as an elastomeric top or side. In some variations, inserting the needle may include inserting the needle through a pre-cut port or valve.

In any of the methods described herein, the temperature of the material being filled and/or the temperature of the filling device (including the needle(s), surface, stage or stand onto which the cartridges are held) or all or part of the cartridge itself (including just the tank and any internal components of the tank) may regulated by heating and/or warming. For example, when filling with a viscous material, the material may be warmed to lower the viscosity and/or cooled within the tank to increase the viscosity.

In general, the vaporizable liquid may comprise any appropriate material, including nicotine solutions (e.g., the vaporizable liquid may be a nicotine salt in an aqueous solution), a cannabis liquid (e.g., including a viscous cannabis-containing material), or any other pharmaceutical material. For example, the vaporizable material may contain a medicinal compound as an active ingredient. The medicinal compounds that are active ingredients for vaporization with the electronic vaporizer device utilizing the method herein, include drugs that can be heated without combustion to vaporization for inhalation delivery at a temperature range of, e.g., about 100° C. (e.g., for water-based carriers, e.g., about 100° C., 105° C., 110° C., 120° C., 130° C., 140° C., 150° C., 160° C., 170° C., etc.; for ethanol-based formulations, e.g., about 50° C., about 60° C., about 70° C., about 80° C., etc.) to about (e.g., below) the temperature at which the active ingredient thermally decomposes (e.g., less than about 150° C., 160° C., 170° C., 180° C., 190° C., 200° C., 210° C., 220° C., 230° C., 240° C., 250° C., 260° C., 270° C., 280° C.; 290° C., 300° C., etc.). In certain embodiments, the drugs can be neat or are solubilized in a pharmaceutically acceptable solvent. In certain embodiments, the drugs can include over the counter (OTC) substances as aides for various ailments; wherein said drugs can include known respiratory aides for asthma or chronic obstructive pulmonary disease (COPD). The vaporizable materials that are active ingredients for vaporization with the device(s) herein described, can include drugs that can be heated to vaporization for inhalation delivery, without combustion; wherein said drugs can include over the counter (OTC) substances from the group comprising upper respiratory aides (like cetirizine), analgesics and internal medication aides (like ibuprofen, naproxen), heartburn aides (like omeprazole), sleeping aides (like doxylamine, diphenhydramine, melatonin), or motion sickness aides (like meclizine). In certain embodiments, the vaporizable material can contain respiratory aides for asthma or chronic obstructive pulmonary disease (COPD) such as short acting beta-agonist (like albuterol, levalbuterol, pirbuterol), long acting beta-agonist (like salmeterol, formoterol), anti-cholinergics (like atropine sulfate, ipratropium bromide), leukotriene modifiers (like montelukast, zafirlukast), cartico-steriods (like fluticasone, budesonide, mometasone), theophylline (like theophylline), or combination corticosteroid and beta agonist, long lasting (fluticasone and salmeterol, budesonide and formoterol, mometasone and formoterol). In certain embodiments, the vaporizable material can contain botanicals and/or nutraceuticals such as tea (polyphenols, flavonoids, green tea catechins+/− caffeine); horehound (phenol flavonoid glycosides, labdane diterpenoids, yohimbe, cranberry/grape (proanthocyanidins), black cohosh (terpene glycoside fraction (actine/cimifugoside), flax seed (omega fatty acids), echinacea (echinacoside), valerian (alkaloids, gabapentin, isovaleric acid, terpenes), senna (senna cglycosides), cinnamon (cinnamaldehyde, phenols, terpenes), vitamin D, saw palmetto (fatty acids), or caffeine. In certain embodiments, the vaporizable material is soluble to at least fifty percent by weight in any suitable carrier solvent such as glycols (such as propylene glycol and vegetable glycerin), ethylene glycol, dipropylene glycol, trimethylene glycol, ethanol, and combinations thereof. In certain embodiments, the medicinal compound is terpinolene. In certain embodiments, the medicinal compound is Linalool. In certain embodiments, the medicinal compound is phytol. In certain embodiments, the medicinal compound is beta myrcene. In certain embodiments, the medicinal compound is citronellol. In certain embodiments, the medicinal compound is caryophyllene oxide. In certain embodiments, the medicinal compound is alpha pinene. In certain embodiments, the medicinal compound is limonene. In certain embodiments, the medicinal compound is beta caryophyllene. In certain embodiments, the medicinal compound is humulene. In certain embodiments, the vaporizable material is an essential oil.

In any of these variations, the vaporizable liquid may be injected into the tank volume at any appropriate rate. For example, the vaporizable liquid may be injected into the tank volume at between about 0.1 ml/sec and 5 ml/sec, 0.5 ml/sec and 2 ml/sec, about 1 ml/sec, etc. (e.g., at a rate between a lower value in ml/sec of 0.05, 0.06, 0.07, 0.08, 0.09, 0.1, 0.2, 0.3, 0.4, 0.5, 0.6, 0.7, 0.8, 0.9, 1.0, 1.1, 1.2, 1.3, 1.4, 1.5, 1.6, 1.7, 1.8, 1.9, 2, 3, 4, 5, 6, 7, 8, 9, 10, 12, 15, etc. and an upper value in ml/sec of 0.5, 0.6, 0.7, 0.8, 0.9, 1.0, 1.1, 1.2, 1.3, 1.4, 1.5, 1.6, 1.7, 1.8, 1.9, 2, 3, 4, 5, 6, 7, 8, 9, 10, 12, 15, 20, etc. where the lower value is always less than the upper value).

In any of these variations, and particularly when the cartridge is oriented on its side and injected from the side, it may be beneficial for the tank volume to include one or more obstructions within the tank volume. The obstruction (e.g., central tube or cannula passing through the tank volume) may form sub-regions within the tank volume the preferentially fill first, without entrapping air, and allow the tank volume to be filled at high rates (e.g., between about 0.5 ml/sec and 2 ml/sec, greater than 0.5 ml/sec, etc.) without entrapping air within the tank volume.

In general, any of these methods may include keeping at least a portion of the wick that is within the tank dry until there is no air entrapped within the tank volume.

Once the filling is complete, the needle may be withdrawn. In any of these methods the needle may be reoriented, including rotating and/or moving laterally (further into or partially out of the tank volume) during filling to direct the filling and prevent entrapment of air.

In any of these variations, the method may be done in parallel to simultaneously fill a large number of cartridges. For example, the method may include positioning a plurality of cartridges in parallel and concurrently inserting a plurality of needles into each of the cartridges, and concurrently injecting the vaporizable liquid into each of the cartridges.

BRIEF DESCRIPTION OF THE DRAWINGS

FIGS. 5A and 5B illustrate side and top views, respectively, of one variation of a filling needle.

FIGS. 6A and 6B illustrate side and top views, respectively, of one variation of a filling.

FIGS. 7A and 7B illustrate side and top views, respectively, of one variation of a filling needle.

DETAILED DESCRIPTION

Described herein are methods of filling a reservoir of an electronic cigarette or cartridge for an electronic cigarette so that air is not trapped within the cartridge. In particular, described herein are methods of filing a reservoir for an electronic cigarette including a porous wick extending out of the reservoir at a first end, without leakage, or overflow, until there is no air within the reservoir.

Figures 1A, 1B, 1C, 1D, 1E, 1F, 1G:
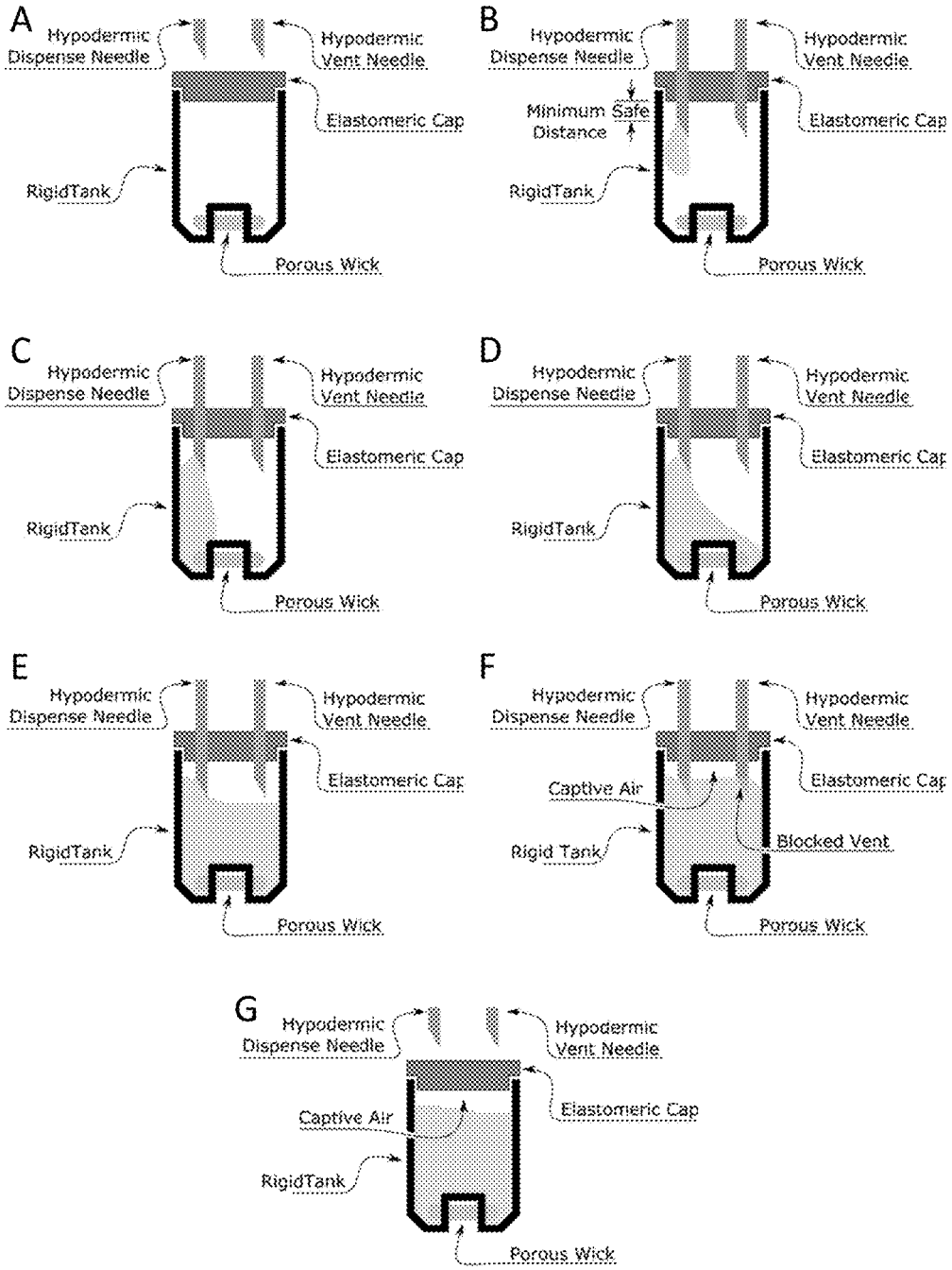
FIGS. 1A-1G illustrate a prior art method for filling a reservoir of an electronic cigarette cartridge which traps air within the cartridge.
Figure 2:
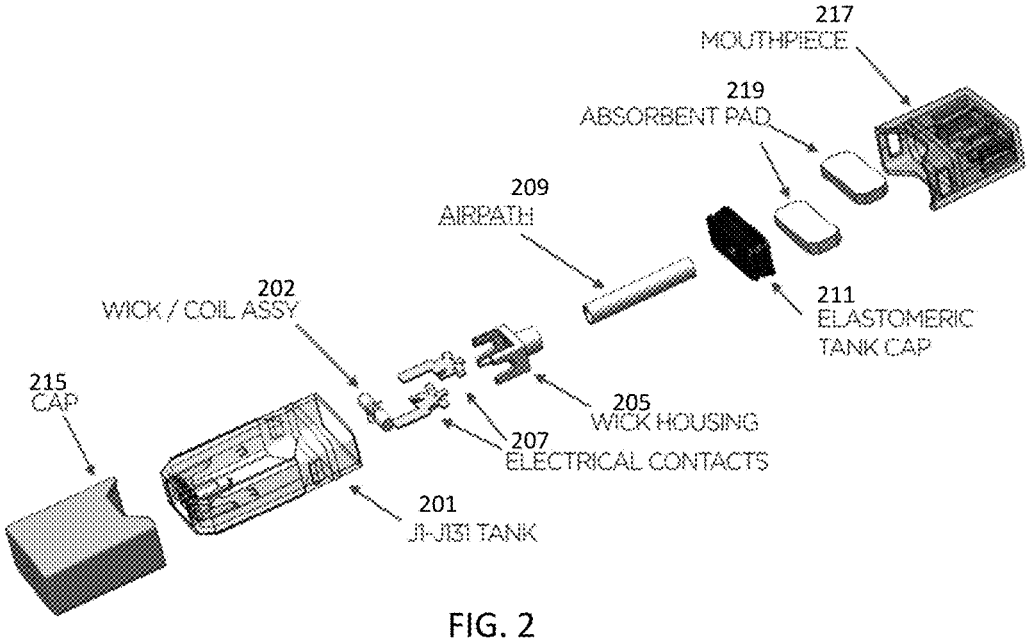
FIG. 2 is an exploded view of one example of a cartridge, including a reservoir, for an electronic cigarette.

In any of the variations described herein, the reservoir being filled may be a cartridge which may be filled vaporizable material (e.g., an aqueous solution of tobacco or any other liquid solution). For example, FIG. 2 shows one example of a cartridge including a reservoir that may be filled as described herein. FIGS. 1A-1G show a schematic illustration of another example of cartridge. In general a cartridge may include a reservoir into which fluid may be filled, a tank 201 (housing the reservoir), an elastomeric cap, and a porous wick at one end of the tank, which passes from within the tank to an external surface. The porous wick may be any appropriate material, including woven, braided, fibrous, and knitted materials. The wick may be coupled with or integral with a heating element. For example, a wire for resistive heating may be wrapped around an external portion of the wick, forming a wick/coil assembly 205 as shown in FIG. 2. The wick may be any appropriate material, including metals, polymers, natural fibers, synthetic fibers, or combinations of these. The wick is porous and provides a capillary pathway for fluid within the tank through and into the wick; the capillary pathway is generally large enough td permit wicking of sufficient material to replace vaporized liquid transferred from the tank by capillary action (wicking) during use of the electronic cigarette, but may be small enough to prevent leakage of the vaporizable fluid material out of the cartridge during normal operation, including when applying pressure (e.g., squeezing) the cartridge. The external portion of the wick may include a wick housing 205. The wick housing and/or wick may be treated to prevent leakage. For example, the wick and/or wick housing may be coated after filling to prevent leakage and/or evaporation through the wick until activated by connecting to an electronic cigarette and/or applying current through the electrical contacts 207 (e.g., operation in an electronic cigarette), or otherwise using the cartridge. Any appropriate coating may be used, including a heat-vaporizable coating (e.g., a wax or other material), a frangible material, or the like.

The cartridge may also include an air path through the tank (shown as a tube 209 in FIG. 2), which may at least partially partition the volume of the tank. The tank may include an elastomeric portion, such as all or a portion of the side, bottom, top, etc. In FIG. 2, the tank is covered by an elastomeric cap 211 (elastomeric tank cap). The elastomeric portion (e.g., cap) may, in some variations, be on an opposite side from the wick.

In the variation shown in FIG. 2, the cartridge including the tank also include a cover (cap 215) and is configured to be used as a mouthpiece, so includes a mouthpiece portion 217 that is separated from the tank 201 by one or more absorbent pads 219.

In general, the methods described herein may include filling the tank (e.g. of a cartridge) that includes a wick at one end. The method may generally include positioning the empty and fully assembled tank (e.g. cartridge) so that it may be filled by a single needle that is inserted from the bottom or side (but not the top) of the empty tank. For example, the tank may be held on its side or upside down.

Figure 3A:
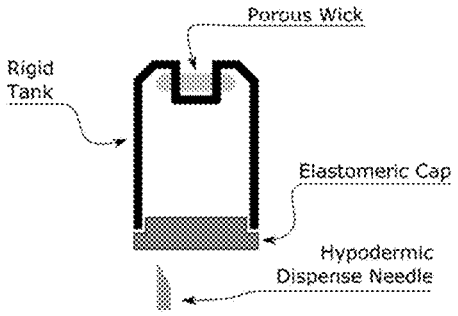
FIGS. 3A-3F illustrate a method filling a reservoir of a cartridge, similar to the cartridge shown in FIG. 2, of an electronic cigarette with a single needle.
Figure 3B:
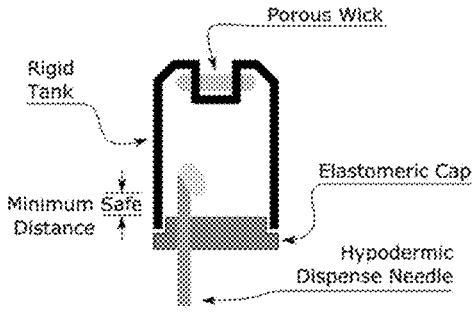
Figure 3C:
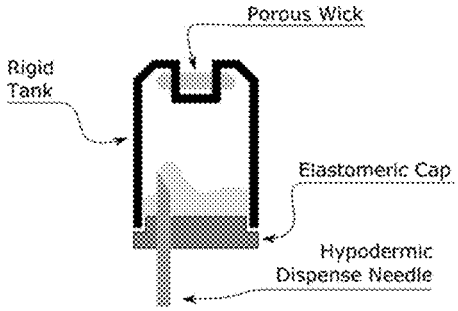
Figure 3D:
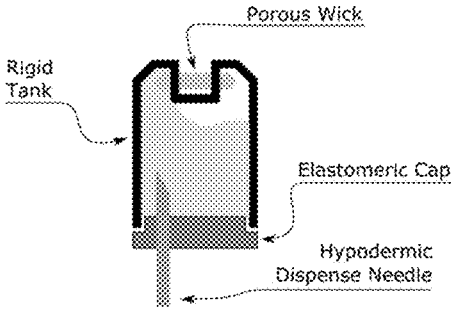
Figure 3E:
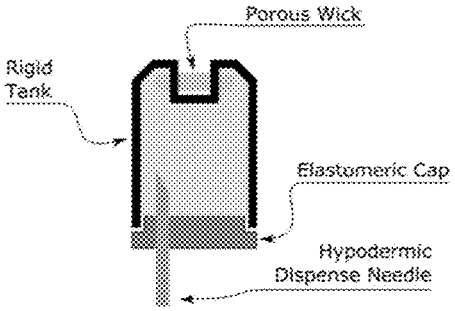
Figure 3F:
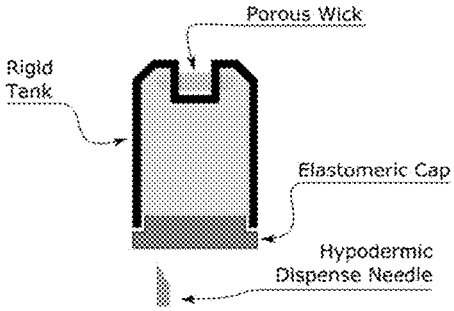

For example, FIGS. 3A-3F illustrate one example of filling as described herein, in which the tank is filled from a needle inserted into the bottom or lateral sides (where the lateral sides are not the top). In FIGS. 3A-3F, the filling system (e.g., needle, etc.) is inverted with respect to gravity so that the wick is not on the bottom. In FIG. 3A, the cartridge is ready to accept the dispensing needle through the elastomeric cap. During the first phase of fill liquid falls down around the needle that is injecting the liquid into the reservoir, immediately filling the reservoir in a way that the "additional vent" approach (shown in FIGS. 1A-1G) cannot. As filling progresses, air is displaced through the silica wick, at the top of the container in this example; the wick is dry, as shown in FIGS. 3B-3D. In FIG. 3B, the filling needle ("fill needle") pierces the elastomeric cap and begins dispensing. In this example a minimum safe distance for filling (e.g., the distance from the tip of the fill needle to the bottom of the opening of the needle opposite the tip) must be cleared by the needle before dispensing. In FIG. 3C the liquid fills the area between the needle opening and the elastomeric cap, and air is vented through the porous wick. By FIG. 3D, liquid being filled into the reservoir has reached one side of the wick, but venting may continue on the opposite side of the wick. In any of these examples the rate of filling may be controlled. For example, the rate of filling may be controlled to be relatively steady/constant and avoid splashing (e.g., by ramping up to the filling rate when initially filling). In FIG. 3E, the liquid front has finally reached the second side of the wick, and the cartridge is completely full, and (in FIG. 3F) the needle may be retraced, as shown.

In some variations, which may be used with tank-style electronic cigarettes, the wick may be as close to the bottom of the container as possible to ensure that as much liquid as possible can be drawn out of the container; when the cartridge is inverted this results in the wick being the highest point in the container and therefore an ideal location to vent from.

The area that surrounds the wick outside the tank may be configured to accommodate some amount of excess liquid during normal use (e.g., the wick housing), which means that it is often palatable to allow some small amount of liquid to be forced through the wick during filling, since any overflow ends up in a manageable location. This allows the possibility to fill a cartridge completely with no geometrically defined bubble zones.

Finally, it may be acceptable to allow some small amount of overfill in this configuration without having to deal with any messes or excess liquid, which allows for the addition of a subtle feature in the filling process. In some variations, the pumping system measures the pressure that it is applying during fill, and that pressure can be used to detect when the liquid front has reached the wick. The dramatic reduction in cross sectional area when passing through the wick typically results in a large change in fluid resistance, which in turn results in a relatively large spike in pressure in the tank and fill system when the flow front reaches the wick. This signal can be detected and used to switch off the pump, which allows the system to fill cartridges of variable sizes with no captive air.

As mentioned, in some variation the filling is performed when the tank is on its side, rather than upside down. This is shown in FIGS. 4A-4H. This variation may be employed to achieve the same effect as the inverted method discussed above, and may be particularly useful when machinery constraints provide a challenge to orienting the system so that the needles points upwards with respect to gravity. This variation may also be particularly useful if the cartridge is not a simple empty container and has additional features that can influence the liquid flow front as it is inserted. In general, it is desired to cause the wick to be the last point to become wetted when filling to completely fill the tank; this may be done when the cartridge (tank) is lying down or even vertical. When there are obstructions in the tank or connected sub-regions of the tank formed by projections into the tank, filing from different angles (e.g., side filling) may take advantage of different levels of fluid restriction in different areas of the cartridge. In any of these variations, the filling may also take advantage of the large difference in viscosity between air and the liquid being filled. Such differences can also be exaggerated by filling at very high speeds (around 1 ml/sec in the case of a cartridge that is between about 12 mm×about 4 mm×22 mm). See FIGS. 4A-4H for details of how the flow front advances in a cartridge during this horizontal fill process to avoid captured air.

Figure 4A:
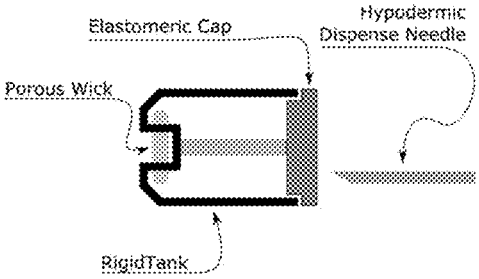
FIGS. 4A-4H illustrate a method of filling a reservoir of a cartridge, similar to the cartridge shown in FIG. 2, of an electronic cigarette with a single needle.
Figure 4B:
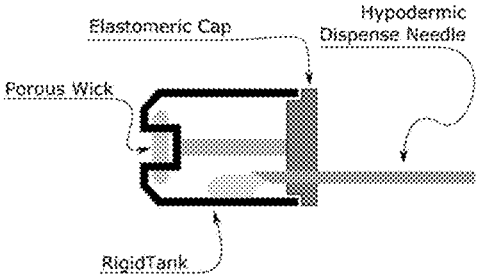
Figure 4C:
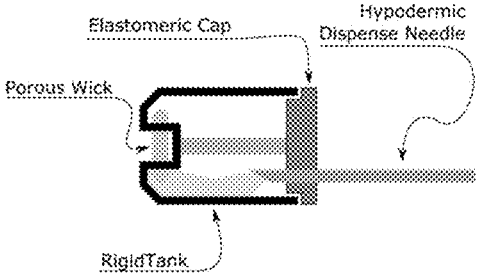
Figure 4D:
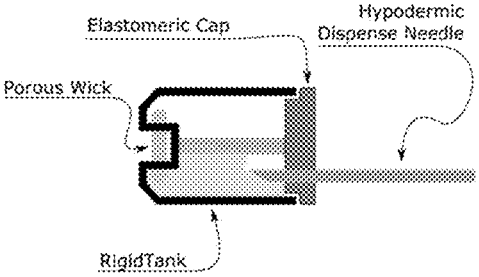
Figure 4E:
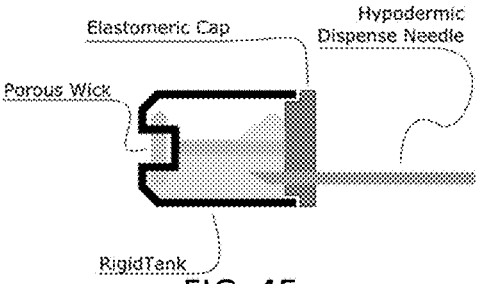
Figure 4F:
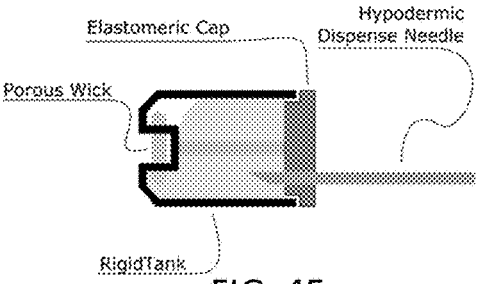
Figure 4G:
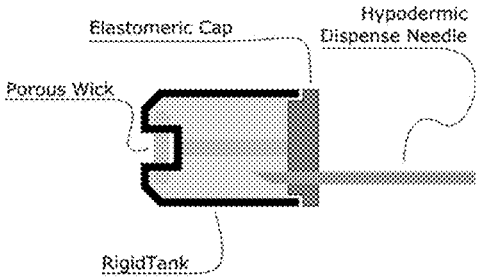
Figure 4H:
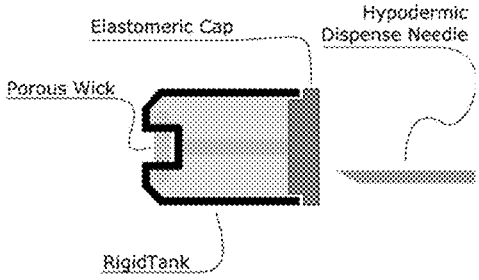

In FIG. 4A, the cartridge having an empty tank is fully assembled and positioned on its side, with the wick on a first side (perpendicular to the direction of gravity). In FIG. 4A, gravity is pointed in the direction of the page. Alternatively or additionally, the filling may be performed so quickly that viscous and inertial force dominate over the force of gravity. In FIG. 4B, the needle is inserted though the elastomeric cap opposite from the wick, and the filling may begin. The filling needle may be sharp and may include a beveled tip having the filling opening. The beveled opening may be oriented to direct the flow of filling liquid preferentially towards the bottom side of the cartridge (e.g., towards the page). In FIG. 4C, the flow front advances until it reaches the first wick end. The high rate of dispensing and fluid restricting of the wick may cause the flow front to advance within the cartridge instead of leaking out through the wick. In FIG. 4D, the internal tube restricts the flow of fluid from the side of the cartridge near the filling tube to the opposite side. In this example, fluid is restricted by the cannula (air path) to passing through the gap region between the walls of the tank and the cannula. This restriction may allow the filing to continue back towards the dispensing needle instead of starting to fill the opposite side from the needle (on the other side of the cannula). In FIG. 4E the proximity to the needle tip (dispensing head) may cause the flow front to finally cross the steel air path toward the end of the cartridge furthest from the wick (e.g., near the end from which the needle entered), eventually filling the furthest corner. In FIG. 4F, the flow front has advanced towards the wick as the top right (near the elastomeric cap) is filled, progressing towards the far side of the wick which is still venting. By FIG. 4G the flow front has reached the last free wick end at last, and after wetting it, no further air can escape (preventing it from venting captive air); by that point, filing is complete, as shown in FIG. 4H, and the hypodermic filling needle may be retracted, as shown.

This side-filling method may work well where there is some degree of fluid restriction (e.g., where, as here, a cannula or other obstruction is present in the tank). It also helps that fluid restriction through the wick is much higher when it is wetted than when it is dry, allowing it to behave effectively like a valve that creates a staged fill process. For example, filling the bottom, then the top. Similarly, the fluid restriction (governed in this case by the geometric arrangement or spacing) around the steel air path (cannula) is much higher than the fluid restriction back towards the needle, allowing the end far from the wick to fill in these examples, which, as shown in FIGS. 1A-1F is where air is trapped, forming a captive air zone in the 2 needle approach, even without gravity influencing that region to fill first as in the inverted filling technique show in FIGS. 3A-3H. Once the flow front reaches the far side of the air path it can simply fill towards the wick without risk of capturing any more air.

In cases in which the tank does not include an obstruction in the inner volume (e.g., where a feature similar to the steel air path in the cartridge shown in FIGS. 4A-4F is absent), a change to the needle geometry that causes the liquid to exit the needle in a direction normal to the axis of the needle (such as using a Witacre or Sprotte type needle, see FIGS. 6A-6B and 7A-B) may be used to influence the flow front to fill completely from the elastomer cap end to the wick end of the cartridge, as illustrated in FIGS. 8A-8F.

Figure 8A:
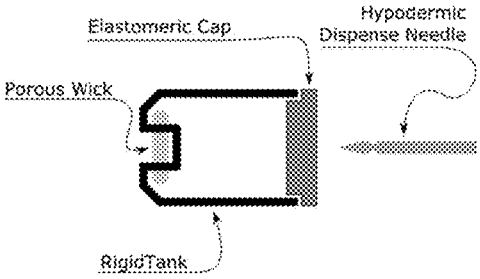
FIGS. 8A-8F illustrate a method of filling a reservoir of a cartridge, similar to the cartridge shown in FIG. 2, of an electronic cigarette with a single needle.
Figure 8B:
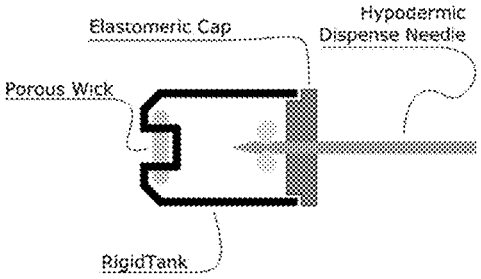
Figure 8C:
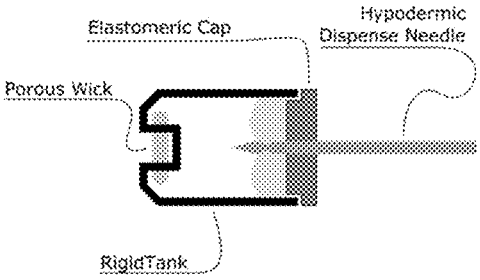
Figure 8D:
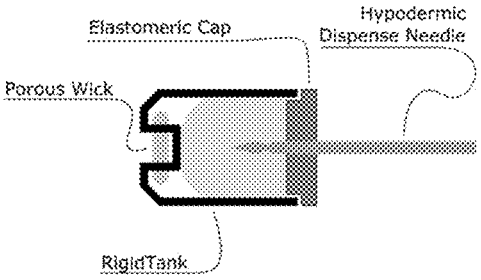

In this example, which is also a side-filling example, the cartridge including a tank is held sideways so that the wick is on one side and the needle is inserted from another side. The needle has a sharp distal tip and a more proximal side opening that directs the flow out of the needle perpendicular to the long axis of the needle. In FIG. 8A, a cartridge is viewed from above and ready for filling, otherwise fully assembled. In this example, gravity may be pointed down (towards the bottom of the page) or more preferable the cartridge is flat against a top surface and gravity is pointed into the page. Alternatively or additionally filling may be done rapidly so that viscous and inertial forces dominate over the gravitational forces. In FIG. 8B, the dispensing needle with side-exists (one or more preferably two side exits) is inserted into the tank reservoir and filing begins. The side exits (orifices) of the needle direct the flow front to fill the area between the needle side exits and the elastomeric section. Filling then progresses from the right to left as shown in FIG. 8C. In FIG. 8D, the filling has further progressed and the dispensing needle may be adjusted to avoid air being captured between the wick housing and the needle (or between the needle and the wall of the tank. Preferably the needle is separated from the wall to entrap an air bubble.

Figure 8E:
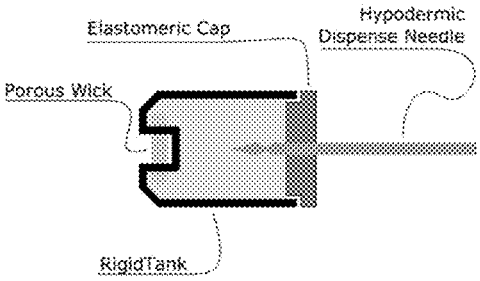
Figure 8F:
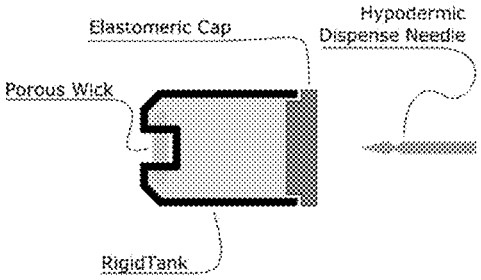

In FIG. 8E, the flow front has reached both wick ends at approximately the same time, and filling is complete in FIG. 8F and the needle may be retracted. Any of the filling methods described herein may be performed in parallel with multiple needles and multiple assembled cartridges/tanks.

Figure 9:
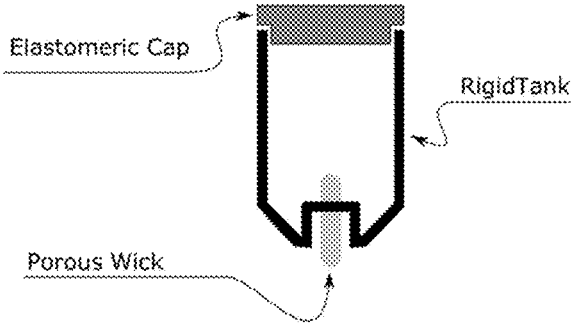
FIG. 9 is a front view of another variation of a cartridge, including a reservoir, for an electronic cigarette.

In all of these configurations we have depicted a style of tank with the wick reaching in to the tank in two locations. The risk of capturing air may be reduced if the wick reaches in to the tank in only one location, and the geometry of the tank may create a funnel towards that point, as would be the case with the variation shown in FIG. 9. All wick-venting filling methods and orientations described herein may work just as well or better with a cartridge of this format.

In general, the filling material (e.g., vaporizable material) that is injected into the tank may be any appropriate liquid. Examples of such liquid may include an aqueous solution of a nicotine salt (as incorporated by reference in its entirety above), or of a cannabis formulations. Any liquid solution may be used, including pharmaceutical solutions that may be vaporized for delivery (e.g., any liquid suitable for vaporization).

In some variations the cartridge may include a pre-pierced septum (e.g., elastomeric cap, etc.), and a blunt dispensing tip (filling needle) may be introduced through the existing septum flap to fill the tank reservoir. Alternatively or additionally any of these variations may include a resealable port of valve into which the needle is inserted for filling. This may reduce the required clearance of the needle (the minimum safe distance mentioned above). For example, a "star valve" may be formed (e.g., punched or laser cut, etc.) in a wall of the tank and/or the elastomeric top (septum), which may also allow liquid to be filled into the tank with a blunt dispensing tip. Alternatively or additionally, a mechanical fill port such as a poppet valve may be included in the cartridge and used for filling, rather than a penetrable septum like the elastomeric cap; this may also allow the use of a blunt dispensing tip, which may be designed to mate with the port.

As mentioned, any appropriate needle may be used, including those that direct the flow laterally (see e.g., FIGS. 6A-7B) or retrograde.

Figure 10C:
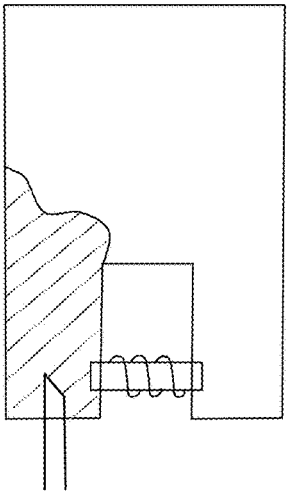
FIGS. 10A, 10B and 10C illustrate other variations of a method of filling a reservoir of a cartridge with a single needle. In these variations the liquid is filled from the same side as the wick, and the tank region (reservoir) is U-shaped. In general, one end of the wick may be confined to a smaller diameter region/smaller chamber so that it fills last, leaving the wick dry and able to vent air.
Figure 10A:
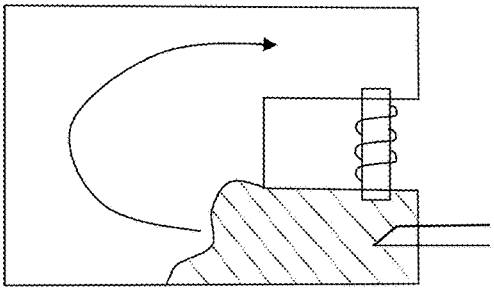
Figure 10B:
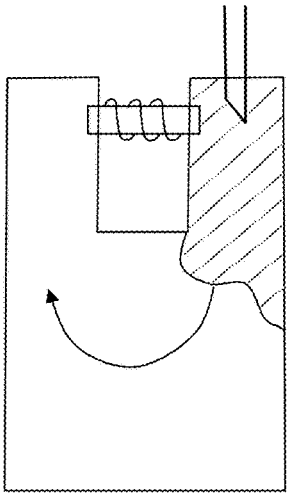

FIGS. 10A and 10B illustrate another variation of a filling method in which the needle is inserted from the same side as the wick. In this example, the filling may occur as described above, but may wrap around as shown in the arrow to fill the cartridge without leaving any air bubbles. In FIG. 10A, the cartridge is filled from the side (as described above) and may be lying flat (with a superior surface against a flat surface) so that gravity is into the page, or it may be inverted, as shown in FIG. 10B. Although it may be challenge. One or both of these filling arrangements. Note that a third variation is shown in FIG. 10C, where the liquid is filled from the bottom of the cartridge. In this case (as in FIGS. 10A-10B), liquid would preferentially flow into the tank vs. through the higher restriction of the wick, especially if filled slowly.

Alternative Cartridge Embodiments

Figure 11A:
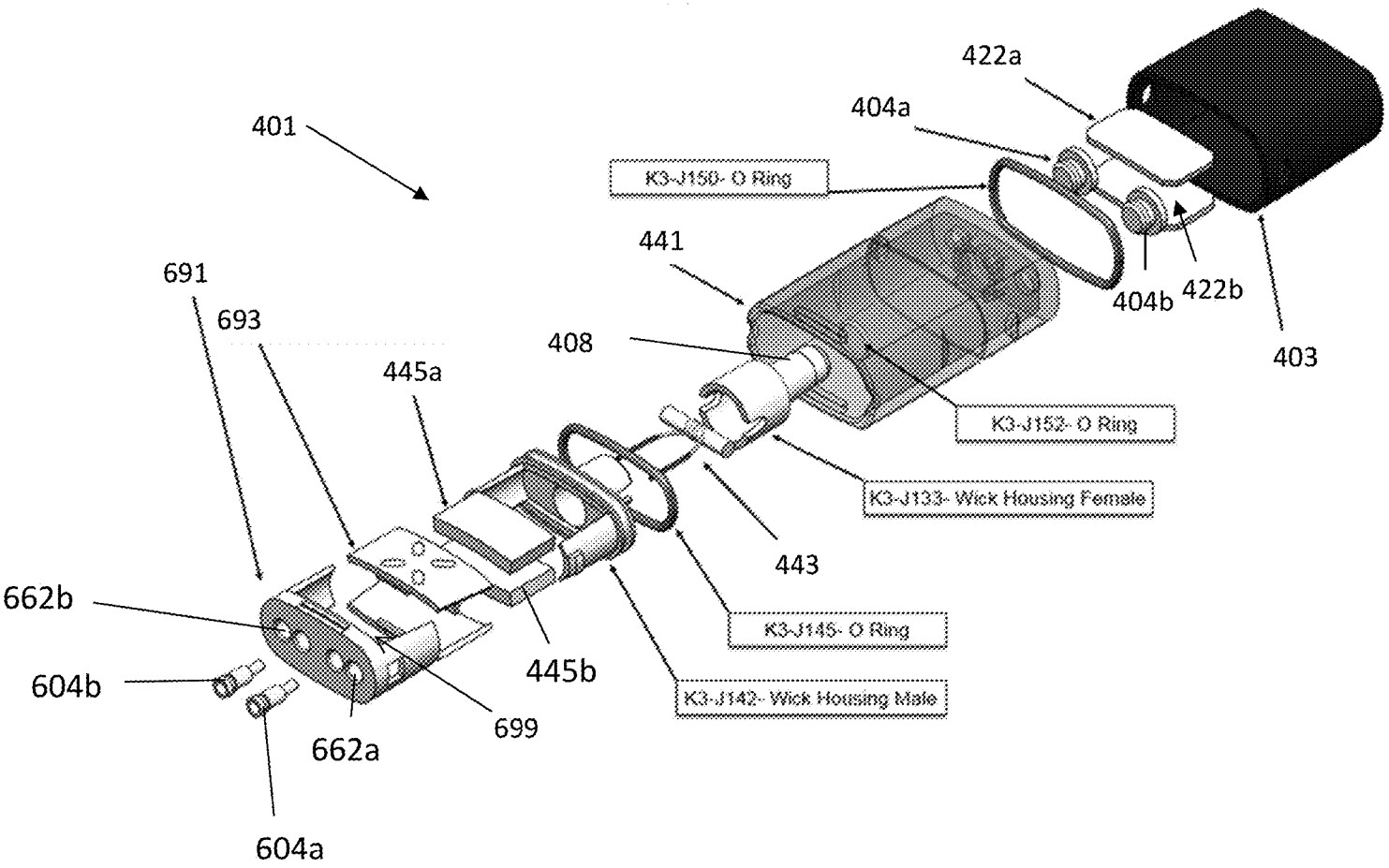
FIG. 11A illustrates an exploded view of a cartridge that may be filled as described herein.
Figure 11B:
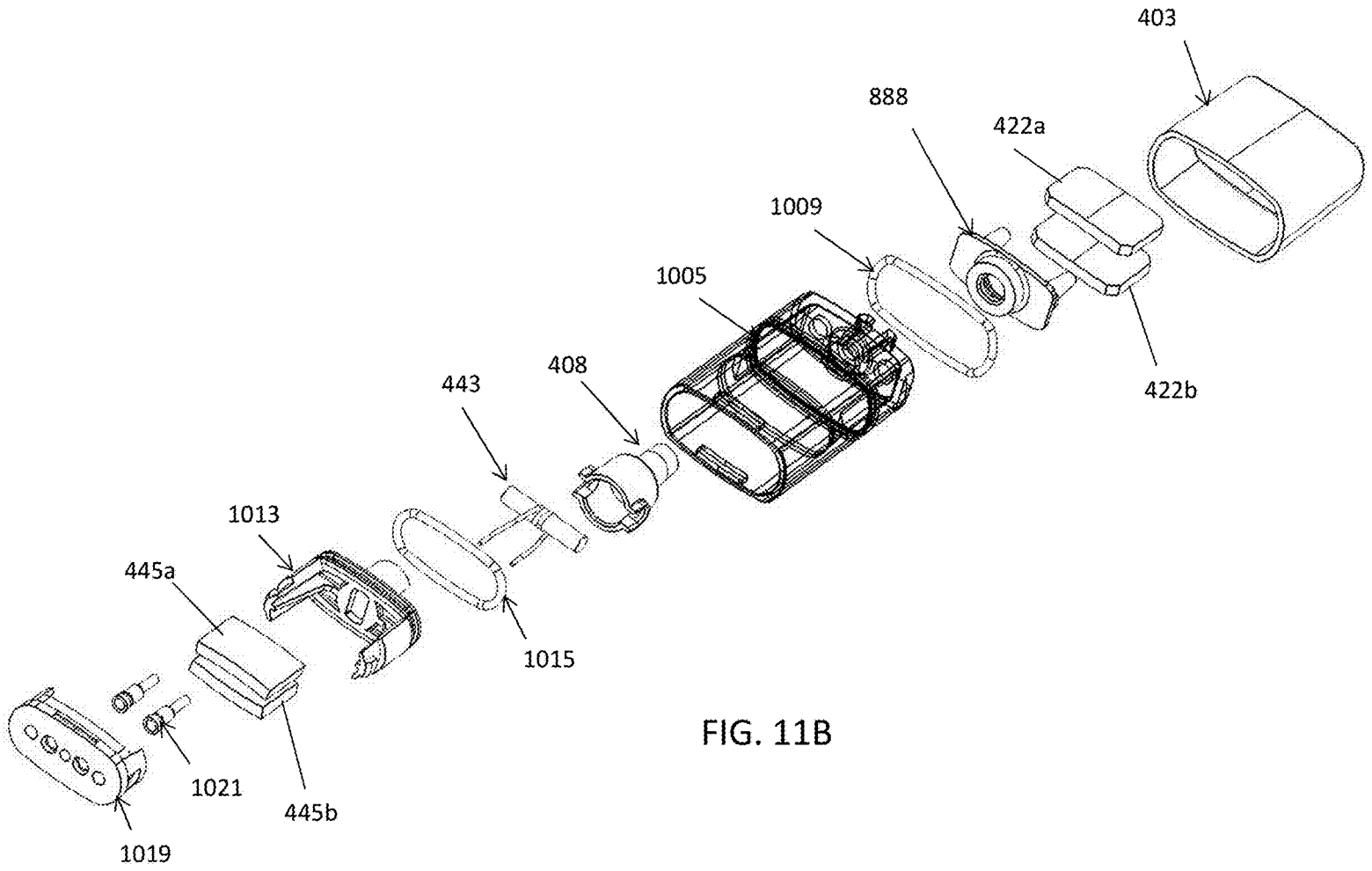
FIG. 11B is an alternative exploded view of a cartridge that may be filled as described herein.

The methods and apparatuses (including filling devices, systems, hardware and/or software for controlling filling) described herein may be used with any appropriate cartridge, including those shown in the exploded view of FIGS. 11A-11B.

For example, in FIG. 11A, the cartridge, whose components are described in greater detail below, may be filled by removing one or both plugs 404*a*, 404*b*, or by injection through these plugs, which may be formed of a self-healing material. In the exploded view of FIG. 11A the cartridge 401 includes a tank 441 configured to hold a liquid vaporizable material therein, a heater (e.g. a wick and coil assembly) 443 configured to heat the vaporizable material in the tank 441, and an air tube 408 extending from the tank to a mouthpiece 403. Contacts 535 are configured to connect with contacts 435 on the reusable component 411 to provide power to activate the wick and coil assembly 443. At the distal end of the cartridge the walls of the elongate and flattened tubular body 441 and a bottom cover piece 691 form an overflow leak chamber 699, which is shown with a pair of absorbent pads 495*a,b* are positioned along the long walls (along the diameter) of the overflow leak chamber. An option felt cover 693 may be included (also acting as an absorbent member). Parallel absorbent pads 422*a,b* can be positioned within the mouthpiece 403. The absorbent pads 422*a,b* are rectangular and parallel with one another. The absorbent pads 422*a,b* are positioned substantially parallel to the flat side of the device 400 (parallel with the plane of the length l and width w in FIG. 4A) and parallel with one another. In some embodiments, the pads 422*a,b* can be biased fully against the inside walls of the mouthpiece 403 so as to easily capture liquid that rolls along the walls (including during filling). A distance between the two pads 422*a,b* can be, for example, between 3 and 6 mm, such as between 4 and 5 mm, e.g., approximately 4.8 mm. The gap between the absorbent pads 422*a,b* advantageously prevents the pads from interfering with the air flow path when a user draws on the mouthpiece 403.

In general, over-flow pads, e.g., 445*a,b* may be positioned proximate to the tank 441, i.e., within an overflow leak chamber below the tank, to absorb liquid that may leak out of the tank 441 during filling and/or use. The over-flow pads 445*a,b* can be similarly placed parallel to one another and/or against the sides of the shell 431 as described above with respect to pads 422*a,b*.

Another example of a cartridge is shown in FIG. 11B. In this example, exemplary device 800 is similar to device 400 (similar reference numbers are therefore used) except that it includes a single plug 888 in the proximal section of the cartridge 801 (i.e., as opposed to the two tank seals 604*a,b* shown in FIG. 11A). The plug 888 is configured to simultaneously seal both outlets of the mouthpiece 403 while also sealing around the tube 408. As mentioned, filling may be performed as described herein, including injecting through the self-healing (e.g., a rubber or polymeric material).

In the exploded view of a cartridge shown in FIG. 11B, the apparatus includes a cartridge body 1005 that may be clear (transparent), opaque and/or translucent. The cartridge body may form a reservoir for the liquid vaporizable material, and particularly for a viscous liquid vaporizable material such as a cannabinoid oil, nicotine solution or other vaporizable material. The cartridge may include an outer seal (e.g., o-ring 1009) that seals the mouthpiece 403 over the body 1005. The reservoir (tank) may be sealed on the top (at the proximal end) under the mouthpiece by a single-piece plug 888 that covers multiple openings which may be used for filling the tank. The vaporization chamber may be formed at the bottom (distal end) of the cartridge; in exemplary cartridges described herein the vaporization chamber is formed from a cannula and housing piece 1011 that includes opening into which the wick (wick portion of wick and coil 443) passes into the chamber; the walls forming the vaporization chamber separate it from the tank and mate with a back piece 1013 that forms the bottom (distal end) of the tank within the cartridge body. This piece is also sealed (e.g., by an o-ring 1015) to the cartridge body from within the cartridge body, as shown. An air chamber is then formed between the bottom of the cartridge 1019 and the back piece 1013 of the tank. One or more (e.g., two) air openings 796, 796' through this bottom 1019 allow air to pass (after entering the cartridge receiver through one or more openings 894 in the side) into the distal end of the cartridge, into the air chamber region and then up through an opening into the vaporization chamber. The piece forming the bottom of the cartridge 1019 may also accommodate or include one or more (e.g., two) electrical connectors that are configured to mate with the connectors on the vaporizer base. As mentioned, these contacts may be wiper or scraping contacts. In FIG. 11B, they are shown as cans 1021, 1021' having openings into which the pins project to form an electrical contact.

Any of the methods (including user interfaces) described herein may be implemented as software, hardware or firmware, and may be described as a non-transitory computer-readable storage medium storing a set of instructions capable of being executed by a processor (e.g., computer, tablet, smartphone, etc.), that when executed by the processor causes the processor to control perform any of the steps, including but not limited to: displaying, communicating with the user, analyzing, modifying parameters (including timing, frequency, intensity, etc.), determining, alerting, or the like.

When a feature or element is herein referred to as being "on" another feature or element, it can be directly on the other feature or element or intervening features and/or elements may also be present. In contrast, when a feature or element is referred to as being "directly on" another feature or element, there are no intervening features or elements present. It will also be understood that, when a feature or element is referred to as being "connected", "attached" or "coupled" to another feature or element, it can be directly connected, attached or coupled to the other feature or element or intervening features or elements may be present. In contrast, when a feature or element is referred to as being "directly connected", "directly attached" or "directly coupled" to another feature or element, there are no intervening features or elements present. Although described or shown with respect to one embodiment, the features and elements so described or shown can apply to other embodiments. It will also be appreciated by those of skill in the art that references to a structure or feature that is disposed "adjacent" another feature may have portions that overlap or underlie the adjacent feature.

Terminology used herein is for the purpose of describing particular embodiments only and is not intended to be limiting of the invention. For example, as used herein, the singular forms "a", "an" and "the" are intended to include the plural forms as well, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof. As used herein, the term "and/or" includes any and all combinations of one or more of the associated listed items and may be abbreviated as "/".

Spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if a device in the figures is inverted, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly. Similarly, the terms "upwardly", "downwardly", "vertical", "horizontal" and the like are used herein for the purpose of explanation only unless specifically indicated otherwise.

Although the terms "first" and "second" may be used herein to describe various features/elements (including steps), these features/elements should not be limited by these terms, unless the context indicates otherwise. These terms may be used to distinguish one feature/element from another feature/element. Thus, a first feature/element discussed below could be termed a second feature/element, and similarly, a second feature/element discussed below could be termed a first feature/element without departing from the teachings of the present invention.

Throughout this specification and the claims which follow, unless the context requires otherwise, the word "comprise", and variations such as "comprises" and "comprising" means various components can be co-jointly employed in the methods and articles (e.g., compositions and apparatuses including device and methods). For example, the term "comprising" will be understood to imply the inclusion of any stated elements or steps but not the exclusion of any other elements or steps.

In general, any of the apparatuses and methods described herein should be understood to be inclusive, but all or a sub-set of the components and/or steps may alternatively be exclusive, and may be expressed as "consisting of" or alternatively "consisting essentially of" the various components, steps, sub-components or sub-steps.

As used herein in the specification and claims, including as used in the examples and unless otherwise expressly specified, all numbers may be read as if prefaced by the word "about" or "approximately," even if the term does not expressly appear. The phrase "about" or "approximately" may be used when describing magnitude and/or position to indicate that the value and/or position described is within a reasonable expected range of values and/or positions. For example, a numeric value may have a value that is +/−0.1% of the stated value (or range of values), +/−1% of the stated value (or range of values), +/−2% of the stated value (or range of values), +/−5% of the stated value (or range of values), +/−10% of the stated value (or range of values), etc. Any numerical values given herein should also be understood to include about or approximately that value, unless the context indicates otherwise. For example, if the value "10" is disclosed, then "about 10" is also disclosed. Any numerical range recited herein is intended to include all sub-ranges subsumed therein. It is also understood that when a value is disclosed that "less than or equal to" the value, "greater than or equal to the value" and possible ranges between values are also disclosed, as appropriately understood by the skilled artisan. For example, if the value "X" is disclosed the "less than or equal to X" as well as "greater than or equal to X" (e.g., where X is a numerical value) is also disclosed. It is also understood that the throughout the application, data is provided in a number of different formats, and that this data, represents endpoints and starting points, and ranges for any combination of the data points. For example, if a particular data point "10" and a particular data point "15" are disclosed, it is understood that greater than, greater than or equal to, less than, less than or equal to, and equal to 10 and 15 are considered disclosed as well as between 10 and 15. It is also understood that each unit between two particular units are also disclosed. For example, if 10 and 15 are disclosed, then 11, 12, 13, and 14 are also disclosed.

Although various illustrative embodiments are described above, any of a number of changes may be made to various embodiments without departing from the scope of the invention as described by the claims. For example, the order in which various described method steps are performed may often be changed in alternative embodiments, and in other alternative embodiments one or more method steps may be skipped altogether. Optional features of various device and system embodiments may be included in some embodiments and not in others. Therefore, the foregoing description is provided primarily for exemplary purposes and should not be interpreted to limit the scope of the invention as it is set forth in the claims.

The examples and illustrations included herein show, by way of illustration and not of limitation, specific embodiments in which the subject matter may be practiced. As mentioned, other embodiments may be utilized and derived there from, such that structural and logical substitutions and changes may be made without departing from the scope of this disclosure. Such embodiments of the inventive subject matter may be referred to herein individually or collectively by the term "invention" merely for convenience and without intending to voluntarily limit the scope of this application to any single invention or inventive concept, if more than one is, in fact, disclosed. Thus, although specific embodiments have been illustrated and described herein, any arrangement calculated to achieve the same purpose may be substituted for the specific embodiments shown. This disclosure is intended to cover any and all adaptations or variations of various embodiments. Combinations of the above embodiments, and other embodiments not specifically described herein, will be apparent to those of skill in the art upon reviewing the above description.

What is claimed is:

1. A method of filling a tank volume of a vaporizer cartridge with a liquid vaporizable material, the method comprising:

positioning a first end of the tank volume above a second end of the tank volume, wherein a wick is positioned proximate to the first end and an elastomeric material is positioned proximate to the second end, and wherein opposing ends of the wick are in communication with the tank volume;

inserting a needle through the elastomeric material and into the tank volume;

injecting, through the needle, a liquid vaporizable material into the tank volume; and venting air out of the tank volume through the wick thereby allowing filling of the tank volume with the liquid vaporizable material.

2. The method of claim 1, wherein the needle is inserted off-center from a longitudinal axis of the tank volume thereby substantially filling a first half of the tank volume before substantially filling a second half of the tank volume.

3. The method of claim 1, wherein the positioning comprises vertically aligning the wick above the elastomeric material.

4. The method of claim 1, wherein the needle comprises a beveled distal tip and an aperture directed at a wall defining the tank volume and extending between the first end and the second end.

5. The method of claim 1, wherein the inserting further comprises inserting the needle through a pre-cut port or valve.

6. The method of claim 1, wherein the needle comprises a blunt distal tip.

7. The method of claim 1, wherein the liquid vaporizable material comprises nicotine and an organic acid.

8. The method of claim 7, wherein the organic acid comprises benzoic acid.

9. The method of claim 1, wherein the injecting further comprises injecting the liquid vaporizable material at a rate between about 0.5 ml/sec and 2 ml/sec.

10. The method of claim 1, further comprising:

filling a first volume of the tank volume and a second volume of the tank volume with the liquid vaporizable material, wherein the first volume and the second volume are formed in part by a cannula disposed within the tank volume, and wherein the first volume is substantially filled prior to the second volume being substantially filled.

11. The method of claim 1, further comprising keeping at least one end of the opposing ends of the wick dry until the tank volume is substantially void of air.

12. The method of claim 1, further comprising:

withdrawing the needle from the tank volume thereby allowing the elastomeric material to provide a fluidic seal thereby preventing fluid from flowing through the elastomeric material.

13. The method of claim 1, wherein positioning the vaporizer cartridge comprises positioning a plurality of vaporizer cartridges in parallel and concurrently inserting one of a plurality of needles into a corresponding one of the plurality of vaporizer cartridges, and concurrently injecting the liquid vaporizable material into each of the plurality of vaporizer cartridges.

14. A method of filling a tank volume of a vaporizer cartridge with a liquid vaporizable material, the method comprising:

positioning a first side of the vaporizer cartridge above a second side of the vaporizer cartridge, wherein a wick is positioned proximate to a first end of the vaporizer cartridge and an elastomeric material is positioned proximate to a second end of the vaporizer cartridge, wherein the first side and the second side respectively extend between the first end and the second end, and wherein opposing ends of the wick are in communication with the tank volume;

inserting a needle through the elastomeric material and into the tank volume;

injecting, through the needle, the liquid vaporizable material-into the tank volume; and venting air out of the tank volume through the wick thereby allowing filling of the tank volume with the liquid vaporizable material.

15. The method of claim 14, wherein the vaporizer cartridge further comprises a cannula disposed within the tank volume thereby forming a first volume of the tank volume, a second volume of the tank volume, and a passageway extending along a side of the cannula between the first volume and the second volume.

16. The method of claim 15, further comprising:

filling a first volume of the tank volume and a second volume of the tank volume with the liquid vaporizable material, wherein the first volume and the second volume are formed in part by a cannula disposed within the tank volume, and wherein the first volume is substantially filled prior to the second volume being substantially filled.

17. The method of claim 1, wherein the first end and the second end are positioned on opposing sides of the tank volume.

18. The method of claim 1, further comprising:

detecting a pressure in a fluid line in communication with the needle; and stopping injection when a threshold pressure is detected, wherein the threshold pressure indicates the tank volume being substantially full of the liquid vaporizable material.

19. The method of claim 14, further comprising:

detecting a pressure in a fluid line in communication with the needle; and stopping injection when a threshold pressure is detected, wherein the threshold pressure indicates the tank volume being full of the liquid vaporizable material.

20. The method of claim 1, wherein a middle portion of the wick is positioned between the opposing ends of the wick and outside of the tank volume.

21. The method of claim 14, wherein a middle portion of the wick is positioned between the opposing ends of the wick and outside of the tank volume.

22. The method of claim 10, wherein a first end of the opposing ends of the wick is positioned in a first volume of the tank volume and a second end of the opposing ends of the wick is positioned in a second volume of the tank volume.

23. The method of claim 16, wherein a first end of the opposing ends of the wick is positioned in a first volume of the tank volume and a second end of the opposing ends of the wick is positioned in a second volume of the tank volume.

24. The method of claim 14, wherein the wick is substantially parallel to the elastomeric material.

25. The method of claim 1, wherein the wick is porous.

26. The method of claim 14, wherein the wick is porous.

27. A non-transitory computer-readable medium storing instructions, which when executed by at least one data processor, result in operations comprising:

positioning a first side of a vaporizer cartridge above a second side of a vaporizer cartridge, wherein a wick is positioned proximate to a first end of the vaporizer cartridge and an elastomeric material is positioned proximate to a second end of the vaporizer cartridge, wherein the first side and the second side respectively extend between the first end and the second end, and wherein opposing ends of the wick are in communication with a tank volume of the vaporizer cartridge;

inserting a needle through the elastomeric material and into the tank volume;

injecting, through the needle, the liquid vaporizable material-into the tank volume; and venting air out of the tank volume through the wick thereby allowing filling of the tank volume with the liquid vaporizable material.

28. The non-transitory computer-readable medium of claim 27, wherein the vaporizer cartridge further comprises a cannula disposed within the tank volume thereby forming a first volume of the tank volume, a second volume of the tank volume, and a passageway extending along a side of the cannula between the first volume and the second volume.

29. The non-transitory computer-readable medium of claim 28, wherein the operations further comprise:

filling a first volume of the tank volume and a second volume of the tank volume with the liquid vaporizable material, wherein the first volume and the second volume are formed in part by a cannula disposed within the tank volume, and wherein the first volume is substantially filled prior to the second volume being substantially filled.

30. The non-transitory computer-readable medium of claim 27, wherein the operations further comprise:

detecting a pressure in a fluid line in communication with the needle; and stopping injection when a threshold pressure is detected, wherein the threshold pressure indicates the tank volume being full of the liquid vaporizable material.

31. The non-transitory computer-readable medium of claim 27, wherein a middle portion of the wick is positioned between the opposing ends of the wick and outside of the tank volume.

32. The non-transitory computer-readable medium of claim 29, wherein a first end of the opposing ends of the wick is positioned in a first volume of the tank volume and a second end of the opposing ends of the wick is positioned in a second volume of the tank volume.

33. The non-transitory computer-readable medium of claim 27, wherein the wick is substantially parallel to the elastomeric material.

34. The non-transitory computer-readable medium of claim 27, wherein the wick is porous.

35. A system, comprising:

at least one data processor; and at least one memory storing instructions which, when executed by the at least one data processor, result in operations comprising:

positioning a first side of a vaporizer cartridge above a second side of a vaporizer cartridge, wherein a wick is positioned proximate to a first end of the vaporizer cartridge and an elastomeric material is positioned proximate to a second end of the vaporizer cartridge, wherein the first side and the second side respectively extend between the first end and the second end, and wherein opposing ends of the wick are in communication with a tank volume of the vaporizer cartridge;

inserting a needle through the elastomeric material and into the tank volume;

injecting, through the needle, the liquid vaporizable material-into the tank volume; and venting air out of the tank volume through the wick thereby allowing filling of the tank volume with the liquid vaporizable material.

36. The system of claim 35, wherein the vaporizer cartridge further comprises a cannula disposed within the tank volume thereby forming a first volume of the tank volume, a second volume of the tank volume, and a passageway extending along a side of the cannula between the first volume and second volume.

37. The system of claim 36, wherein the operations further comprise:

filling a first volume of the tank volume and a second volume of the tank volume with the liquid vaporizable material, wherein the first volume and the second volume are formed in part by a cannula disposed within the tank volume, and wherein the first volume is substantially filled prior to the second volume being substantially filled.

38. The system of claim 35, wherein the operations further comprise:

detecting a pressure in a fluid line in communication with the needle; and stopping injection when a threshold pressure is detected, wherein the threshold pressure indicates the tank volume being full of the liquid vaporizable material.

39. The system of claim 35, wherein a middle portion of the wick is positioned between the opposing ends of the wick and outside of the tank volume.

40. The system of claim 37, wherein a first end of the opposing ends of the wick is positioned in a first volume of the tank volume and a second end of the opposing ends of the wick is positioned in a second volume of the tank volume.

41. The system of claim 35, wherein the wick is substantially parallel to the elastomeric material.

42. The system of claim 35, wherein the wick is porous.

* * * * *